US006543374B2

(12) United States Patent
Terao

(10) Patent No.: US 6,543,374 B2
(45) Date of Patent: Apr. 8, 2003

(54) SEWING APPARATUS AND STORAGE MEDIUM FOR THE SAME

(75) Inventor: Akira Terao, Nagoya (JP)

(73) Assignee: Brother Kogyo Kabushiki, Nagoya (JP)

( * ) Notice: Subject to any disclaimer, the term of this patent is extended or adjusted under 35 U.S.C. 154(b) by 0 days.

(21) Appl. No.: 10/106,194

(22) Filed: Mar. 27, 2002

(65) Prior Publication Data

US 2002/0100403 A1 Aug. 1, 2002

Related U.S. Application Data

(63) Continuation-in-part of application No. 10/002,288, filed on Dec. 5, 2001.

(30) Foreign Application Priority Data

Dec. 6, 2000 (JP) ..... 2000-372050
Jan. 19, 2001 (JP) ..... 2001-10966
Mar. 30, 2001 (JP) ..... 2001-099259

(51) Int. Cl.[7] ..... D05B 19/12; D05B 21/00

(52) U.S. Cl. ..... 112/470.05; 112/102.5; 112/277; 112/475.19

(58) Field of Search ..... 112/470.05, 470.06, 112/470.01, 475.19, 102.5, 285, 293, 294, 275, 270, 277; 700/136, 137, 138

(56) References Cited

U.S. PATENT DOCUMENTS 3,385,247 A 5/1968 Johnson et al.
3,749,039 A 7/1973 Fritts
4,077,339 A 3/1978 Bass et al.
4,100,867 A 7/1978 Bass et al.
4,549,496 A 10/1985 Kile
5,803,001 A 9/1998 Shimizu et al.
5,904,108 A * 5/1999 Tanaka et al. ..... 112/102.5

FOREIGN PATENT DOCUMENTS

JP 2621184 4/1997
JP A 10-151287 6/1998
JP 11-267389 10/1999
JP 2002-20964 1/2002

OTHER PUBLICATIONS

U.S. patent application Ser. No. 09/897,393, Shimizu, filed Jul. 3, 2001.
U.S. patent application Ser. No. 09/897,600, Mamiya et al., filed Jul. 3, 2001.

* cited by examiner

*Primary Examiner*—Peter Nerbun
(74) *Attorney, Agent, or Firm*—Oliff & Berridge, PLC

(57) ABSTRACT

An engagement groove provided near a comer of a sewing cartridge is engaged with a pin shaft protruding from a free end side of an oscillating arm oscillatably provided on the front of an engagement plate. A tip of an engaging member rotatably provided to the oscillating arm is engaged with an engagement portion provided on a right side of the sewing cartridge to maintain a posture of the sewing cartridge. An operating member rotatably supported by the engagement plate is used to disengage the engaging member from the engagement portion of the sewing cartridge. A thread cutting device disposed on the back of the engagement plate is actuated in conjunction with the disengagement of the sewing cartridge using the operating member. With the movement of the operating member after thread cutting operation is completed, a limit switch provided on the engagement plate is turned off, so that a signal is not outputted. Then, when an embroidery frame needs to be detached from a sewing apparatus body, the embroidery frame is moved forward to a detachable position. With this structure, the embroidery frame can be detached from the sewing apparatus body after a thread extending between the embroidery frame and the sewing cartridge is surely cut.

16 Claims, 32 Drawing Sheets

SEWING APPARATUS AND STORAGE MEDIUM FOR THE SAME

This application is a continuation-in-part of Ser. No. 10/022,288 filed Dec. 5, 2001.

BACKGROUND OF THE INVENTION

1. Field of Invention

This invention relates to a sewing apparatus that a sewing cartridge can be attached thereto or detached therefrom and a storage medium for the sewing apparatus.

2. Description of Related Art

Conventionally, a sewing apparatus, such as a sewing machine, sews a work cloth using upper and lower threads in cooperation with a thread take-up, a thread loop taker and a needle. The needle is threaded with the upper thread and moves vertically. A regular home sewing machine sews using a single needle attached to a lower end of a needle rod. When the upper thread wound around a spool runs out, or the upper thread needs to be changed to sew a different color of a color pattern, the upper thread, after the spool for the upper thread is changed, is threaded to a predetermined guide portion provided for the sewing machine, then the upper thread needs to be threaded through a needle hole.

A conventional sewing apparatus and sewing cartridge, which can be attached to and detached from the sewing apparatus, includes the sewing cartridge accommodating a needle and a spool therein. However, it is not necessary to thread an upper thread through a needle hole when an upper thread wound around a spool runs out, or the upper thread needs to be changed to sew a color pattern. The omission of threading the upper thread through a needle hole is disclosed in U. S. Pat. No. 4,100,867, the disclosure of which is incorporated herein by reference.

The needle attached to a sewing cartridge is similar to a regular sewing needle wherein a thread is threaded through a needle hole at its lower end. When a sewing cartridge is attached to a sewing apparatus, the needle and the needle up and down mechanism provided to the sewing apparatus are connected to each other so as to move integrally. When a machine motor is running, the needle is moved up and down by the needle up and down driving mechanism with respect to the sewing cartridge fixed to the main body of the sewing machine. Thus, when the operation of a needle passing through a work cloth is repeated, sewing is performed on a work cloth using an upper thread and a looper member.

When the sewing operation is completed, the sewing cartridge and the embroidery frame need to be removed from the sewing apparatus. In this case, the embroidery frame is located, in advance, in a predetermined position provided at the back of the sewing apparatus, so that the thread extending from the sewing cartridge is easily cut by the thread cutting mechanism. However, it is difficult to detach the embroidery frame from the sewing apparatus as it is, so that it is necessary to forcefully move the embroidery frame to the outside of the sewing apparatus.

When the sewing cartridge is replaced with another sewing cartridge, accommodating a different color thread while performing the sewing operation, the thread extending the sewing cartridge needs to be cut by the thread cutting mechanism before the sewing cartridge is detached from the sewing apparatus. However, it is unnecessary to remove the embroidery frame.

In the conventional sewing apparatus, the disengagement of the sewing cartridge from the oscillating arm and the thread cutting operation is performed by a single operating member. There may be a case where the sewing apparatus performs an undesired operation by mistakenly determining that the sewing operation is completed. When this occurs the embroidery frame is forcefully moved to the outside of the sewing apparatus in accordance with the determination as to whether the thread cutting operation is performed. Thus, the instructions to detach the embroidery frame is issued using a separately provided switch.

If a user accidentally operates the operating member during the sewing operation, the sewing cartridge is rotated in a direction to remove the sewing cartridge from the oscillating arm, so that the posture of the sewing cartridge is changed. This results in causing sewing failure and damage to the sewing needle and the like.

SUMMARY OF THE INVENTION

This invention provides a sewing apparatus wherein a holding frame, having a workpiece, detachably attached to a sewing apparatus body is easily removed from the sewing apparatus body. According to this invention control can be achieved such that the holding frame can be surely detached from the sewing apparatus body after a sewing cartridge is detached from the sewing apparatus body and a thread cutting operation is completed. This invention also provides a storage medium for the sewing apparatus.

According to one aspect of the invention, a sewing apparatus includes a needle that moves up and down, a sewing cartridge designed to be able to accommodate a spool therein, a holding frame to which a workpiece is attached, a frame moving member that moves the holding frame, a sewing operation member that performs sewing operation on the workpiece while moving the holding frame in orthogonal directions. A detecting device is also provided that performs at least one of a detection of the presence or absence of the sewing cartridge and a detection of a mounting state of the sewing cartridge, and a sewing control device that moves the holding frame to a detachable position by moving the frame moving device in accordance with a detection signal from the detecting device.

Accordingly, the presence or absence of the sewing cartridge in the sewing apparatus and the posture of the sewing cartridge can be detected. As a result of the detection, if the condition of the sewing apparatus is inappropriate for the sewing operation, the holding frame is controlled so as not to be moved to the detachable position. By doing so, the holding frame is not moved due to accidental operation by the user. Thus, damage to the sewing apparatus and parts of the sewing cartridge can be prevented.

When the sewing cartridge is in the posture where the sewing operation can be stopped, the holding frame is controlled to be moved to the detachable position. With this control, the replacement or detachment of the holding frame can be easily performed.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
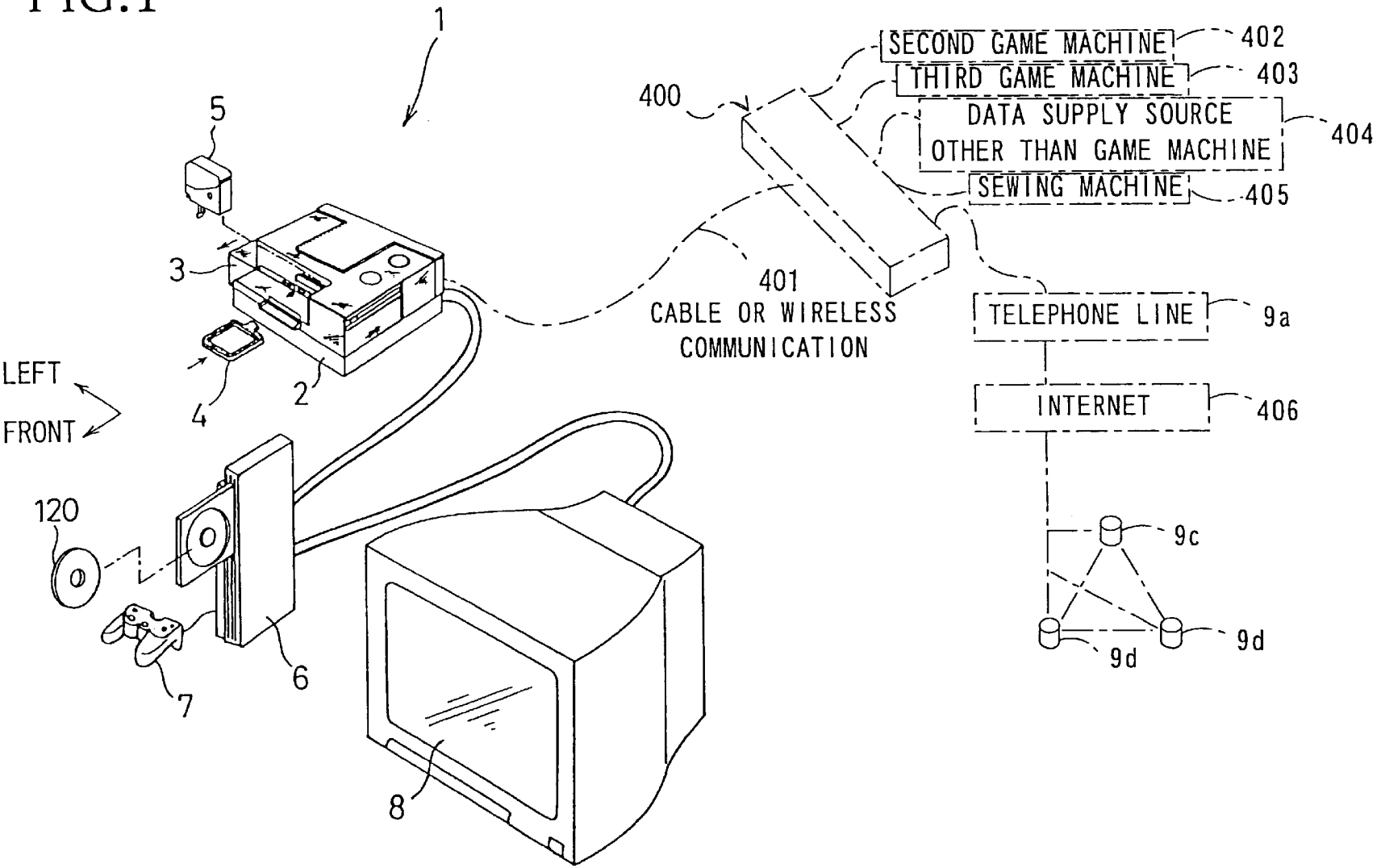
FIG. 1 is a perspective view showing a sewing apparatus according to an exemplary embodiment of this invention and a game machine.

As shown in FIG. 1, a sewing apparatus 1 is connected to a home video game machine 6, including a controller 7 via a cable 6A. In the sewing apparatus 1, an embroidery pattern is selected and edited using the game machine 6 while the embroidery pattern is observed on a display 8. The selected/edited embroidery pattern can be embroidered on a work cloth.

Figure 2:
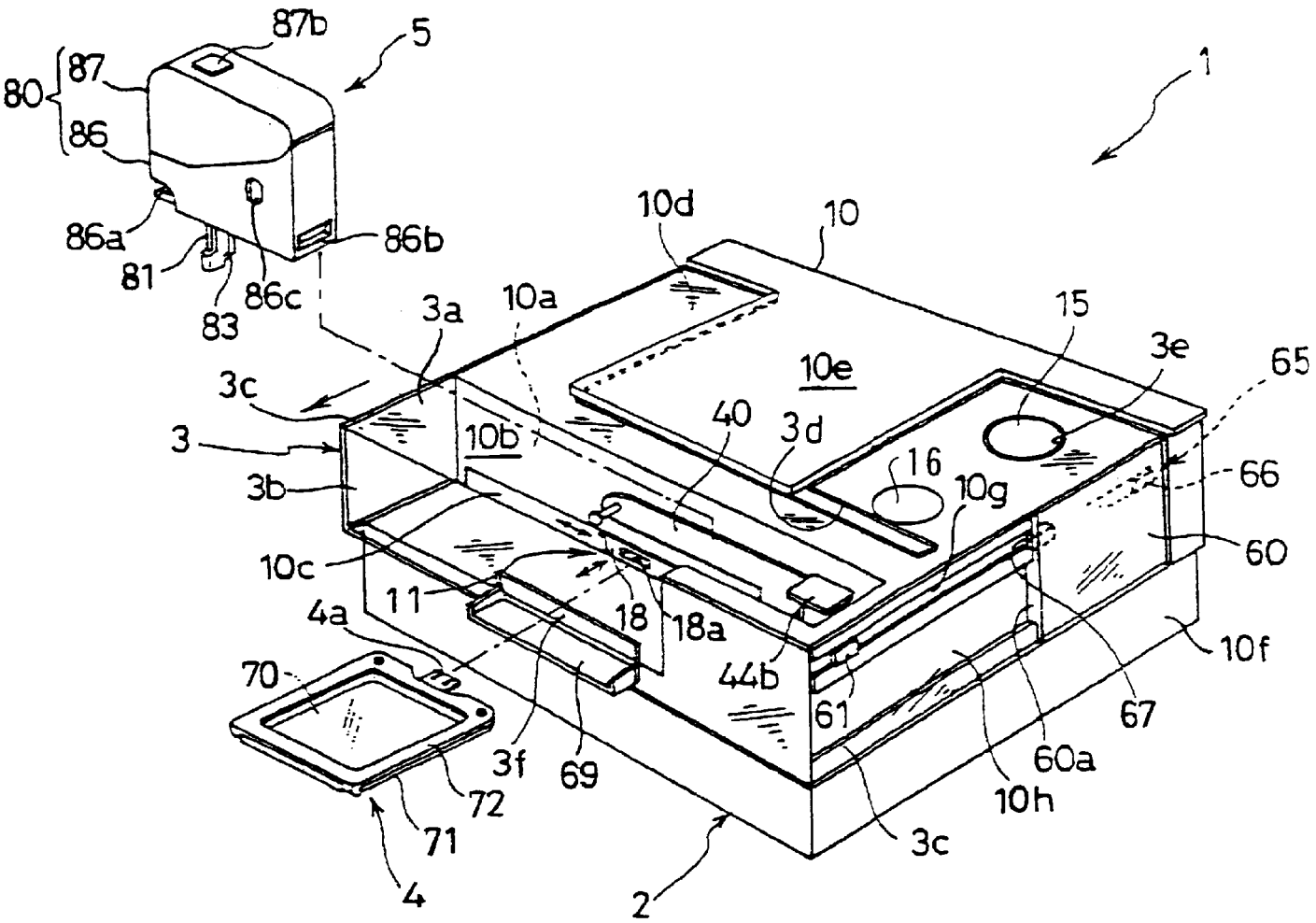
FIG. 2 a perspective view of the sewing apparatus when a safety cover is in a storage position.

As shown in FIGS. 1 and 2, the sewing apparatus 1 includes a sewing apparatus body 2, a safety cover 3 slidably attached to the sewing apparatus body 2 in a back and forth direction, an embroidery frame 4, and a sewing cartridge 5. The embroidery frame 4 and the sewing cartridge 5 are detachably attached to the sewing apparatus body 2. A work cloth 70 to be sewn is held in the embroidery frame 4, and a hollow needle 81, capable of penetrating into the work cloth 70 is provided in the sewing cartridge 5.

Figure 3:
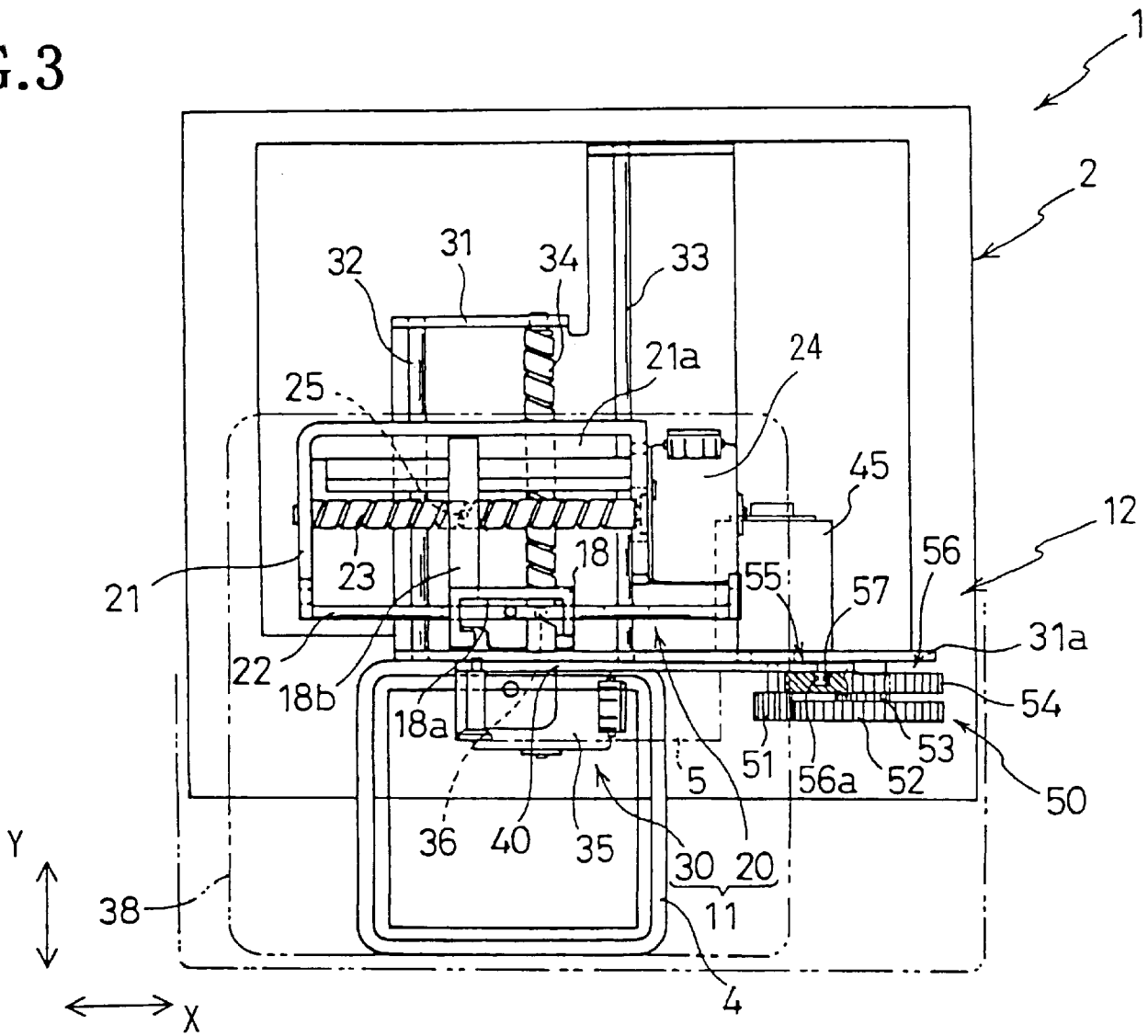
FIG. 3 is a plan view showing an embroidery frame driving mechanism and other mechanisms.
Figure 4:
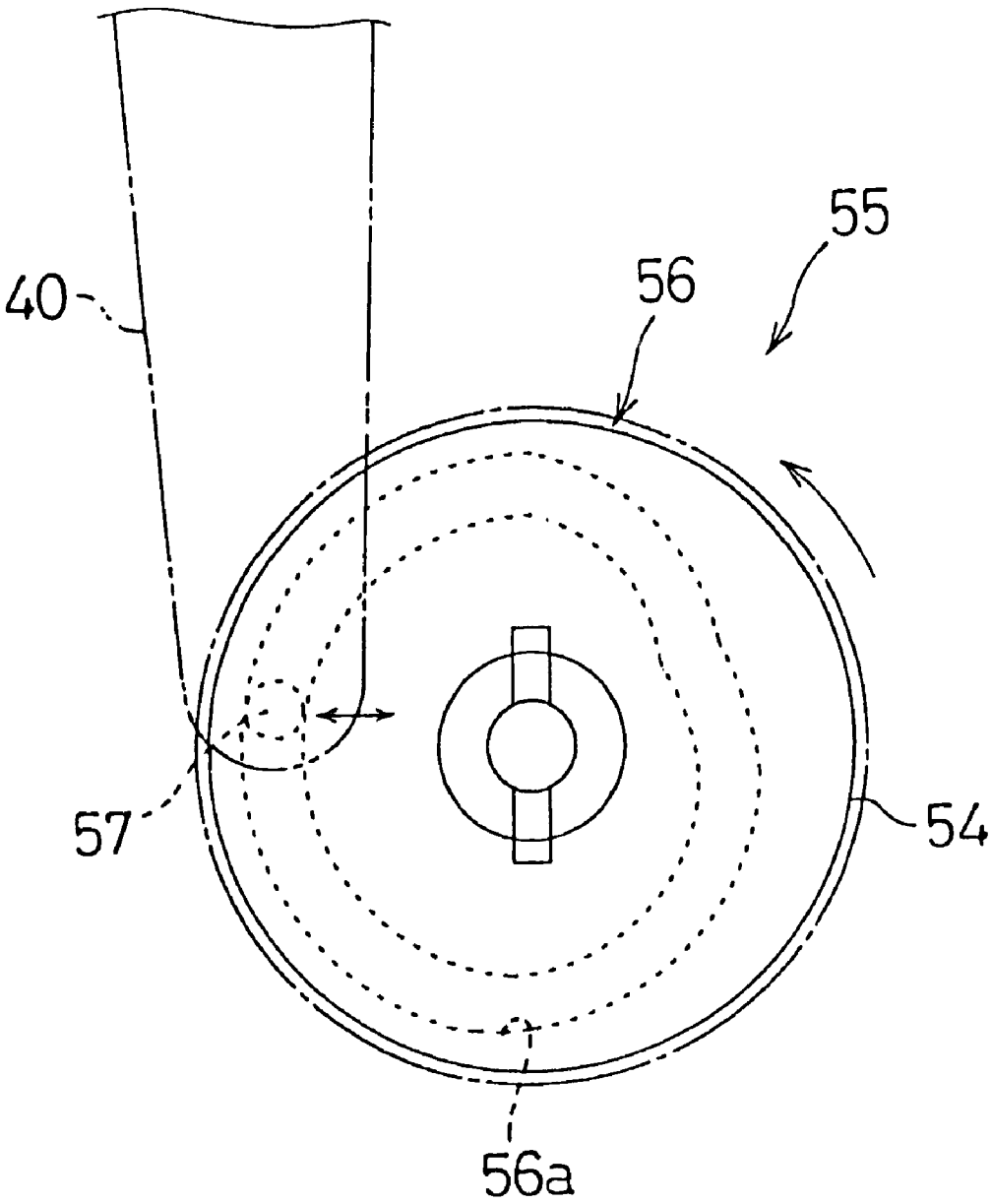
FIG. 4 is a front view of a cam.
Figure 5:
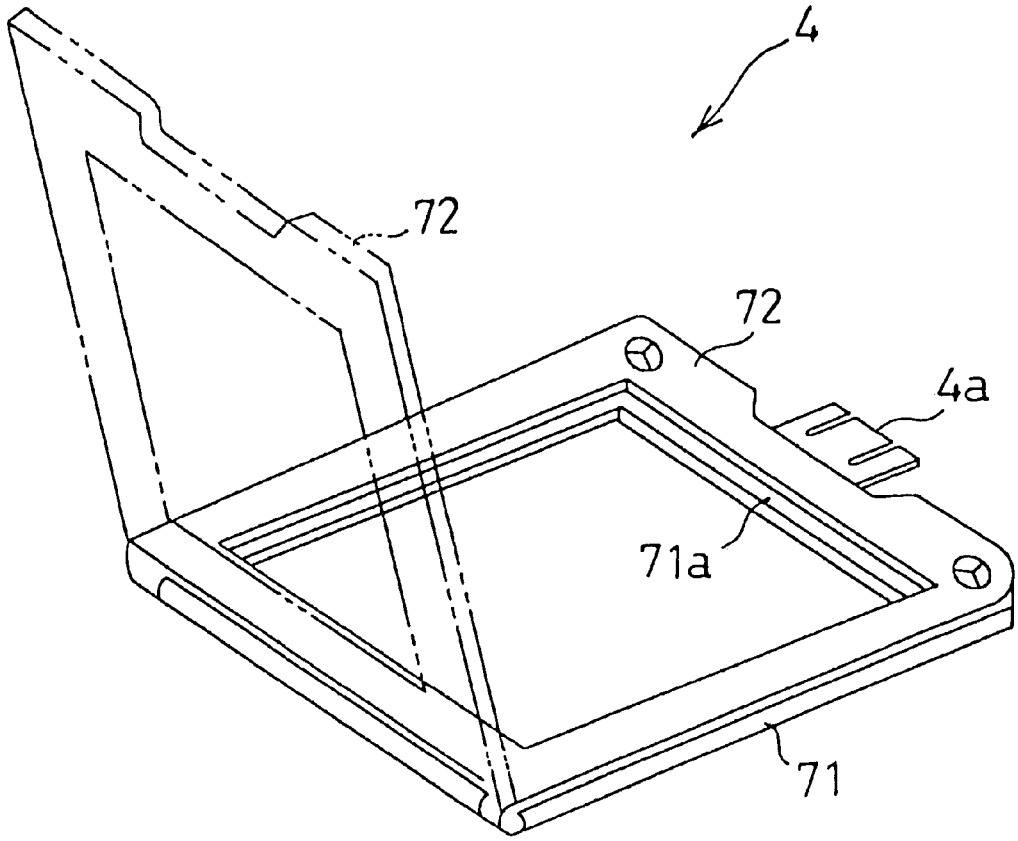
FIG. 5 is a perspective view of an embroidery frame.

As shown in FIGS. 2 to 4, the sewing apparatus body 2 includes a casing 10, an embroidery frame driving mechanism 11 that moves the embroidery frame 4 having the work cloth 70 in a horizontal plane with respect to the hollow needle 81. This occurs while the embroidery frame 4 is held by a carriage 18, and a cartridge driving mechanism 12 swings the sewing cartridge 5, attached to an oscillating arm 40, up and down. An operational controller 13 (see FIG. 36) controls the embroidery frame driving mechanism 11 and the cartridge driving mechanism 12.

The casing 10 is a relatively small rectangular solid, for example, in one embodiment it may be 130 mm long, 165 mm wide and 70 mm high. The casing 10 contains the main parts of the embroidery frame driving mechanism 11 and the cartridge driving mechanism 12, and the operational controller 13. The casing 10 is cut away approximately two-thirds of the way from a left side (as shown in FIGS. 1 and 2) of the casing 10 in the length, approximately one-fourth of the way from a front side, and approximately half of the height from the top. Thus, a cutaway space 10*a* is defined in the casing 10. The right forward part of the upper wall 10*d* of the casing 10 is cut away so that an operating member 44*b* (described later) can be operated. The cutaway portion communicates with the cutaway space 10*a*.

A slit 10*c*, extending in a right and left direction, is formed in a lower end portion of a front wall 10*b* of the casing 10 within the cutaway space 10*a*. The slit 10*c* is provided to attach the embroidery frame 4 to the carriage 18 and to move the embroidery frame 4 in a horizontal plane. A slit extending in a vertical direction (not shown) is formed in the side wall of the casing 10 within the cutaway space 10*a*. The oscillating arm 40 of the cartridge driving mechanism 12 protrudes into the cutaway space 10*a* from the inside of the casing 10 and is vertically movable in the vertical slit.

On an upper wall 10*d* of the casing 10, a guide upper surface 10*e* is formed as a step. A middle area of the guide upper surface 10*e* protrudes toward the front of the casing 10. On the right side of the guide upper surface 10*e* is a power switch 15, electrically connected to the operational controller 13 (FIG. 36), and a start/stop switch 16 (FIG. 2) that starts and stops the sewing. Upper surfaces of the power switch 15 and the start/stop switch 16 are positioned at the same or a slightly lower level than the upper surface of the upper wall 10*d*.

To assist in the attachment/detachment of the sewing cartridge 5 to/from the oscillating arm 40, in front of the guide upper surface 10*e* (described later), a front end of the guide upper surface 10*e* is longer in length in the right and left direction (as shown) than the sewing cartridge 5. Accordingly, the front end of the guide upper surface 10*e* extends toward and behind the sewing cartridge 5 that is attached to the oscillating arm 40.

Guide grooves 10*g* and 10*h* are formed in the front to rear direction in right and left side walls 10*f* of the casing 10. The guide groove 10*g* is narrower than the guide groove 10*h*. An engaging block piece 67 is fixed to each guide groove 10*g* in a substantially mid-position, between the front and backsides, of the casing 10 and protrudes outwardly. Because the cutaway space 10*a* exists in the casing 10, the length of the guide grooves 10*g* and 10*h* in the left wall 10*f* is shorter than that of the guide grooves 10*g* and 10*h* in the right wall 10*f*.

As shown in FIGS. 2 and 3, the embroidery frame driving mechanism 11 includes the carriage 18 to which the embroidery frame 4 is detachably attached, an X-axis direction driving mechanism 20 that drives the carriage 18 in an X direction (the left-right direction as shown) within a horizontal plane. The embroidery frame driving mechanism 11 also includes a Y-axis direction driving mechanism 30 that drives the carriage 18 in a Y direction (the front and rear direction as shown) perpendicular to the X direction, within the horizontal plane.

As shown in FIG. 3, the carriage 18 has an engagement portion 18*a* that can engage/disengage an installation portion 4*a* of the embroidery frame 4 thereto/therefrom and a guide plate 18*b* that extends rearward from the underside of the engagement portion 18*a*. When the embroidery frame 4 is attached to, or detached from the carriage 18, the carriage 18 is positioned under the oscillating arm 40. A moving frame 21 of the X-axis direction driving mechanism 20 is has a guide portion 21*a* in the right and left direction at its rear and is provided with a guide rod 22 in the right and left direction at its front. The carriage 18 is movably supported and guided in the right and left direction by the guide portion 21*a* and the guide rod 22.

The X-axis direction driving mechanism 20 has a moving frame 21, the guide rod 22, a screw shaft 23, a pulse motor 24 (FIG. 36), and a guide pin 25. The moving frame 21 is substantially box shaped and has an open upper portion. The guide rod 22 is supported at its ends by side walls of the moving frame 21. The screw shaft 23 is disposed inside of the moving frame 21, extending in the right and left direction. A left end of the screw shaft 23 is rotatably supported by the left wall of the moving frame 21. The pulse motor 24 is fixed on the right of the right wall of the moving frame 21. An output shaft of the pulse motor 24 is directly connected to a right end of the screw shaft 23.

The guide plate 18*b* of the carriage 18 is disposed above the screw shaft 23. The guide pin 25 is fixed to the guide plate 18*b* so as to protrude downward. The guide pin 25 slidably engages a spiral groove formed in the screw shaft 23. As the screw shaft 23 is rotated by the pulse motor 24, the guide pin 25 is guided along the spiral groove, so that the guide pin 25 moves from side to side. As a result, the carriage 18 is moved in the X direction.

The Y-axis direction driving mechanism 30 has a support frame 31, two guide rods 32, 33, a screw shaft 34, a pulse motor 35, and a guide pin 36. The support frame 31 has a substantially concave shape when viewed from the side. The guide rods 32 and 33, extend in the front to back direction and are supported by the front and the rear walls at their ends. The support frame 31 of the Y-axis driving mechanism 30 is movably supported and guided in the back and forth direction by the guide rods 32, 33.

The screw shaft 34 extends in the front to back direction. The screw shaft 34 is rotatably supported by the rear wall of the support frame 31 at its rear end. The pulse motor 35 is fixed at the front of the front wall of the support frame 31. An output shaft of the pulse motor 35 is directly connected to the front end of the screw shaft 34. The guide pin 36 is fixed to the moving frame 21 so as to protrude downward. The guide pin 36 slidably engages a spiral groove formed in the screw shaft 34. As the screw shaft 34 is rotated by the pulse motor 35, the guide pin 36 is guided along the spiral groove, so that the guide pin 36 moves back and forth. As a result, the carriage 18 is moved in the Y direction together with the moving frame 21. The Y-axis direction driving mechanism 30 is disposed under the X-axis direction driving mechanism 20.

An embroidery frame moving area 38, shown in FIG. 3, is an area in which the embroidery frame 4, attached to the carriage 18, can be moved by the embroidery frame driving mechanism 11. The hollow needle 81 in the sewing cartridge 5 attached to the sewing apparatus body 2 is positioned substantially at a center of the embroidery frame moving area 38. The sewing cartridge 5 is attached to the forward part of the sewing apparatus body 2, so that the embroidery frame moving area 38 extends forward from the casing 10. As described above, the Y-axis direction driving mechanism 30 is disposed under the X-axis direction driving mechanism 20 and each of the driving mechanisms 20 and 30 are positioned under the embroidery frame moving area 38 of the carriage 18. Accordingly, the sewing apparatus body 2 can be downsized.

As shown in FIGS. 3 and 4, the cartridge driving mechanism 12 has the oscillating arm 40 that the sewing cartridge 5 is removably attached to a machine motor 45, that may be an AC motor, as a drive source to move the oscillating arm 40 up and down. The cartridge drive mechanism also has a gear mechanism 50 that reduces the rotation speed of the machine motor 45, and a cam mechanism 55 that converts a rotary motion, reduced in its rotation speed by the gear mechanism 50, into up-and-down movements of the oscillating arm 40.

As shown in FIGS. 14 to 22, the oscillating arm 40 is formed with an arm portion 40*a*, extending in the right and left direction, and a lever portion 40*b*, extending in the up and down direction, which are integral to form a single structure. The oscillating arm 40 is disposed at substantially the right half part of the forward part of the casing 10. The lever portion 40*b* is pivotally supported at its middle portion by a pivot shaft 41*b* which is supported by an engagement plate 19 extending upward via a bracket 41*a*. The largest portion of the arm portion 40*a* protrudes toward the cutaway space 10*a*. The remaining portion, including the lever portion 40*b*, is accommodated in the casing 10.

Figure 8:
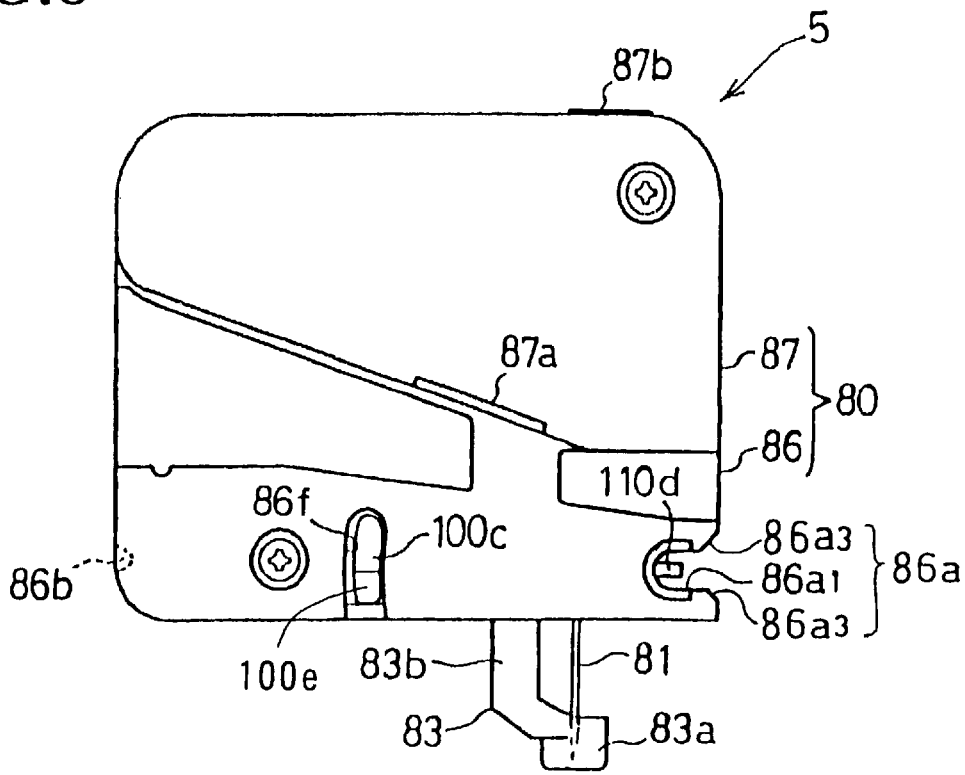
FIG. 8 is a rear view of the sewing cartridge.
Figure 14:
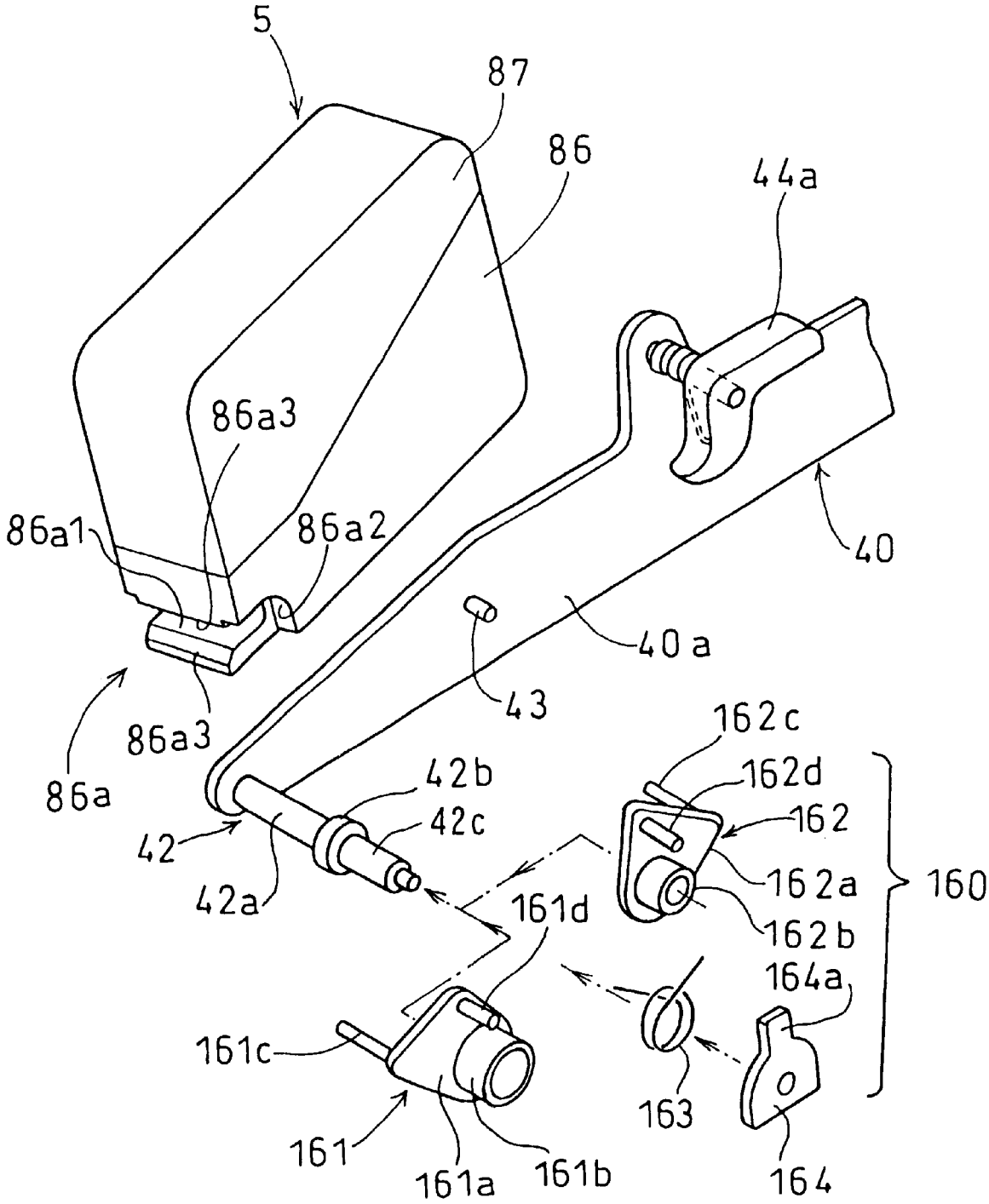
FIG. 14 is an exploded perspective view showing the sewing cartridge, apart of an oscillating arm, and a cartridge setting mechanism.
Figure 15:
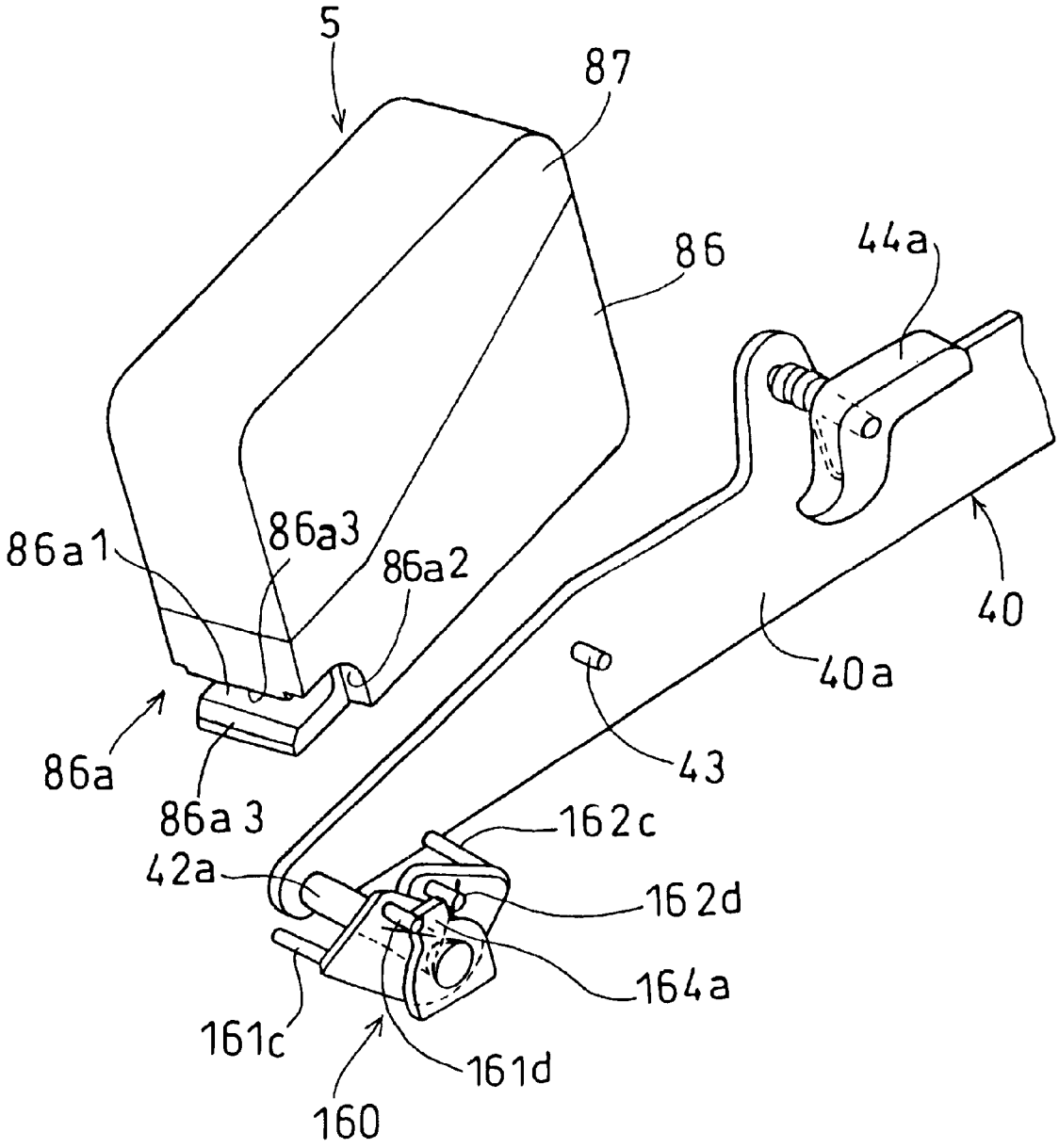
FIG. 15 is a perspective view showing the sewing cartridge, the oscillating arm, and the cartridge setting mechanism when the cartridge setting mechanism is attached to the oscillating arm.
Figure 16:
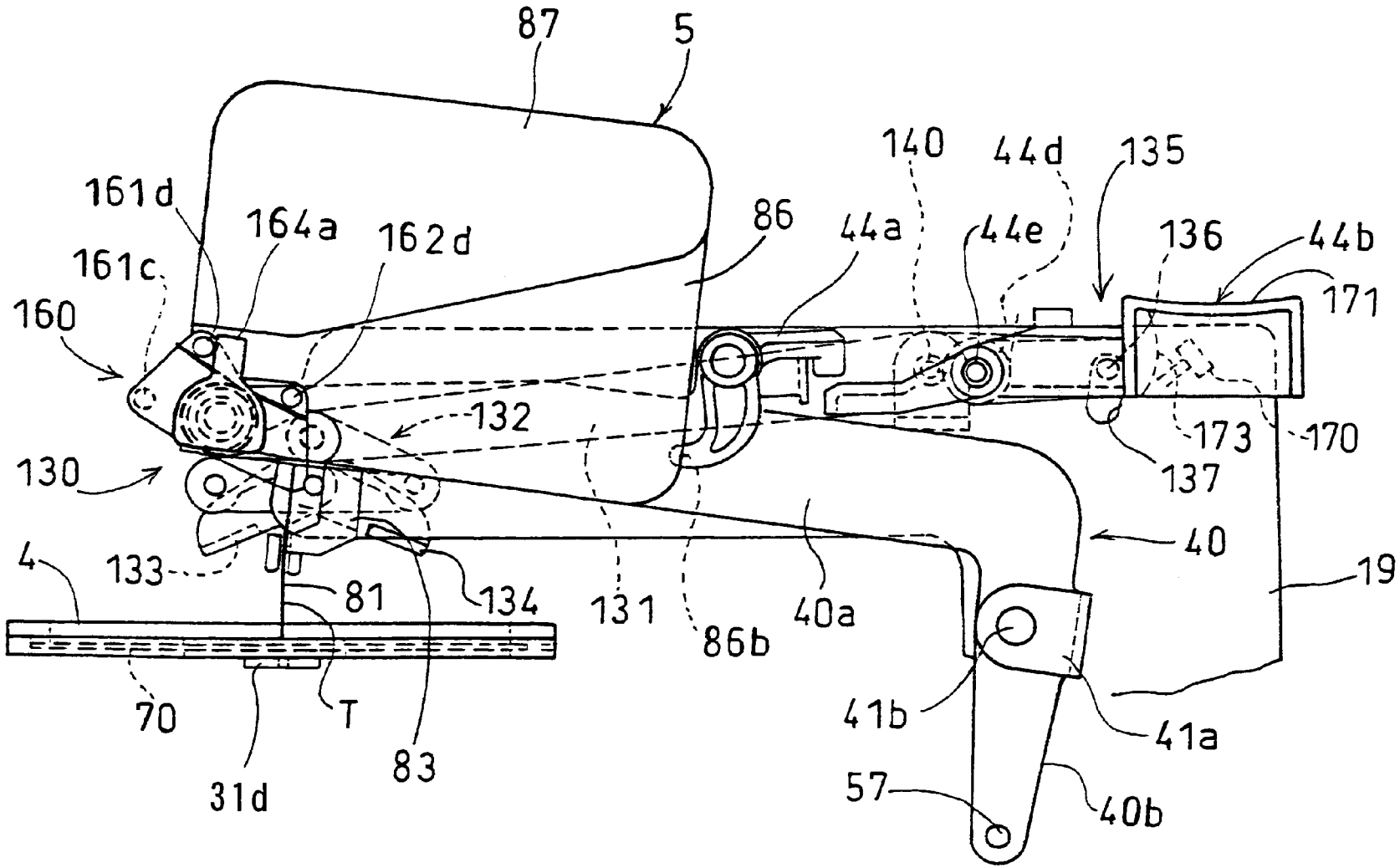
FIG. 16 is a front view of essential parts when the sewing cartridge is attached to the oscillating arm.

As shown in FIGS. 14 to 16, an engaging pin 42, extending from front to rear of the casing 10, is fixed at a left end portion of the arm portion 40*a*, to which the sewing cartridge 5 is rotatably supported. A cartridge setting mechanism 160 is mounted to an end portion of the engaging pin 42. A lock release pin 43, also extending from front to rear, is fixed to the right of the engaging pin 42 so as to protrude frontward. The oscillating arm 40 rotatably supports, at the right of the lock release pin 43, an engaging member 44*a* that regulates the sewing cartridge 5 supported at the engaging pin 42 to a position where sewing is feasible (FIG. 16). As shown in FIG. 8, when the sewing cartridge 5 is attached to the oscillating arm 40, the lock release pin 43 enters an opening 86*f* from below, the lock release pin 43 engages a tapered portion 100*e* of an engaged portion 100*c*. A movement prohibiting member 100 is rotated from a lock position to a lock release position against the urging force from a torsion spring 100*d*, so that a needle cover 84 is unlocked. The engaging pin 42 includes a pin shaft 42*a* and a large-diameter portion 42*b* (see FIG. 14).

As shown in FIGS. 14, 15, 17, and 18, the cartridge setting mechanism 160 includes a pair of setting members 161 and 162, made of synthetic resin, a torsion spring 163, and a retaining member 164. A boss 162*b* provided on a base 162*a* of the right setting member 162 is rotatably fit around an end portion 42*c* of the engaging pin 42. A boss 161*b* provided on a base 161*a* of the left setting member 161 is fit around the boss 162*b* so that it can rotate relatively to the boss 162*b*. A support pin 161*c* protruding rearward from the substrate 161*a* of the left setting member 161 makes contact with a left side surface of the sewing cartridge 5. A support pin 162*c* protruding rearward from the substrate 162*a* of the right setting member 162 makes contact with the bottom of the sewing cartridge 5.

The retaining member 164 is fixed to the end of the engaging pin 42 so that a spacing piece 164*a* is disposed between a stopper pin 161*d* protruding frontward from the base 161*a* of the left setting member 161 and a stopper pin 162*d* protruding frontward from the base 162*a* of the right setting member 162. The stopper pins 161*d* and 162*d* are pressed inwardly by both stopping end portions of the torsion spring 163, so that the left and right setting members 161 and 162 are pivotable on the engaging pin 42 relative to each other (The position of each of the left and right setting members 161 and 162 is determined by an angle between the engaging pin 42 and the support pin 161*c* and 162*c*.). The sewing cartridge 5 attached to the cartridge setting mechanism 160 can be maintained in a position where the right side of sewing cartridge 5 is lifted from a lowest position (the engaging pin 42). (See FIG. 19).

An engagement plate 19, that is integrally formed with the machine frame of the sewing apparatus body 2, is provided behind the oscillating arm 40. The engagement plate 19 extends from the right part of the machine frame of the sewing apparatus body 2 and toward the left (as shown). In front of the engagement plate 19, the operating member 44*b*, that is operated to rotate the engaging member 44*a* in a counterclockwise direction, is operably supported so as to be rotatable about a support shaft 44*e*. A torsion spring 44*d* is provided to the support shaft 44*e* of the operating member 44*b* while its one end is received by a fixing member provided to the engagement plate 19 and its other end is received by a left end portion of the operating member 44*b*. The engagement plate 19 is also provided with a regulating member (not shown) that prevents the operating member 44*b* from being rotated, other than in manual operation. With this structure, the operating member 44*b* is supported in a substantially horizontal position. The engaging pin 42, the lock release pin 43, the engaging member 44*a* and the operating member 44*b* are provided in order to attach and detach the sewing cartridge 5 to and from the oscillating arm 40.

When a free end side of the arm portion 40*a* of the oscillating arm 40 has descended and is in the sewing position (that is, when the hollow needle 81 is positioned near the work cloth 70 held in the embroidery frame 4 or is penetrating the work cloth 70), a left end portion of the operating member 44*b* (with respect to a center of rotation of the operating portion 44*b*) is apart from a right end portion of the engaging member 44*a* (with respect to a center of rotation of the engaging member 44*a*), so that they cannot contact each other.

As shown in FIG. 16, when the free end of the arm portion 40*a* of the oscillating arm 40 has ascended, the left end portion of the operating member 44*b* can contact the right end portion of the engaging member 44*a*, so that the sewing cartridge 5 can be detached from the oscillating arm 40. A positional relationship between the center of rotation of the oscillating arm 40 (the pivot shaft 41*b*) and the center of rotation of the operating member 44*b* (the support shaft 44*e*), a distance between the center of rotation of the operating member 44*b* (the pivot shaft 41*b*) and the left end portion of the operating member 44*b* (the support shaft 44*e*), and a distance between the center of rotation of the engaging member 44*a* and the right end portion of the engaging member 44*a* are set in a fashion such that the above-described operation can be performed.

As shown FIG. 16, the center of rotation of the oscillating arm 40 (the pivot shaft 41*b*), the center of rotation of the operating member 44*b* (the support shaft 44*e*), and the center of rotation of the engaging member 44*a* are positioned so that they form vertexes of a triangle. A distance from the pivot shaft 41*b* to the support shaft 44*e* is set shorter than a distance from the pivot shaft 41*b* to the center of rotation of the engaging member 44*a*. Further, a distance between the support shaft 44*e* and the center of rotation of the engaging member 44*a* is set shorter than the other two sides of the triangle. By doing so, in a position where the free end side of the arm portion 40*a* of the oscillating arm 40 is upwardly moved, the right end portion of the engaging member 44*a* moves into contact with the left end portion of the operating member 44*b*. In a position where the free end side of the arm portion 40*a* of the oscillating arm 40 is moved downwardly (into the sewing position), the right end portion of the engaging member 44*a* is separated from the left end portion of the operating member 44*b*.

The sewing cartridge 5 may be detachable by use of the engaging pin 42 provided on the oscillating arm 40 and the pivotable engaging member 44*a*. Further, the sewing cartridge 5 may be attached to, or detached from the oscillating arm 40 by projecting a projecting piece of an electromagnetic solenoid provided on the engagement plate 19 and pivoting the engaging member 44*a* when the oscillating arm 40 is positioned in a place where sewing is feasible.

The sewing cartridge 5 may be attached to the sewing apparatus body 2 from a horizontal direction so that its vertical movement is regulated with respect to the sewing apparatus body 2. Further, an engaging device that attaches and detaches the sewing cartridge 5 to and from the sewing apparatus body 2 may be an actuator. Further, a needle position sensor may be used to detect that the sewing cartridge 5 is in the sewing position. Further, with the actuator not being operated, the sewing cartridge 5 may be attachable and detachable via the engaging device and the sewing cartridge 5 may be detached from the sewing apparatus body 2 when the needle is at its up position (where most of the needle is retracted into the sewing cartridge 5).

The machine motor 45 is fixed to the back of the right lower portion of the front wall 31*a* of the support frame 31 so that a rotational shaft of the machine motor 45 extends toward the front of the casing 10. A gear mechanism 50 includes gears 51, 52, 53 and 54 disposed in front of the front wall 31*a* of the support frame 31 as shown in FIG. 3. The drive gear 51 is fixed to the output shaft of the machine motor 45. The intermediate gears 52 and 53, which are integrally connected on the same shaft, and the large-diameter gear 54 are rotatably supported at the front wall 31*a*. The drive gear 51 engages the intermediate gear 52. The intermediate gear 53 engages the large-diameter gear 54. Thus, rotation speed of the large-diameter gear 54 is reduced with respect to the rotation speed of the machine motor 45 (the drive gear 51).

As shown in FIGS. 3 and 4, the cam mechanism 55 has a cam 56 that is rotatably supported by the front wall 31*a* and a cam follower 57 that is fixedly attached to the right end of the oscillating arm 40 to protrude toward the front. The outer region of the cam 56 is formed with gear teeth of the large-diameter gear 54. A cam groove 56*a* is formed on the back of the cam 56. The cam follower 57 is slidably engaged with the cam groove 56*a*.

Figure 9:
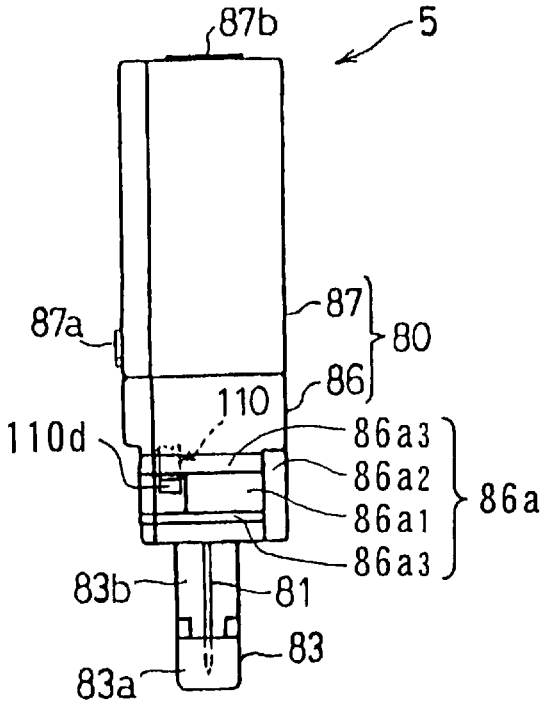
FIG. 9 is a left side view of the sewing cartridge.

As shown in FIG. 4, the cam groove 56*a* is formed into a loop wherein a distance between the cam groove 56*a* and a center of rotation of the cam 56 is changed. When the cam 56 is turned, the arm portion 40*a* travels vertically between an upper limit position and a lower limit position. As a distance between an engaging position where the cam follower 57 engages the cam groove 56*a* and a center of an axis of rotation of the cam 56 becomes longer, the cam follower 57 is located at a further left position and the arm portion 40*a* of the swing arm 40 is located at a further upper position. FIG. 9 shows a state where the cam follower 57 engages a position which is farthest from the center of rotation of the cam 56 in the cam groove 56*a*. In this state, the arm portion 40*a* of the swing arm 40 is in the upper limit position of FIG. 7.

As shown in FIG. 2, the safety cover 3 has the functions of protecting the embroidery frame 4, the sewing cartridge 5, and the oscillating arm 40 which are movable, covering the hollow needle 81 and the embroidery frame moving area 38 (FIG. 3). This is so a user, such as a child, will not be hurt, and may also prevent the occurrence of an undesired operation of the start/stop switch 16. The safety cover 3 can cover the entire embroidery frame moving area 38. The safety cover 3 can be moved between a sewing position, where the safety cover 3 covers the embroidery frame moving area 38 at the time sewing is executed, and a storage position (see FIG. 2), where the safety cover 3 is in a position for storage or packing.

The safety cover 3 is formed of a transparent or a translucent material made of a synthetic resin. The safety cover 3 has an upper wall 3*a*, a front wall 3*b*, and right and left side walls 3*c*. The safety cover 3 does not have a lower wall or a rear wall. The upper wall 3*a* of the safety cover 3 is formed with a recessed area 3*d* which is recessed at the rear, generally center portion. The recessed area 3*d* engages the guide upper surface 10*e* of the casing 10 so that the safety cover 3 can slide back and forth. The lower surface of the upper wall 3*a* of the safety cover 3 can contact the upper surface of the upper wall 10*d* of the casing 10, except for the guide upper surface 10*e*.

A vertical plate 60 is fixed inside of the rear part of each side wall 3*c* of the safety cover 3. An engagement piece 66 is fixed inside of the upper rear portion of each vertical plate 60. An engagement portion 60*a* is integrally formed with each vertical plate 60 under the engagement piece 66. Each engagement piece 66 slidably engages a guide groove 10*g* formed in each side wall 10*f* of the casing 10. The guide groove 10*h* is also formed in each side wall 10*f*. Each engagement portion 60*a* slidably engages a guide groove 10*h*. Inside of the forward part of the right side wall 3*c* of the safety cover 3, is fixed an engagement piece 61, which can slidably engage the guide groove 10*g*.

A stopper mechanism 65 is provided to position the safety cover 3 in the sewing position and to regulate the safety cover 3 so as not to be removed from the sewing apparatus body 2. The stopper mechanism 65 has the engagement pieces 66, which are fixed to each side wall 3*c* of the safety cover 3, and the engagement block pieces 67, which are fixed to each guide groove 10*g* of each side wall 10*f* of the casing 10 and protrude outwardly. When the engagement pieces 66 engage the engagement block pieces 67, the safety cover 3 is in the sewing position. As a result, the safety cover 3 cannot move forward from the sewing position.

In a state where the safety cover 3 is switched to the sewing position, a cartridge insertion slot 68 is defined by the front end of the guide upper surface 10*e* of the casing 10 and the recessed area 3*d* of the safety cover 3. The width of the cartridge insertion slot 68 is substantially equal to the width of the sewing cartridge 5. The length of the cartridge insertion slot 68 is longer than that of the sewing cartridge 5. The sewing cartridge 5 can be attached to the oscillating arm 40 by inserting the sewing cartridge 5 from the cartridge insertion slot 68. When the sewing cartridge 5 is inserted into the safety cover 3 from the cartridge insertion slot 68, the sewing cartridge 5 is guided by the cartridge insertion portion 68 and attached to the oscillating arm 40. In a state where the sewing cartridge 5 is attached to the sewing apparatus body 2, the safety cover 3 is regulated in its position to the sewing position by the sewing cartridge 5.

A switch operating hole 3*e* is formed on the right in the upper wall 3*a* of the safety cover 3. When the safety cover 3 is in the storage position shown in FIG. 2, the switch operating hole 3*e* is opposed to the power switch 15. Therefore, the power switch 15 can be operated via the switch operating hole 3*e*. In this state, the start/stop switch 16 is covered with the safety cover 3, so that the start/stop switch 16 cannot be operated.

The power switch 15 is disposed to the rear of the start/stop switch 16. The distance between centers of the power switch 15 and the start/stop switch 16 is approximately the same as the amount of back-and-forth movement of the safety cover 3. Accordingly, in the state where the safety cover 3 is in the sewing position shown in FIG. 3, the switch operating hole 3*e* is opposed to the start/stop switch 16, so that the start/stop switch 16 can be operated via the switch operating hole 3*e*. That is, the prohibition provided by the safety cover 3 is withdrawn.

When the safety cover 3 is in the sewing position, the power switch 15 is exposed at the rear portion of the safety cover 3, thereby enabling the operation of the power switch 15. The power switch 15 is available when the safety cover 3 is in both the storage position and the sewing position. The power switch 15, the start/stop switch 16, and the switch operation hole 3*e* are formed in substantially the same way as described above.

An embroidery frame insertion slot 3*f* is formed at a substantially middle portion in the right and left direction (perpendicular to the sliding direction of the safety cover 3) of the lower portion of the front wall 3*b* of the safety cover 3. The embroidery frame 4 can be inserted into the safety cover 3 via the embroidery frame insertion slot 3*f*. A guide member 69 protruding forward is fixed to the front wall 3*b*. The guide member 69 guides the embroidery frame 4 in the back and forth direction when the embroidery frame 4 is attached to the carriage 18 by inserting the embroidery frame 4 into the safety cover 3 from the embroidery frame insertion slot 3*f* The embroidery frame insertion slot 3*f* is in a position displaced to the right slightly from a middle position within the moving range of the carriage 18 in the right and left direction (a middle position of the embroidery frame moving area 38 in the right and left direction).

As shown in FIGS. 2, 3, 5, and 6, the embroidery frame 4 is formed with a base frame 71 and a holding frame 72 both having a rectangular shape. The base frame 71 and the holding frame 72 are rotatably connected to each other at their front ends. The installation portion 4*a* is formed integrally with the base frame 71 at the rear end. The embroidery frame 4 can be engaged with and disengaged from the engaging portion 18*a* of the carriage 18 at the installation portion 4*a*. A stepped portion 71*a* is formed to the internal edge of the base frame 71. The stepped portion 71*a* is stepped down with respect to an upper surface of the base frame 71. An outer region of a special work cloth 70 is fit to the stepped portion 71*a*. The work cloth 70 is held by the holding frame 72 and attached to the embroidery frame 4 under tension. The work cloth 70 can be releasably attached to the embroidery frame 4 via a double-sided adhesive tape or an adhesive in some cases.

Figure 6:
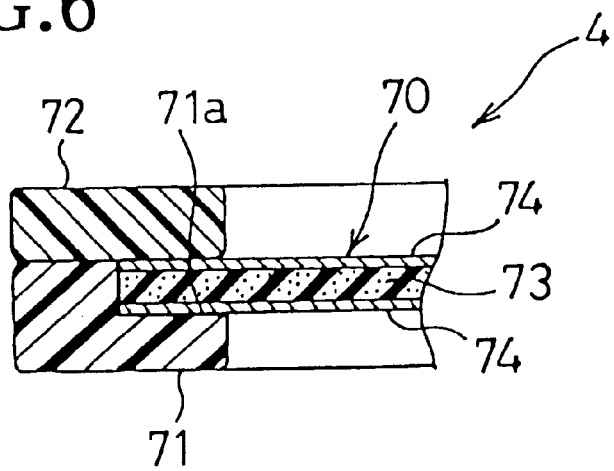
FIG. 6 is a fragmentally vertical sectional view of the embroidery frame.

As shown in FIG. 6, for example, the work cloth 70 is a special cloth that has elasticity and a multi-layer structure formed by which an elastic film member 73 made of urethane is sandwiched between pieces of cloth 74 by lamination. A plurality of sets of the embroidery frame 4 and the work cloth 70 set in the embroidery frame 4 are prepared in advance.

Figure 19:
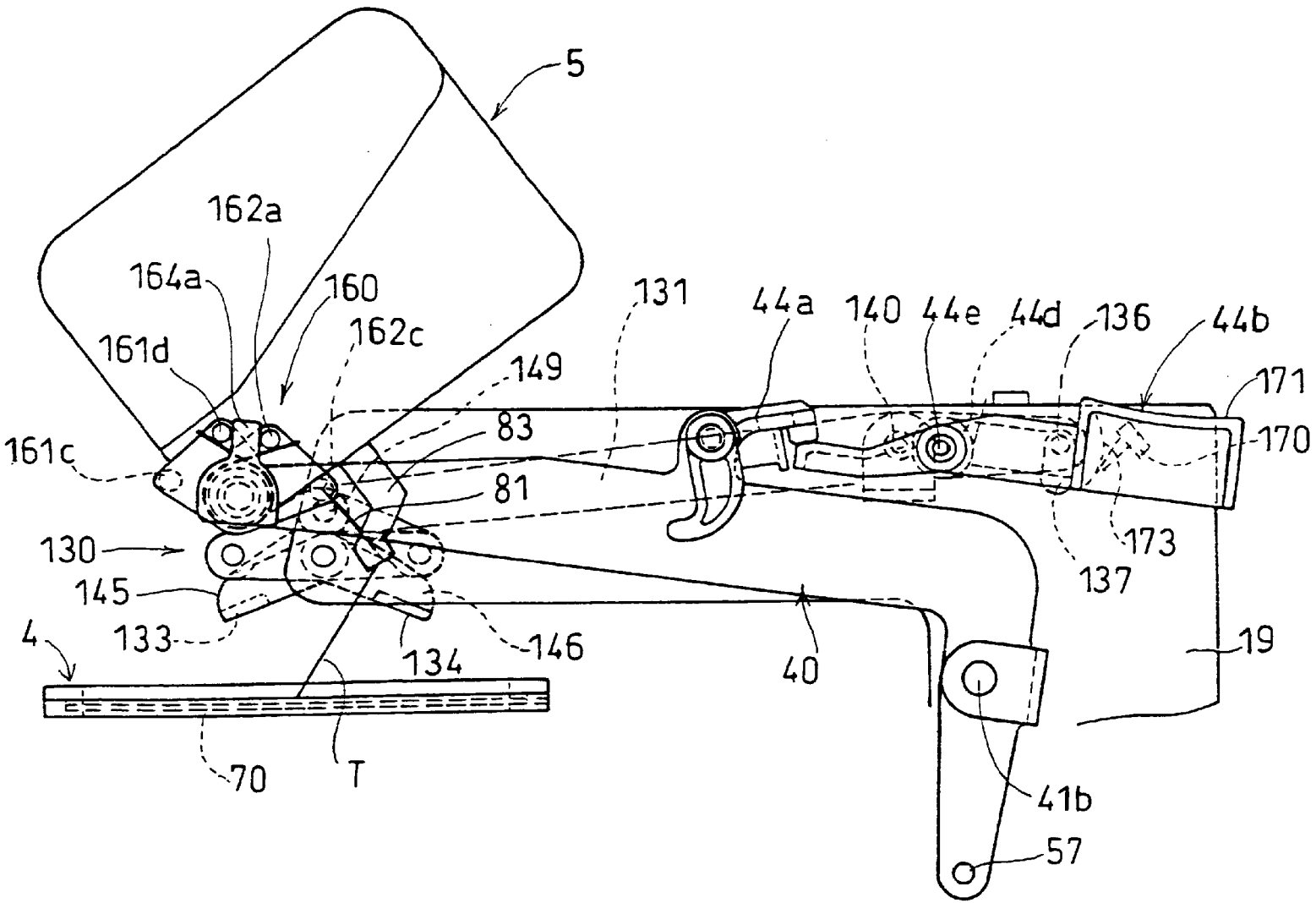
FIG. 19 is a front view of essential parts when the sewing cartridge is being detached from the oscillating arm.

The sewing cartridge 5 will be described below. For all of the discussion below, any direction description related to FIGS. 10–13 is the reverse of the actual directions when the sewing cartridge 5 is mounted in the sewing apparatus, such as shown in FIGS. 1, 16 and 19, for example.

As shown in FIGS. 2, 3, and 7 to 12, the sewing cartridge 5 includes a cassette body 80, the hollow needle 81 that can pass through the work cloth 70, a spool 82 around which a thread T to be supplied to the hollow needle 81 is wound, a needle cover 83 that covers at least a tip of the hollow needle 81, a coil compression spring 84 that urges the needle cover 83 to a cover position where the needle cover 83 covers the hollow needle 81, and a movement prohibiting mechanism 85 that prohibits the movement of the needle cover 83 positioned at the cover position. For this sewing apparatus 1, a plurality of sewing cartridges 5 that can be detachably attached to the oscillating arm 40 are prepared. The sewing cartridges 5 each accommodate different colors, so that a colorful embroidery pattern can be formed using several sewing cartridges 5.

The cassette body 80 has a rectangular shape like a horizontally oriented standing matchbox. The cassette body 80 has a housing case 86 and an openable cover 87. The housing case 86 is movable with respect to the sewing apparatus body 2 in a state where the cassette body 80 is attached to the oscillating arm 40. The openable cover 87 is substantially fixed with respect to the sewing apparatus body 2. The housing case 86 accommodates the upper portion of the hollow needle 81 and the needle cover 83, the spool 82, the coil compression spring 84, and the movement prohibiting mechanism 85. The housing case 86 and the openable cover 87 are rotatably connected to each other at an upper right portion of the cassette body 80 (see FIGS. 10 and 11). The openable cover 87 travels between a closed position shown in FIG. 10 and an open position shown in FIG. 11 with respect to the housing case 86. A torsion spring 88 is attached to a pivot shaft that pivotally supports the openable cover 87 with respect to the housing case 86. The openable cover 87 is rotatably urged to the closed position by the torsion spring 88.

The sewing cartridge 5 includes a housing area 90 wherein the spool 82 is housed, an excessive rotation preventive mechanism 91, a backflow preventive mechanism 92, and a locking mechanism 93. The excessive rotation preventive mechanism 91 prevents the spool 82 accommodated in the housing area 90 from rotating excessively in the thread supply direction so that excessive feeding of the thread T is prevented. The backflow preventive mechanism 92 prevents the thread T from being drawn back to the housing area 90 from the hollow needle 81 by applying resistance to the thread T drawn partway from the spool 82 to the hollow needle 81. The locking mechanism 93 locks the openable cover 87 in the closed position with respect to the housing case 86. The housing area 90, the excessive rotation preventive mechanism 91, and a locking member 110 of the locking mechanism 93 are provided inside the housing case 86. The backflow preventive mechanism 92 and an engaged portion 87*d* of the locking mechanism 93 are provided inside the openable cover 87.

Figure 7:
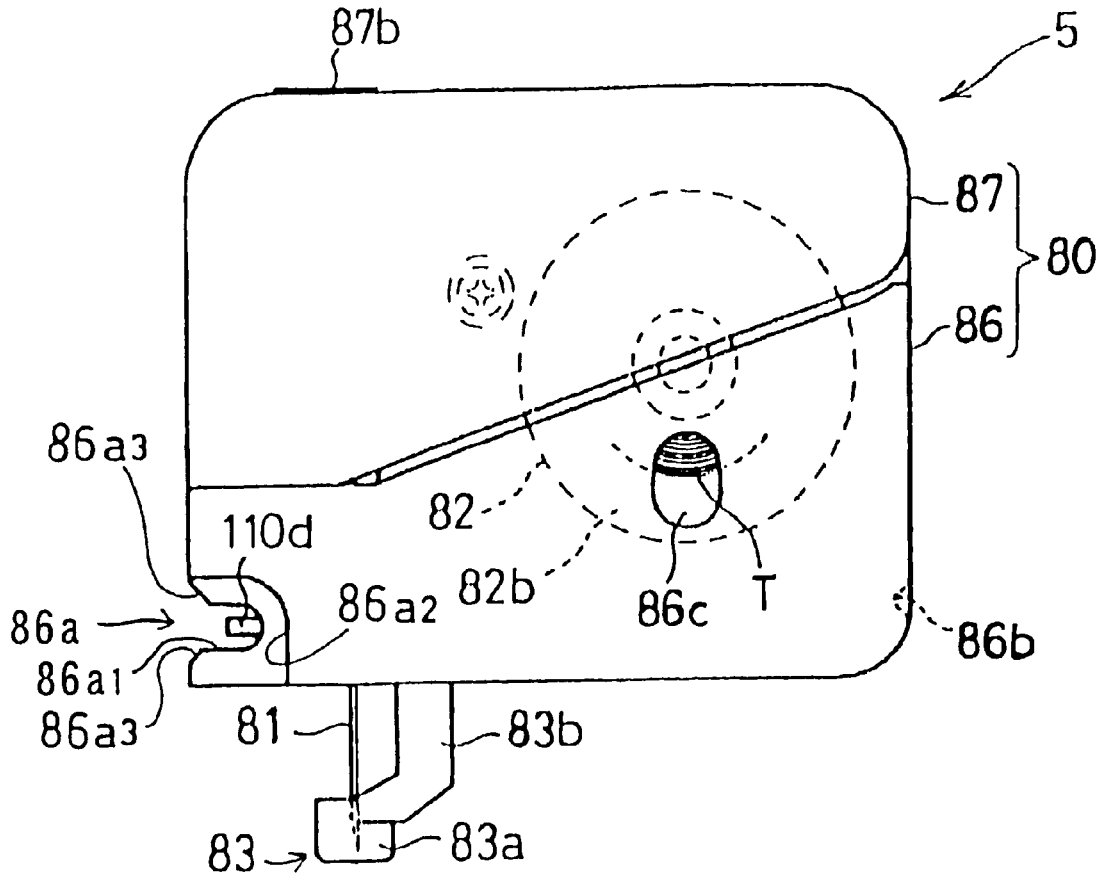
FIG. 7 is a front view of a sewing cartridge.
Figure 11:
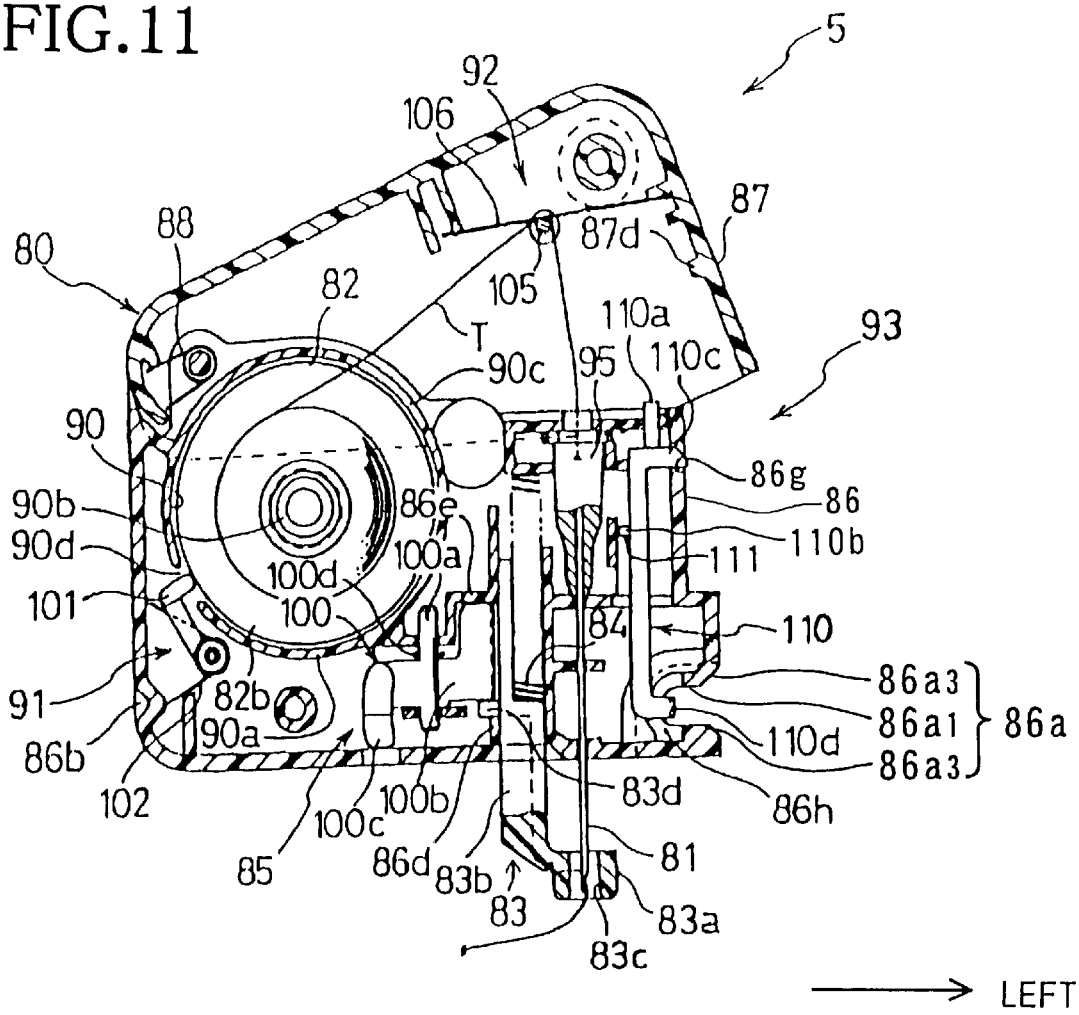
FIG. 11 is a vertical sectional view of the sewing cartridge in an open state.
Figure 12:
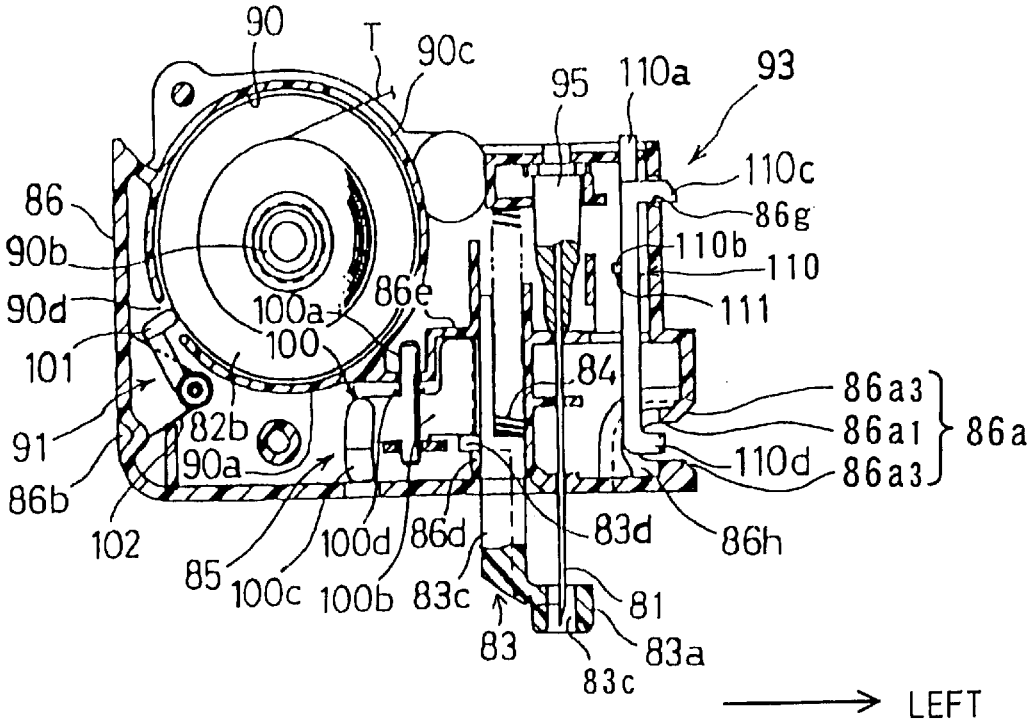
FIG. 12 is a vertical sectional view of a housing case of the sewing cartridge.
Figure 13:
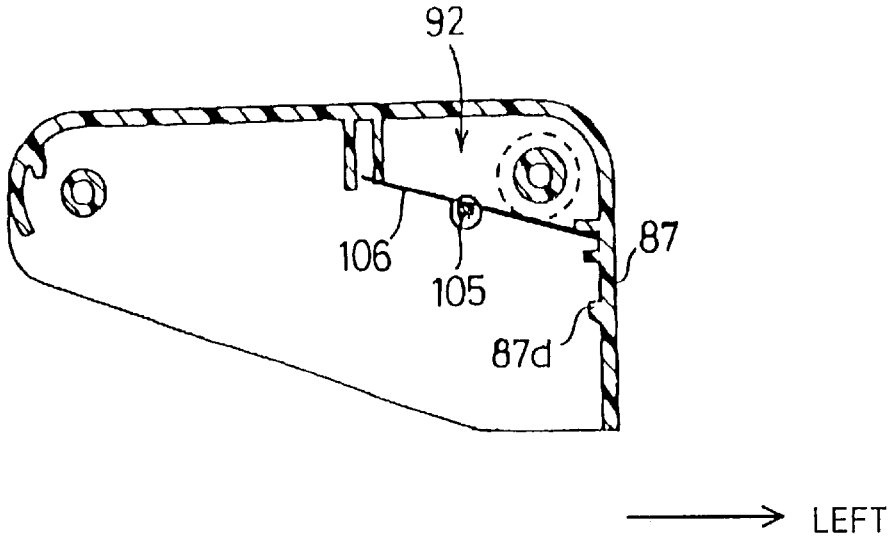
FIG. 13 is a vertical sectional view of an openable cover of the sewing cartridge.

As shown in FIG. 7, a U-shaped engagement groove 86*a* is formed in a lower left portion of the housing case 86 (see FIGS. 11 and 12). The engagement groove 86*a* is cut away from the left and can engage the engaging pin 42 of the oscillating arm 40. The engagement groove 86*a* includes a U-shaped narrow groove portion 86*a*1 and a wide recessed portion 86*a*2. The narrow groove portion 86*a*1 is cut away from the left. The pin shaft 42*a* of the engaging pin 42 rotatably engages the narrow groove portion 86*a*1. The wide recessed portion 86*a*2 is provided so as to connect with the narrow groove portion 86*a*1. The large diameter portion 42*b* of the engaging pin 42 rotatably engages the wide recessed portion 86*a*2. The engagement groove 86*a* also includes connecting portions 86*a*3 that connect the narrow groove portion 86*a*1 and the periphery of the housing case 86 of the sewing cartridge 5. At least one of the connecting portions 86*a*3, 86*a*3 (both connecting portions 86*a*3 opposed each other in the embodiment) is inclined such that the opening of the engagement groove 86*a* becomes wider toward the periphery of the sewing cartridge 5 (see FIG. 14). The connecting portions 86*a*3, 86*a*3 may be curved, instead of straightly included, as long as the opening of the engagement groove 86*a* becomes wider toward the periphery of the sewing cartridge 5. The engagement groove 86*a* opens (to the left when viewed from the front) in a horizontal direction while the sewing cartridge 5 is attached to the sewing apparatus body 2. With this structure, the engaging pin 42 becomes easy to be engaged with the engagement groove 86*a*. An engagement recess 86*b*, that can engage the engaging member 44*a* provided to the oscillating arm 40, is formed in a lower right portion of the housing case 86.

Figure 17:
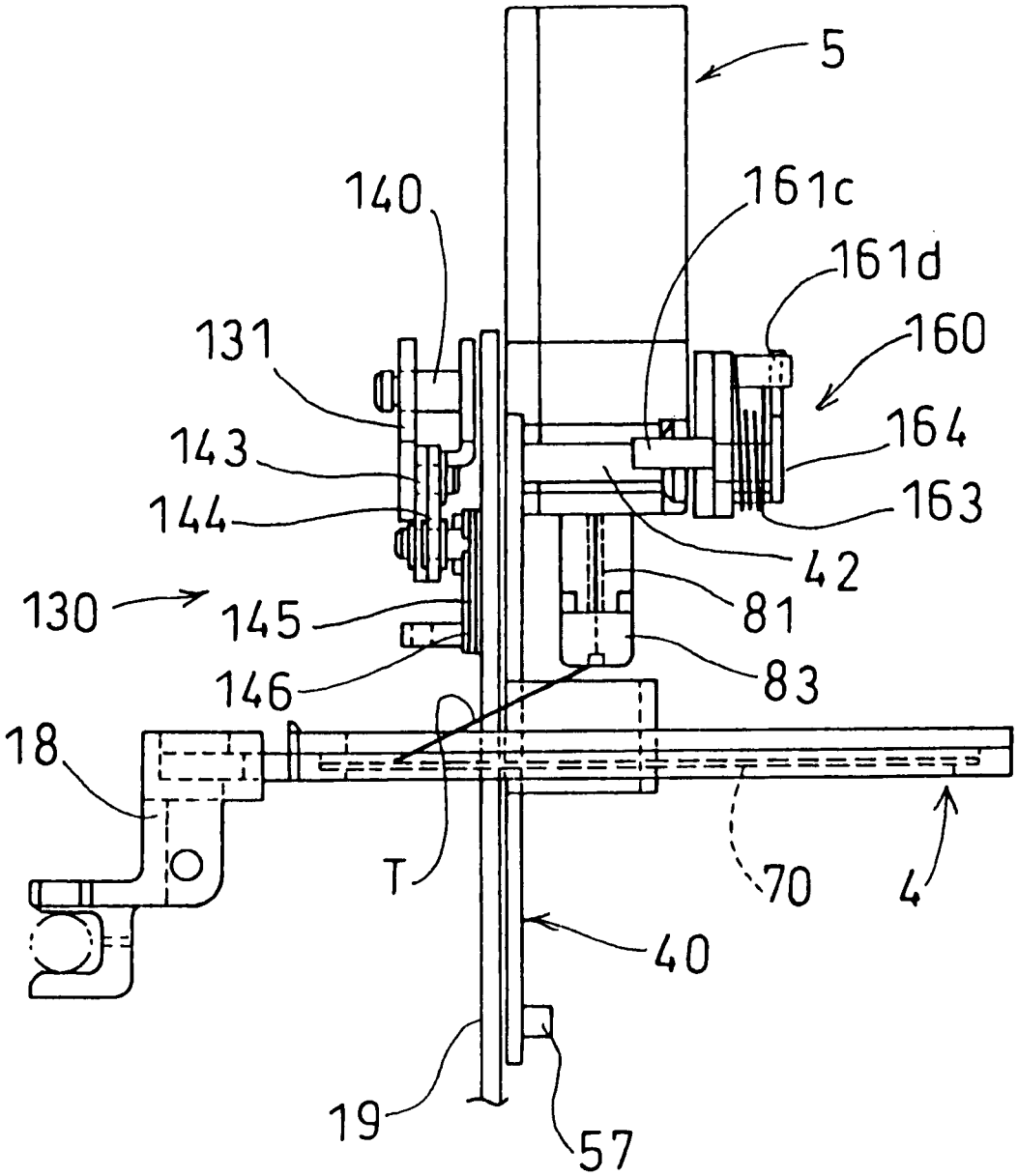
FIG. 17 is a left side view of essential parts of the sewing cartridge of FIG. 16.

Now the attachment and detachment of the sewing cartridge 5 to and from the oscillating arm 40 is described. When the sewing cartridge 5 is attached to the oscillating arm 40, the sewing cartridge 5 is inserted from the cartridge insertion slot 68, formed by the forward movement of the safety cover 3, while inclined leftwardly and downwardly. The engagement groove 86*a* is engaged with the engaging pin 42. At that time, because the connecting portions 86*a*3 which connect the narrow groove portion 86*a*1 and the periphery of the housing case 86 of the sewing cartridge 5, are inclined so that the opening of the engagement groove 86*a* become wider toward the outside as shown in FIG. 17, the pin shaft 42*a* can smoothly engage the narrow groove portion 86*a*1. Further, the large-diameter portion 42*b* provided at substantially the middle of the engaging pin 42 engages the wide recessed portion 86*a*2 connected with the narrow groove portion 86*a*1. Therefore, the sewing cartridge 5 cannot move along the pin shaft 42*a* so that it can be properly fit in a predetermined position.

The sewing cartridge 5 can be held in position where the right side of the sewing cartridge 5 is lifted because the sewing cartridge 5 is supported at the bottom by the right support pin 162*c* and at the left side by the left support pin 161*c*. Accordingly, the sewing cartridge 5 may be more surely prevented from being attached to the oscillating arm 40 in an improper posture by a user.

Then, the sewing cartridge 5 is pivoted clockwise to be in a sewable position where the sewing cartridge 5 is placed in a horizontal position. As shown in FIG. 16, the engaging member 44*a* is engaged and held by the oscillating arm 40 so as to be able to contact the lower right end portion of the sewing cartridge 5. The lower right end portion of the sewing cartridge 5 contacts the engaging member 44*a* slightly before the sewing cartridge 5 reaches the sewable position. As the sewing cartridge 5 reaches the sewable position, the engaging member 44*a* rotates in the counterclockwise direction against an urging force from the torsion spring 44*d*.

Then, the engaging member 44*a* is pivoted in the clockwise direction by the urging force from the torsion spring 44*d* to engage the engagement recess 86*b*, so that the engaging member 44*a* is returned by a small amount. Thus, the housing case 86 is regulated in its pivotal movement and is fixedly attached to the oscillating arm 40. When the sewing cartridge 5 is pivoted to the sewable position, in the cartridge setting member 160, the left stopper pin 161*c* makes contact with the spacing piece 164*a* of the retaining member 164, which is stationary, and is pressed toward the spacing piece 164*a* from outside by one end of the torsion spring 163. At that time, similarly, the right stopper pin 162*d* makes contact with the spacing piece 164*a* and is pressed toward the spacing piece 164*a* from the outside by another end of the torsion spring 163. When the support pin 162*c* of the right setting member 162 is pressed against the bottom of the sewing cartridge 5, the right setting member 162 is moved clockwise in FIG. 16, and the torsion spring 163 is elastically twisted via the stopper pin 162*c*. Thus, while the sewing cartridge 5 is urged upward by the torsion spring 163 in the sewing feasible position, the engaging member 44*a* is engaged in the engagement groove 86*b*, so that the sewing cartridge 5 is attached and its movement is regulated.

When the free end side of the arm portion 40*a* of the oscillating arm 40 is pivoted downwardly toward a substantially horizontal position where the sewing cartridge 5 is in the sewing feasible position, the right end portion of the engaging member 44*a* provided in the middle of the arm portion 40*a* is away from the left end portion of the operating member 44*b* pivotally supported to the engagement plate 19, which is fixed. If a user operates the operating member 44*a* by mistake, the sewing cartridge 5 is not detached from the oscillating arm 40. Therefore, even in a state where the hollow needle 81 protruding from the bottom of the sewing cartridge 5 is penetrating the work cloth 70, the sewing cartridge 5 does not come off of the sewing apparatus body 2 accidentally, which can prevent accidents such as bending of the hollow needle 81 and damage to the work cloth 70.

The sewing cartridge 5 is attached to the oscillating arm 40 in a state where the oscillating arm 40 is in the upper limit position. As described above, when the housing case 86 is fixedly attached to the oscillating arm 40, an engaged portion 87*a* of the openable cover 87 engages a pin (not shown) provided to the engagement plate 19 of the sewing apparatus body 2 so as to abut against it from the above. A guide pin 105 (FIG. 25) provided in the openable cover 87 slightly swings, although the housing case 86 fiercely swings. Thus, the openable cover 87 is substantially fixed with respect to the sewing apparatus body 2. The openable cover 87 may be fixed to the sewing apparatus body 2 or it may be completely fixed to the sewing apparatus body 2.

In a state where the sewing cartridge 5 is in the upper limit position shown in FIG. 16 so that the hollow needle 81 is placed above the work cloth 70 held in the embroidery frame 4, the left end portion of the operating member 44*b* pivotally supported by the engagement plate 19 is placed close to the right end portion of the engaging member 44*a* pivotally supported by the arm portion 40*a*. When the operating member 44*b* is pressed downward (FIG. 19), the engaging member 44*a* is pivoted counterclockwise against the urging force from the torsion spring 44*d* via the operating member 44*b*.

As shown in FIG. 19, the engaging member 44*a* is disengaged from the engagement recess 86*b* as indicated by a solid line. After the operating member 44*b* is pressed downward, the right setting member 162 is urged counterclockwise (FIG. 19) by the torsion spring 163 in the cartridge setting member 160 until the engaging member 44*a* is moved to a position where the engaging member 44*a* does not engage the engagement recess 86*b*, and the sewing cartridge 5 is pivoted upward in the counterclockwise direction. From this state, the sewing cartridge 5 can be removed from the oscillating arm 40 in a manner reverse to the operation for attaching the sewing cartridge 5 to the oscillating arm 40. While the operating member 44*b* is not operated, it is supported in a substantially horizontal position by the torsion spring 44*d*.

The upper wall 10*d* of the casing 10 is cut away to continue to the cutaway space 10*a* so as to expose the operating member 44*b* from the top of the upper wall 10*d*. With respect to the cutaway portion, an opening is formed in the upper wall of the safety cover 3 in the sewing position. Accordingly, the operating member 44*b* can be operated from outside.

As shown in FIG. 7, an opening 86*c* is formed in the front wall in front of the housing area 90 in the housing case 86 of the cassette body 80. A remaining amount of a thread T, wound around the spool 82 housed in the housing area 90 can be visually confirmed from the outside through the opening 86*c*. A thread color indicating portion 87*b* that indicates a same or similar color as the color of the thread T wound around the spool 82, housed in the housing area 90, is provided on a top surface of the openable cover 87 of the cassette body 80. A color chip that is the same as or similar to the color of the thread T may be adhered to the cassette body 80.

Flanges 82*b* of the spool 82 are transparent or translucent. Accordingly, a remaining amount of the thread T wound around the spool 82 housed in the housing area 90 can be visually confirmed from the opening 86*c* through the flange 82*b*. Because the thread color indicating portion 87*b* is provided on the top surface of the openable cover 87, the thread color indicating portion 87*b* is visually exposed to the outside of a state where the sewing cartridge 5 is attached to the sewing apparatus body 2.

The hollow needle 81 is disposed at the left part (FIGS. 2 and 7) of the inside of the cassette body 80 in a substantially standing posture. At least the upper end portion of the hollow needle 81 is supported by a tube-like needle support member 95 (FIGS. 10 to 13) fixedly attached to the housing case 86. The lower end portion of the hollow needle 81 protrudes from the bottom of the cassette body 80. A tip of the hollow needle 81 is pointed such that the tip is inclined rightwardly and downwardly from the left to the right (FIG. 7). When the sewing cartridge 5 is installed in the sewing apparatus body 2, the hollow needle 81 is positioned so that its extreme tip faces a center-of-swing side of the oscillating arm 40.

In FIG. 15, a circular wall 90*a*, which is integrally formed with the housing case 86 and protrudes therefrom, forms the housing area 90 in the left half in the housing case 86. The spool 82 housed in the housing area 90 is fit onto a shaft 90*b* of the housing case 86 and is rotatably supported by the shaft 90*b*. The thread T extending from the spool 82 is fed into the hole formed in the hollow needle 81 from above via the backflow preventive mechanism 92 from a thread passing aperture 90*c* formed in the circular wall 90*a*. The thread T is drawn to the outside of the sewing cartridge 5 from the lower end of the hollow needle 81.

The thread T, wound around the spool 82, is not very heavy. The hole in the hollow needle 81 is formed so that the thread T can be threaded through the hollow needle 81. A sewing operation is performed when a certain length of the thread T is drawn from the lower end of the hollow needle 81.

The needle cover 83 can move between a cover position where the needle cover 83 covers the tip of the hollow needle 81 and a retracted position where the needle cover 83 retracts to a position above the cover position so that the hollow needle 81 can pass through the work cloth 70. The needle cover 83 also serves as a presser foot that holds the work cloth 70 at the time of sewing. The needle cover 83 includes a cover portion 83*a* and a guided portion 83*b* extending upward from the right end of the cover portion 83*a*. The cover portion 83*a* and the guided portion 83*b* are integrated into a single part to form the needle cover 83.

Figure 10:
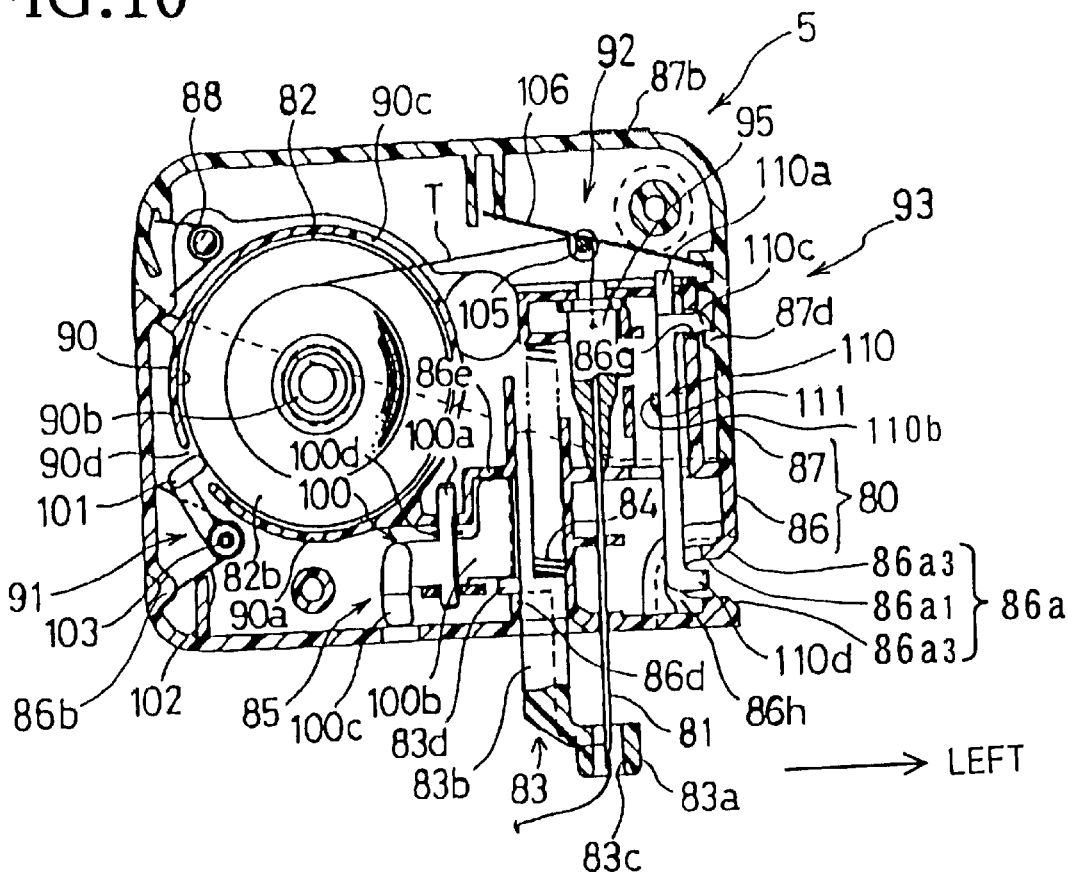
FIG. 10 is a vertical sectional view of the sewing cartridge in a closed state.

The cover portion 83*a* is formed with a needle passing hole 83*c* through which the hollow needle 81 passes. The guided portion 83*b* is vertically movably guided by the housing case 86. The coil compression spring 84 is interposed between the guided portion 83*b* and the housing case 86. A protrusion 83*d*, protruding rightward in FIG. 10, is provided at a middle portion of the guided portion 83*b* in the up and down direction. In a state where the protrusion 83*d* abuts against an upper end of a rib 86*d* that guides the guided portion 83*b* in the up and down direction, the needle cover 83 is in the cover position. Further, the tip of the hollow needle 81 is positioned inside of the needle passing hole 83*c*, so that the tip of the hollow needle 83 is covered with the cover portion 83*a*. As the needle cover 83 moves upward with respect to the hollow needle 81, the needle cover 83 is placed in the retracted position. Thus, the hollow needle 81 passes through the needle passing hole 83*c* and protrudes from the bottom of the cover portion 83*a*.

As shown in FIGS. 10 to 12 and 23 to 25, the movement prohibiting mechanism 85 has a movement prohibiting member 100 disposed at a middle, lower portion, in the right and left direction, inside of the housing case 86. The movement prohibiting member 100 includes a vertical pivot shaft portion 100*a*, a locking portion 100*b* disposed on the left of the pivot shaft portion 100*a* (FIGS. 10 to 12, and 23 and 24) and an engaged portion 100*c*, that engages the lock release pin 43, disposed on the right of the pivot shaft portion 100*a*. The vertical pivot shaft portion 100*a*, the locking portion 100*b*, and the engaged portion 100*c* are integral and form a unitary structure. In the movement prohibiting member 100, the pivot shaft portion 100*a* is pivotally supported to the housing case 86, so that the movement prohibiting member 100 is rotated about the pivot shaft portion 100*a*. The movement prohibiting member 100 cannot move vertically.

The locking portion 100*b* is relatively long in the up and down direction. The lower end of the locking portion 100*b* substantially abuts against an upper surface of the protrusion 83*d* of the needle cover 83 in the cover position, that is, where the lower surface of the protrusion 83*d* is abutted against the upper surface of the rib 86*d*. In this state, the locking portion 100*b* is positioned between a rib 86*e*, in the cassette body 80, and the protrusion 83*d*. Thus, the needle cover 83 is locked in the cover position, and cannot move upward. The movement prohibiting member 100 can be rotated between a locked position (see FIG. 23) and an unlocked position (see FIG. 24) where the locking portion 100*b* is moved out of the way of the up and down movement of the protrusion 83*d* between the rib 86*e* and the rib 86*d* (FIG. 10). Therefore, when the movement prohibiting member 100 is placed in the unlocked position, the needle cover 83 can be movable if the needle cover 83 is pushed upwardly against the elastic force from the coil compressing spring 84. The needle cover 83 is pushed upwardly when the sewing cartridge 5 is moved to the sewing position by the movement of the oscillating arm 40. At that time, the needle cover 83 is pushed against a needle plate 31*d* (FIG. 16), having a hole through which the hollow needle 81 can pass, formed on the support frame 31, via the work cloth 70.

Figure 23:
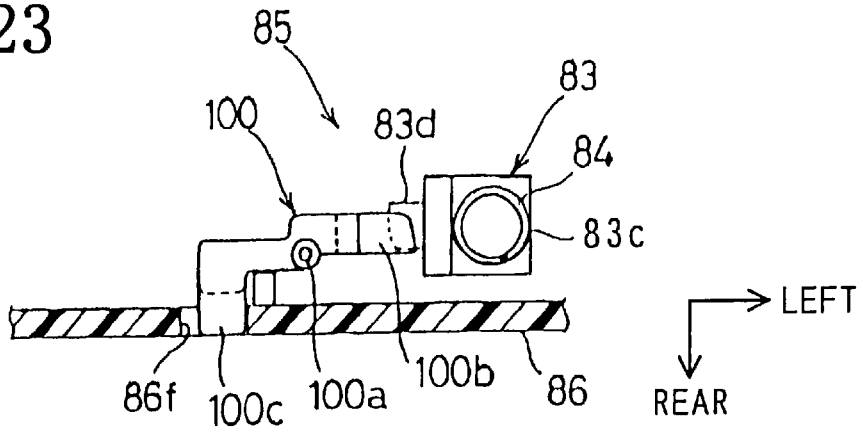
FIG. 23 is a plan view of a movement prohibiting mechanism in a locked position.
Figure 24:
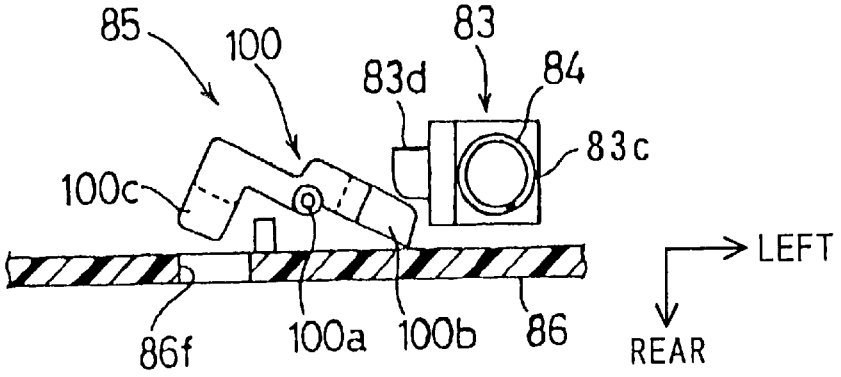
FIG. 24 is a plan view of the movement prohibiting mechanism in an unlocked position.

A torsion spring 100*d* is attached to the pivot shaft portion 100*a*. The movement prohibiting member 100 is rotatably urged to the locked position by the torsion spring 100*d*. In a state where the sewing cartridge 5 is not attached to the sewing apparatus body 2, the movement prohibiting member 100 is maintained in the locked position. The rear wall of the housing case 86 is formed with an opening 86*f* corresponding to the engaged portion 100*c* (FIGS. 10 and 11). When the movement prohibiting member 100 is in the locked position, the engaged portion 100*c* protrudes toward the outside from the opening 86f (FIG. 23).

Figure 25:
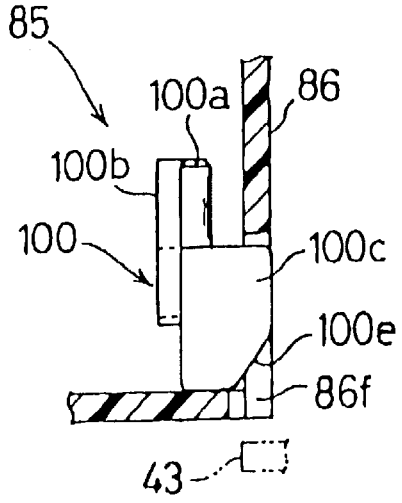
FIG. 25 is a side view of the movement prohibiting mechanism.
Figure 26:
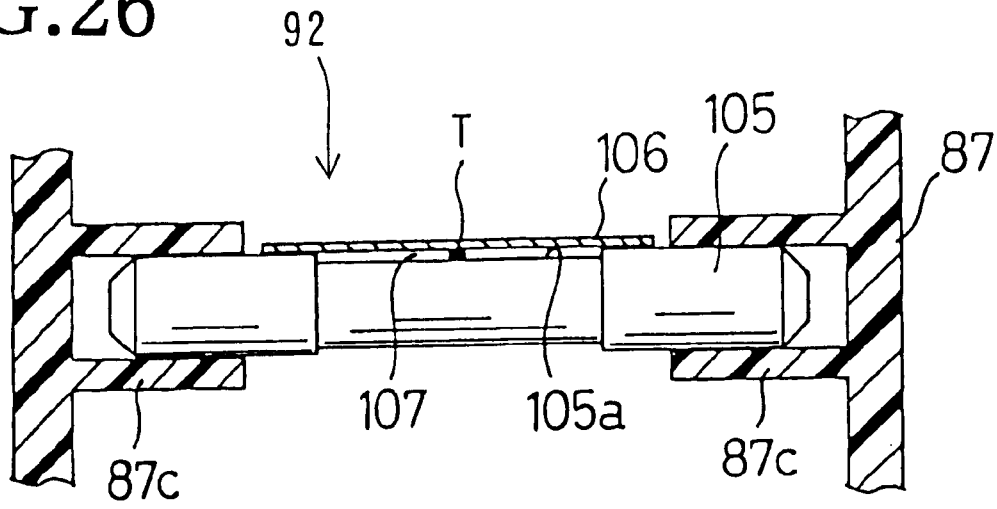
FIG. 26 is a vertical sectional view of a backflow preventive mechanism.
Figure 27:
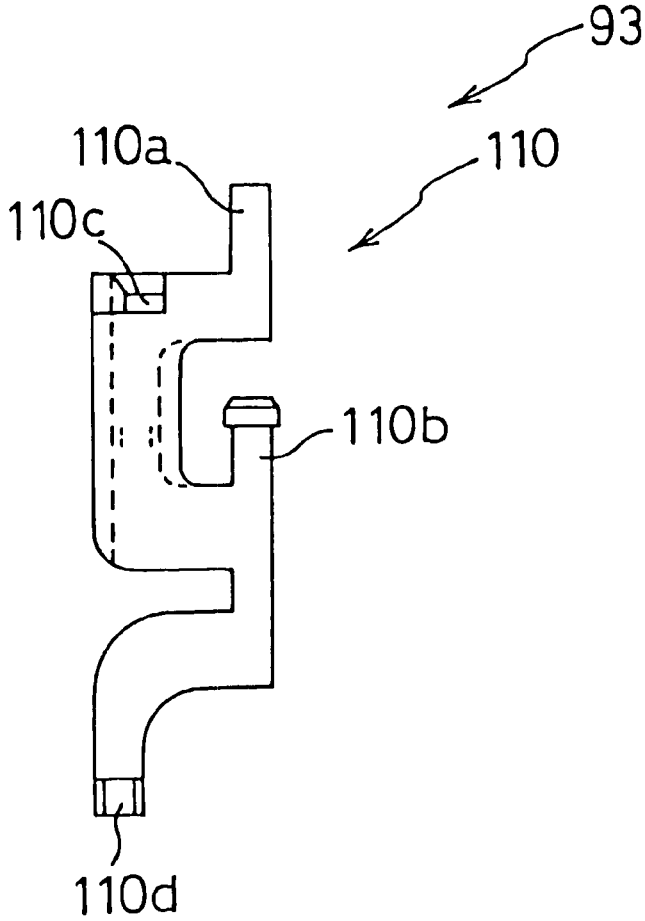
FIG. 27 is a side view of a locking member of a locking mechanism.

As shown in FIG. 25, the opening 86*f* extends to the lower wall of the housing case 86. The bottom of the engaged portion 100*c* is formed with a tapered portion 100*e* that inclines externally and upwardly. As described above, the lock release pin 43 is provided to the oscillating arm 40. When the sewing cartridge 5 is attached to the oscillating arm 40, the lock release pin 43 enters into the opening 86*f* from the bottom and engages the tapered portion 100*e* of the engaged portion 100*c*. As a result, the movement prohibiting member 100 is rotated from the locked position to the unlocked position against the urging force from the torsion spring 100*d* (FIGS. 10 and 11), so that the needle cover 83 is unlocked and can be movable upwardly as described above.

In the state where the sewing cartridge 5 is not attached to the sewing apparatus body 2, as described above, the movement prohibiting member 100 prohibits the needle cover 83 in the cover position from moving therefrom. In the state where the sewing cartridge 5 is attached to the sewing apparatus body 2, the needle cover 83 is allowed to move from the cover position to the retracted position.

As shown in FIGS. 10 to 12, the excessive rotation preventive mechanism 91 has a contact 101 that can contact one of the flanges 82*b* of the spool 82, and a torsion spring 102 that urges the contact 101 against the flange 82*b*. By the friction produced between the contact 101 and the flanges 82b, the spool 82 is prevented from excessively rotating in the thread supply direction to prevent the excessive feeding of the thread T. The contact 101 is pivotally supported by a shaft 103 disposed near the housing area 90 in the housing case 86. The shaft 103 is provided with the torsion spring 102. The tip of the contact 101 contacts the flange 82*b* of the spool 82 in the housing area 90 by passing through an aperture 90*d* formed in the circular wall 90*a*.

As shown in FIGS. 10, 11, 13 and 26, the backflow preventive mechanism 92 has two backflow preventive members, the guide pin 105 and a leaf spring 106 abutting against the guide pin 105. Between the guide pin 105 and the leaf spring 106, a thread passing portion 107, which has extremely small clearance, is provided. The thread T drawn from the spool 82 is passed through the thread passing portion 107. A frictional resistance is applied to the thread T due to the contact of the guide pin 105 and the leaf spring 106.

Both ends of the guide pin 105 are fixed in respective bosses 87*c* formed at the left part (FIGS. 10, 11 and 26) of the openable cover 87. The leaf spring 106 is inserted into the openable cover 87 so as to urge the guide pin 105 in a leftwardly and downwardly inclined posture. A slender portion 105*a*, having a smaller diameter is formed at the middle portion of the guide pin 105. The thread passing portion 107 is formed by the slender portion 105*a* and the leaf spring 106. Thereby, the thread T passing through the thread passing portion 107 has an appropriate frictional resistance applied thereto and the thread T can be surely guided into the hollow needle 81.

As shown in FIGS. 10 to 12 and 27, the locking mechanism 93 integrally locks the openable cover 87 to the housing case 86 in a state where the sewing cartridge 5 is not attached to the sewing apparatus body 2. The locking mechanism 93 has the locking member 110 disposed on the left of the housing case 86. The locking member 110 is formed with pivot portions 110*a* and 110*b*, an engaging portion 110*c*, and an engaged portion 110*d* as an integrated structure. The pivot portions 110*a* and 110*b* are supported by the housing case 86 such that the locking member 110 pivots about a vertical axis. The locking member 110 can be switched between the locked position (see FIG. 10) and the unlocked position (see FIG. 11).

The locking member 110 is regulated in its vertical movement. The locking member 110 is urged to the locked position by a torsion spring 111. In FIG. 10, the engaging portion 110*c* protrudes leftward from the upper portion of the locking member 110. The engaged portion 110*d* protrudes leftward from the lower end portion of the locking member 110. The engaging portion 110*c* and the engaged portion 110*d* protrude toward the left from apertures 86*g*, 86*h*, respectively, which are formed in the upper portion of the left side wall and a back wall of the engagement recess 86*a*.

When the sewing cartridge 5 is not attached to the oscillating arm 40, the openable cover 87 is in the closed position. In this state, the engaging portion 110*c* of the locking member 110 in the locked position engages the engaged portion 87*d* protruding rightward (inward) in FIG. 10 from the front wall of the openable cover 87 from above. Accordingly, the openable cover 87 cannot be moved upward with respect to the housing case 86 and is integrally locked to the housing case 86 in the closed position.

When the sewing cartridge 5 is attached to the oscillating arm 40, as described above, the engaging pin 42 rightwardly presses and moves the engaged portion 110*d* of the locking member 110 as the engagement recess 86*a* of the housing case 86 engages the engaging pin 42 of the oscillating arm 40. Therefore, the locking member 110 is switched to the unlocked position from the locked position. In this state, the engaging portion 110*c* of the locking member 110 is in the unlocked position and is disengaged from the engaged portion 87*d*. The lock is released, so that the openable cover 87 can be moved upward with respect to the housing case 86.

Usually, the sewing cartridge 5 is detached from the oscillating arm 40 in a state where the openable cover 87 is in the closed position. Therefore, the openable cover 87 is locked to the housing case 86 in the locked position immediately after the sewing cartridge 5 is detached. If the sewing cartridge 5 is detached from the oscillating arm 40 in a state where the openable cover 87 is in a position other than the closed position, the locking member 110 is switched to the locked position with the openable cover 87 unlocked. However, the openable cover 87 is rotated to the closed position by the urging force from the torsion spring 88 because a tapered portion inclined leftwardly is formed at the left end portion of the engaging portion 110*c* of the locking member 110. At that time, the engaged portion 87*d* temporarily presses and moves the locking member 11O toward the unlocked position via the tapered portion, so that the openable cover 87 can be switched to the closed position.

The sewing operation performed in the sewing apparatus 1 and stitches to be formed on the work cloth 70 by the sewing operation will be described with reference to FIGS. 28 to 35.

In a state where the embroidery frame 4 having the work cloth 70 and the sewing cartridge 5 are attached to the sewing apparatus body 2, the sewing cartridge 5 is vertically moved by the cartridge driving mechanism 12. At that time, the hollow needle 81, the needle cover 83 (when the needle cover 83 is kept away from the work cloth 70), the spool 82, and the excessive rotation preventive mechanism 91 move up and down with the housing case 86. However, the openable cover 87 is supported by the pin 19*a* and is fixed with respect to the sewing apparatus body 2, so that the backflow preventive mechanism 92 provided therein hardly moves up and down.

Figure 28:
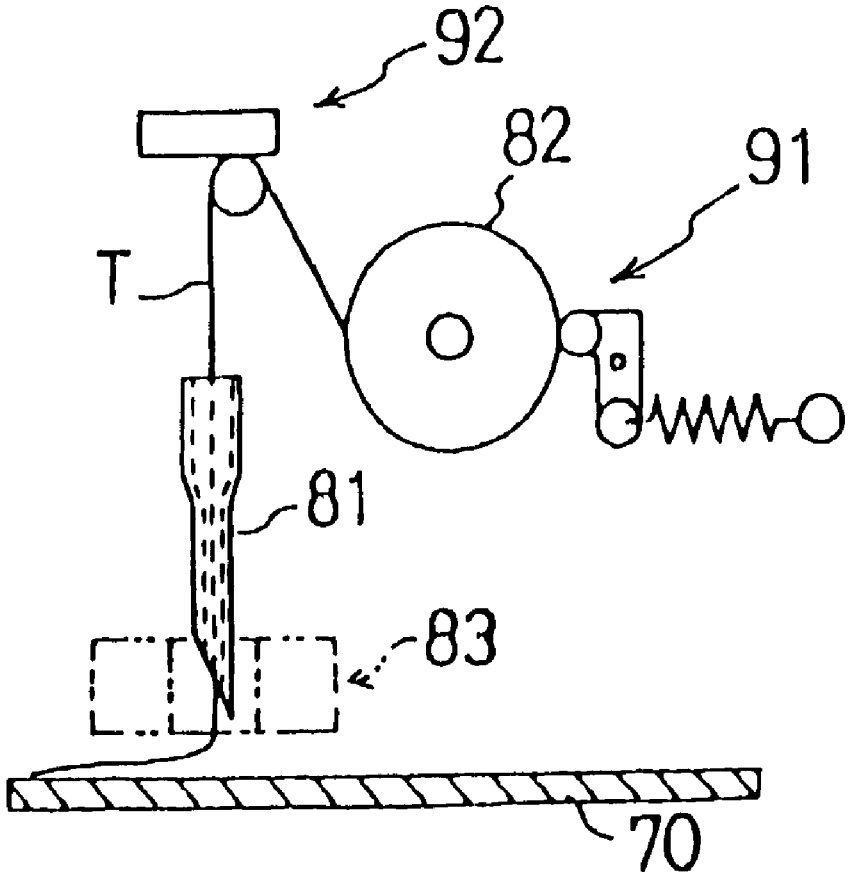
FIG. 28 is an explanatory diagram showing a sewing operation before the sewing operation is started.
Figure 29:
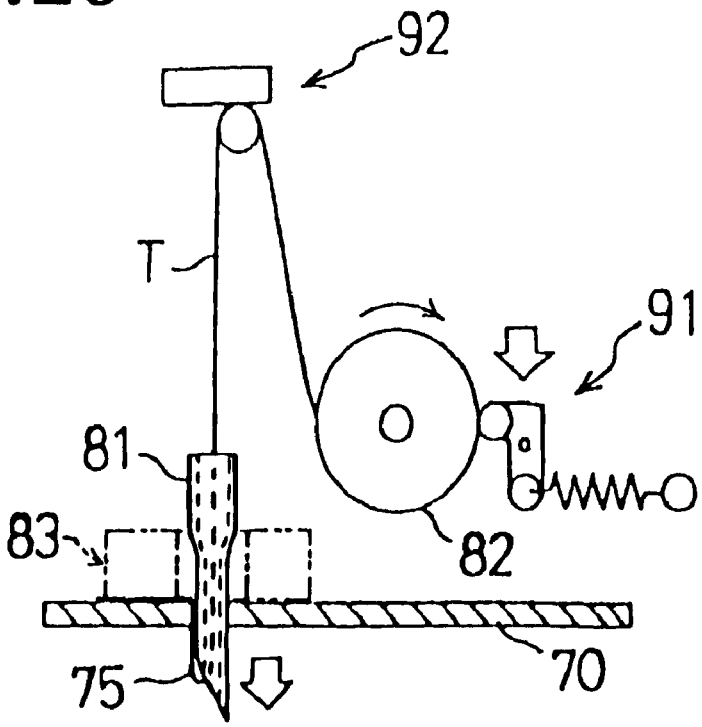
FIG. 29 is an explanatory diagram showing the sewing operation when a first stitching is performed.

When the sewing cartridge 5 is attached to the oscillating arm 40 and the first sewing operation is performed, as shown in FIG. 28, a certain length of the thread T is drawn from the lower end of the hollow needle 81. When the housing case 86 descends from this state, as shown in FIG. 29, the needle cover 83, acting as a presser foot holds the work cloth 70 and the thread T on the work cloth 70. When the needle cover 83 holds the work cloth 70, the needle cover 83 comes to a substantial standstill. Then, the hollow needle 81 descends with respect to the needle cover 83 and penetrates the work cloth 70. At that time, the hollow needle 81 is substantially perpendicular to the work cloth 70 at the instant when the hollow needle 81 penetrates the work cloth 70. The extreme tip of the hollow needle 81 faces the center-of-swing side of the oscillating arm 40, so that the work cloth 70 is prevented from being displaced.

When the hollow needle 81 penetrates the elastic film member 73, the thread T extending from the hollow needle 81 is maintained in the work cloth 70 by a thread holding force due to the elasticity of the elastic film member 73. In this state, when the hollow needle 81 (the spool 82 and the excessive rotation preventive mechanism 91) further descends, the thread T is drawn from the spool 82 against the draw resistance for the thread T provided by the excessive rotation preventive mechanism 91 and the backflow preventive mechanism 92, and a free loop 75 is formed on a reverse side of the work cloth 70. At this stage, a half of the thread T forming the free loop 75 exists inside of the hollow needle 81.

While the hollow needle 81 penetrates the work cloth 70 and descends to a lower limit position, the thread T extending from the hollow needle 81 is pulled toward the reverse side of the work cloth 70 and more thread T is drawn from the spool 82. Thus, the free loop 75 is formed on the reverse side of the work cloth 70. Further, the thread T is prevented, up to a point, from being pulled toward the reverse side of the work cloth 70 before the hollow needle 81 penetrates the work cloth 70, if the thread T extending from the hollow needle 81 is held between the needle cover 83 and the work cloth 70.

Figure 30:
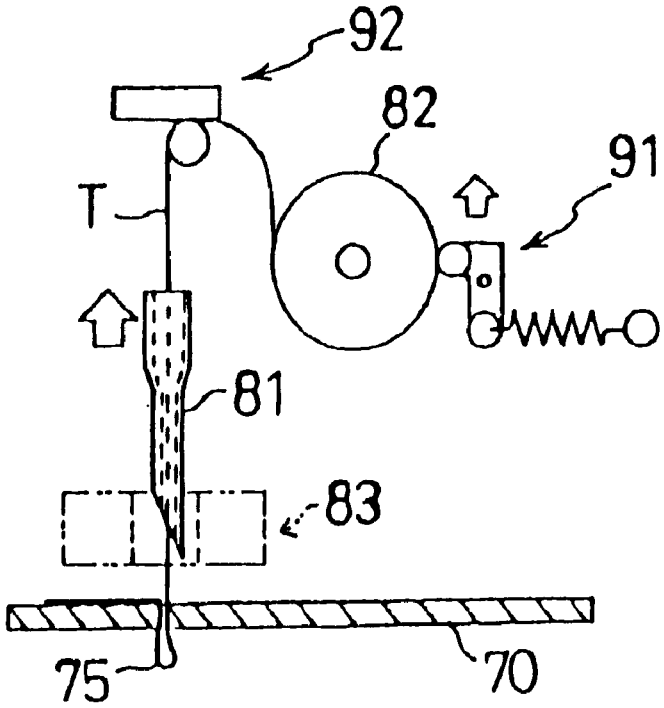
FIG. 30 is an explanatory diagram showing the sewing operation when the hollow needle has risen immediately after the first stitching was performed.

Next, when the housing case 86 is moved upward, as shown in FIG. 30, the hollow needle 81 ascends from the lower limit position and the tip of the hollow needle 81 is pulled from the work cloth 70. Then, the work cloth 70, held by the needle cover 83, becomes free from the pressure and the needle cover 83 ascends to an upper limit position together with the hollow needle 81. At that time, only the hollow needle 81 ascends while the thread T is fixed or set between the backflow preventive mechanism 92 that is stopped in a certain position and the work cloth 70. The free loop 75 formed on the reverse side of the work cloth 70 is held and the entire free loop 75 is exposed externally. When the hollow needle 81 moves to the upper limit position, the spool 82 and the excessive rotation preventive mechanism 91 also move to the upper limit position. At that time, the thread T is not drawn from the backflow preventive mechanism 92 to the hollow needle 81, and the backflow preventive mechanism 92 and the excessive rotation preventive mechanism 91 apply resistance to the drawing of the thread T. Accordingly, the thread T extending between the spool 82 and the backflow preventive mechanism 92 becomes loosened.

Figure 31:
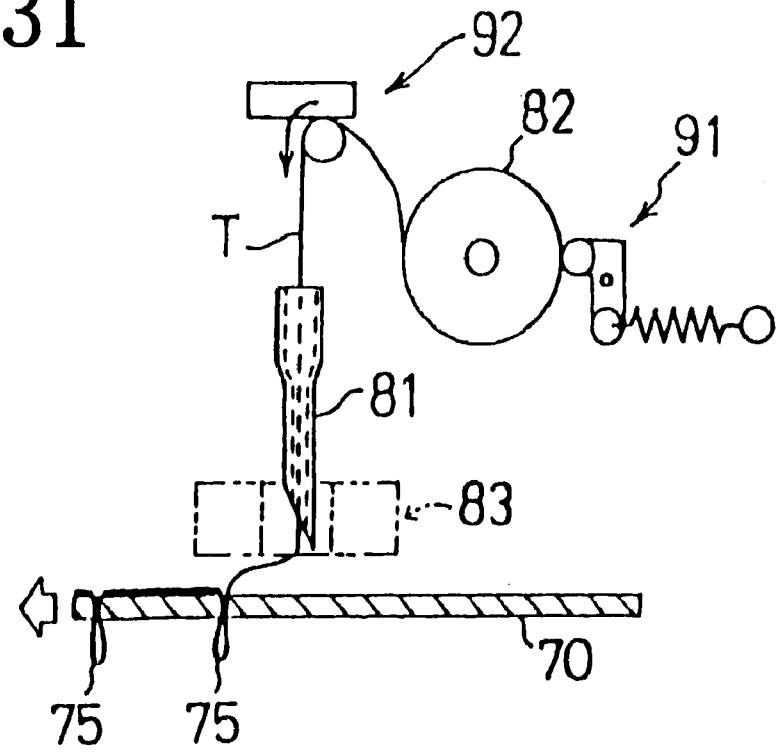
FIG. 31 is an explanatory diagram showing the sewing operation while advancing a work cloth.

Then, as shown in FIG. 31, as the work cloth 70 is moved in a horizontal direction, the thread T is pulled by the thread holding force and the loosened portion of thread T extending between the spool 82 and the backflow preventive mechanism 92. The thread T is pulled via the backflow preventive mechanism 92 because the thread T extending from the hollow needle 81 is held of the work cloth 70. At that time, the thread holding force of the work cloth 70 is far greater than the resistance to the draw of the thread by the backflow preventive mechanism 92, so that there is no possibility of pulling out the thread T forming the free loop 75 toward the side of the hollow needle 81.

Figure 32:
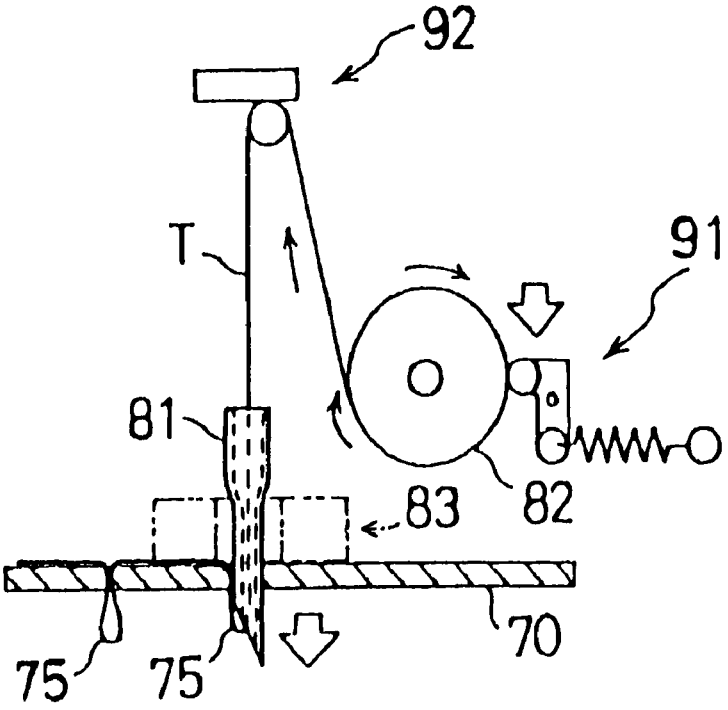
FIG. 32 is an explanatory diagram showing the sewing operation when a second or following stitching is performed.

After the work cloth 70 is moved in the horizontal direction, the housing case 86 descends, and the needle cover 83 holds the work cloth 70 and the hollow needle 81 penetrates the work cloth 70 as shown in FIG. 32. While the hollow needle 81 descends from the upper limit position to the lower limit position, the remaining loosened thread T extending between the spool 82 and the backflow preventive mechanism 92 is pulled and then the thread T is drawn from the spool 82. Resistance is applied to the drawn thread T by drawing the thread by the excessive rotation preventive mechanism 91 and the backflow preventive mechanism 92. As described above, the resistance to drawing the thread is smaller than the thread holding force of the work cloth 70. Further, thread T can be pressed against the work cloth 70 by the needle cover 83. Accordingly, a new free loop 75 is formed without pulling the previous free loop 75 from the work cloth 70.

Figure 33:
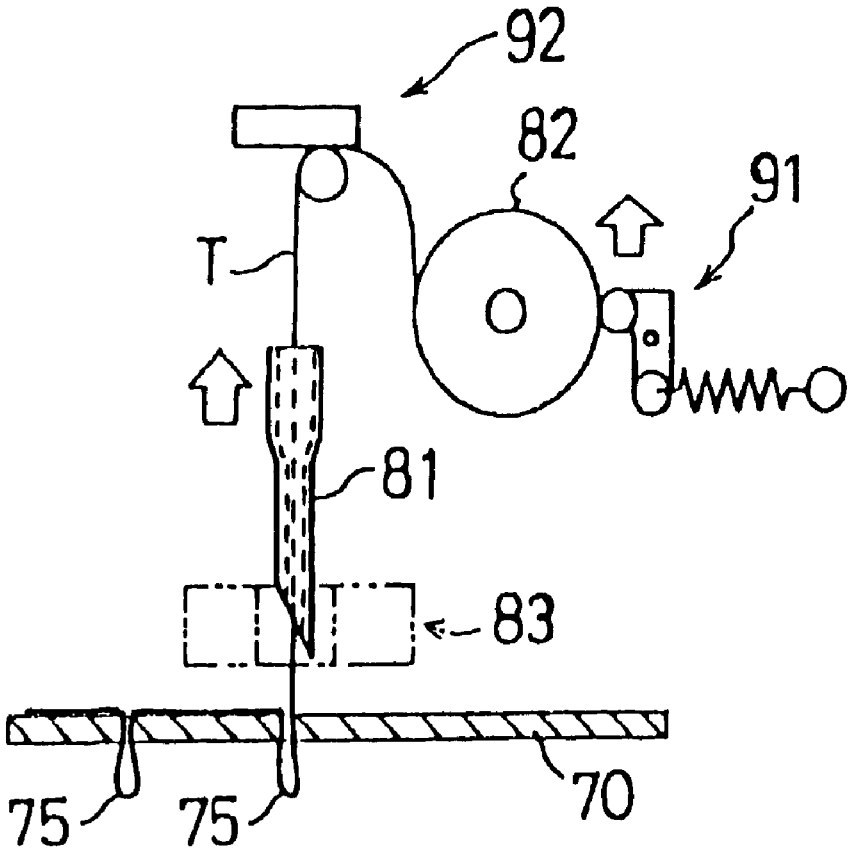
FIG. 33 is an explanatory diagram showing the sewing operation when the hollow needle has risen immediately after the second or following stitching is made.
Figure 34:
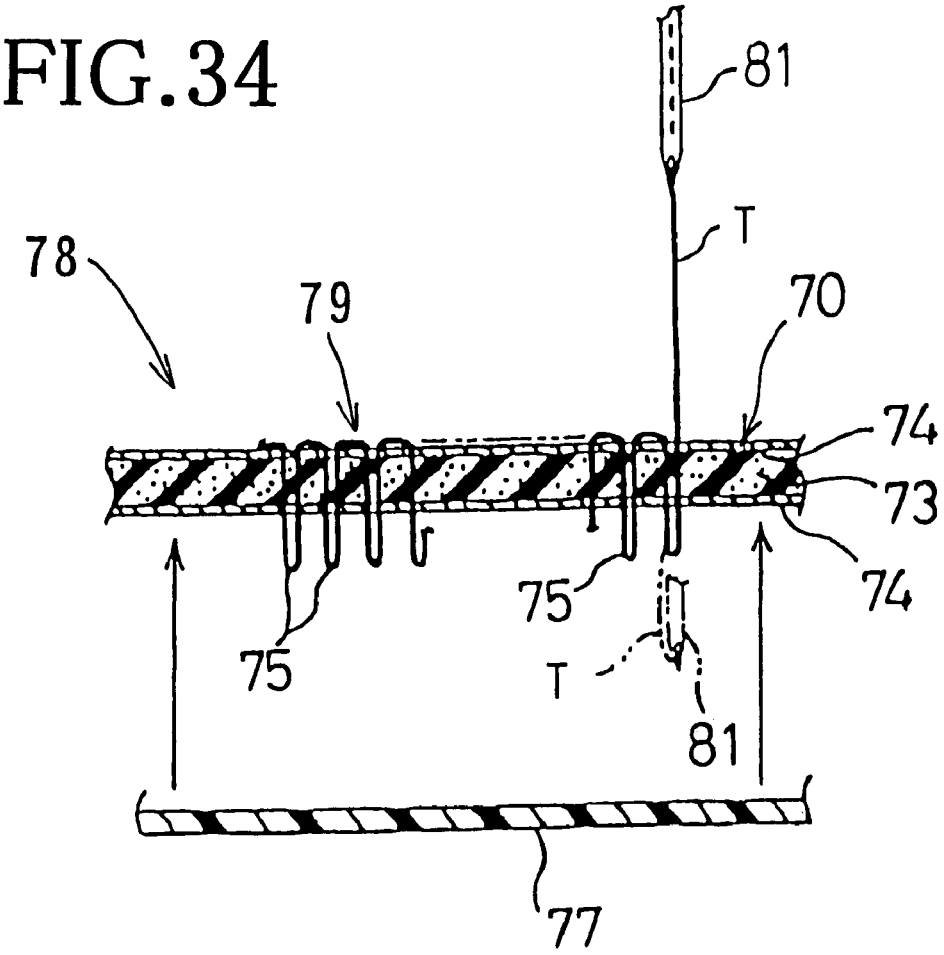
FIG. 34 is a sectional view of a work cloth, an embroidery pattern formed on the work cloth, and a double-sided adhesive tape.
Figure 35:
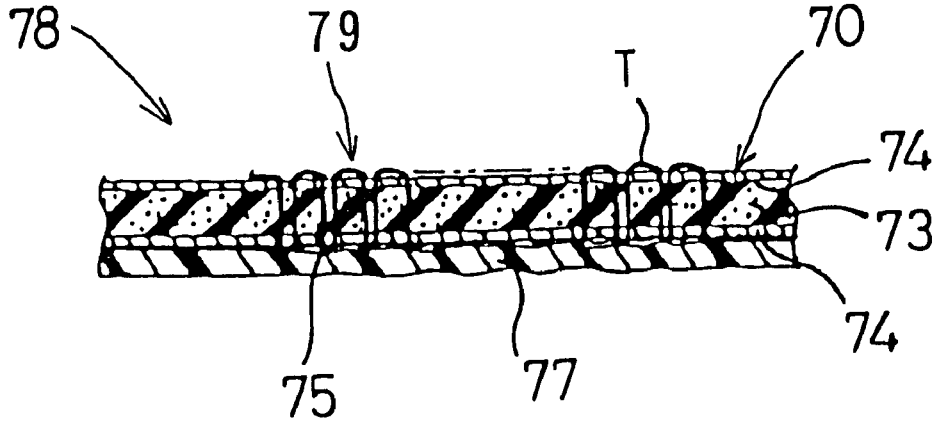
FIG. 35 is a sectional view of a patterned cloth.

Next, as shown in FIG. 33, the hollow needle 81 and the needle cover 83 ascend. Then, the operations shown in FIGS. 31 to 33 are repeatedly performed. As described above, the thread T is left in the work cloth 70 during every sewing operation by the thread holding force produced by the elasticity of the work cloth 70 and a plurality of free loops 75 are formed on the reverse side of the work cloth 70 by the thread T, as shown in FIG. 34. Thus, stitches forming an embroidery pattern 79 are formed on the surface of the work cloth 70. When a double-sided adhesive tape 77 is adhered to fix the free loops 75 on the reverse side of the work cloth 70, a patterned cloth 78, as shown in FIG. 35, is obtained.

Accordingly, the free loops 75 do not come off or out, so that the thread T does not need to be fixed by another thread or the thread of the previous stitch and following stitch. The embroidery pattern 79 formed on the work cloth 70 is stable without unraveling. The patterned cloth 78 can be attached to various things via the double-sided adhesive tape 77, such as an emblem. Instead of the double-sided adhesive tape 77, an adhesive agent may be applied to the reverse side of the work cloth 70 in layers. A tape may be formed of the adhesive agent and the tape may be used to fix the free loops 75 on the reverse side of the work cloth 70.

There are a plurality of free loops 75 on the reverse side of the work cloth 70. Accordingly, unevenness may develop in the double-sided adhesive tape 77 when the double-sided adhesive tape 77 is adhered to the reverse side of the work cloth 77. When the work cloth 70 is adhered to clothes via the double-sided adhesive tape 77 as an emblem, the emblem is liable to come off because the cloth is soft. However, adhesion of the work cloth 70 can be improved because of the unevenness of the double-sided adhesive tape 77. The unevenness develops at every free loop or every several free loops depending on the materials of the thread and the double-sided adhesive tape used.

A thread cutting mechanism 130 will be described with reference to FIGS. 16 to 22. The sewing apparatus 1 (FIG. 2) is provided with the thread cutting mechanism 130 that cuts the thread T extending from the sewing cartridge 5 and connecting the sewing cartridge 5 and the work cloth 70 in the embroidery frame 4 when the sewing cartridge 5 mounted in the sewing apparatus body 2 is replaced with a different one. As described above, the sewing apparatus body 2 includes the operating member **44*b* that is used to remove the sewing cartridge 5 from the sewing apparatus body 2 (the oscillating arm 40). In response to the operation of the operating member 44*b*, the thread cutting mechanism 130** is actuated so as to cut the thread T.

The thread cutting mechanism 130 includes a thread cutting lever 131, a link mechanism 132, a pair of cutting blades 133 and 134, and an engagement mechanism 135. The thread cutting lever 131 is pivotally supported on the back of the engagement plate 19 near the operating member 44*b* and straightly extends to the left. The link mechanism 132 is linked with the left end portion of the thread cutting lever 131. The cutting blades 133 and 134 are opened and closed via the link mechanism 132. The engagement mechanism 135 actuates the thread cutting lever 131 by the operation of the operating member 44*b*. The link mechanism 132 functions as a quadric chain mechanism.

By the operation of the operating member 44*b* to detach the sewing cartridge 5 from the sewing apparatus body 2 (FIG. 2), the sewing cartridge 5 is pivoted on the engaging pin 42 (FIG. 18) to a position where the sewing cartridge 5 can be detached, and immediately afterward, a thread cutting operation is performed by the link mechanism 132 via the thread cutting lever 131. The thread cutting lever 131 and the link mechanism 132 correspond to a movable member.

The thread cutting lever 131 is disposed behind the engagement plate 19. The thread cutting lever 131 is pivotally supported to the engagement plate 19 using a pivot shaft 140, extending in the front and rear direction.

Figure 21:
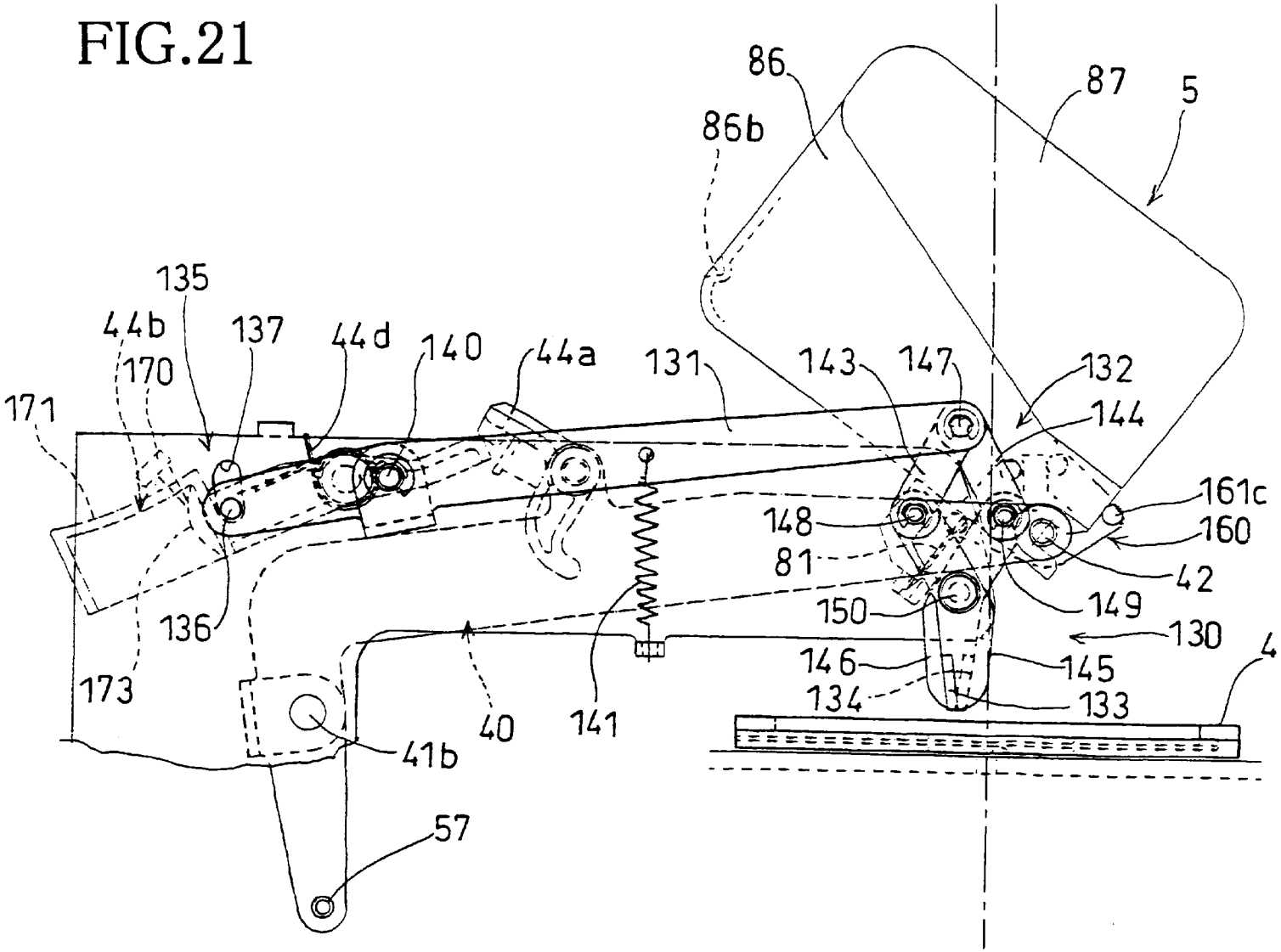
FIG. 21 is a rear view of an engagement plate when thread cutting is being performed.
Figure 22:
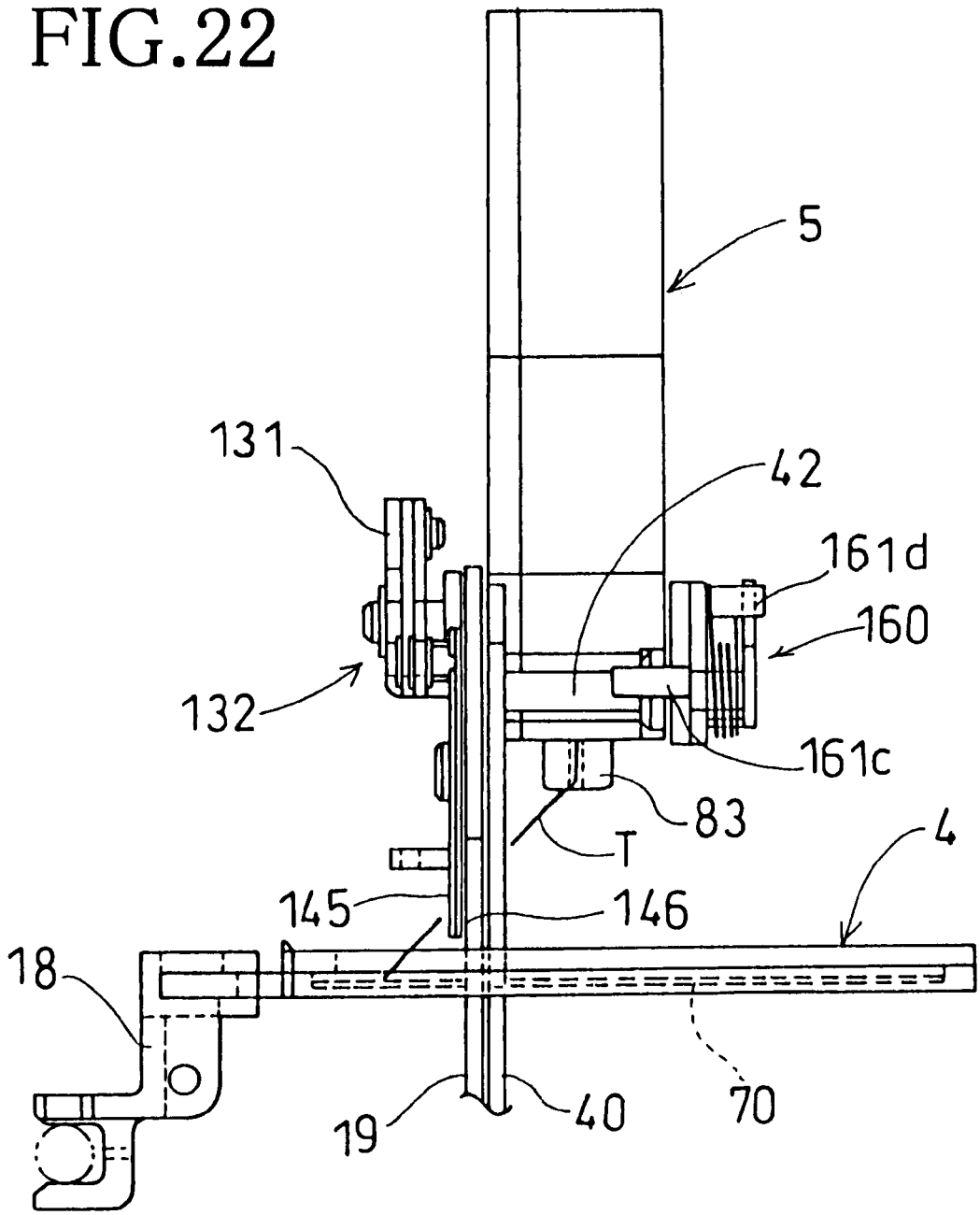
FIG. 22 is a left side view of essential parts of the thread cutting mechanism of FIG. 21.

As shown in FIG. 21, a tensile coil spring 141 extends between the thread cutting lever 131 and the engagement plate 19, so that the free end side of the thread cutting lever 131 (toward the link mechanism 132) is urged downwardly. As shown in FIG. 16, 19, and 21, an abutment pin 136 protrudes frontward at a base end of the thread cutting lever 131. The abutment pin 136 faces an undersurface of the operating member 44*b* through a guide slot 137 provided in the engagement plate 19. When the operating member 44*b* is pivoted downward more than a specified angle, the free end side of the thread cutting lever 131 is pivoted upward via the abutment pin 136. The engagement mechanism 135 comprises the above.

As shown in FIG. 21, the link mechanism 132 includes a pair of links 145 and 146 having the cutting blades 133 and 134 respectively, and a pair of links 143 and 144 that drive the links 145 and 146. The links 145 and 146 function as scissors-like links, and the links 143 and 144 function as coupled links. Top end portions of the links 143 and 144 are pivotally connected to the left end portion of the thread cutting lever 131 via a common shaft 147. Bottom end portions of the links 143 and 144 are pivotally connected to top end portions of the links 145 and 146 via shafts 148 and 149, respectively. Middle portions of the links 145 and 146 along their lengths are pivotally supported at the engagement plate 19 (FIG. 16) via a common shaft 150. The cutting blades 133 and 134 are formed in face to face relation at lower end portions of the links 145 and 146. When the thread cutting lever 131 is in a lower limit position, the shafts 147 and 150 come closest to each other, and the cutting blades 133 and 134 are opened maximally (FIG. 16). When the thread cutting lever 131 is in an upper limit position, the shafts 147 and 150 are separated from each other, and the cutting blades 133 and 134 are closed (FIG. 21). The link mechanism 132 operating as the quadric chain mechanism includes four links and operates like lazy tongs.

Regardless of the state of the thread T, such that the thread is loosened or tightened, if the thread T is positioned near the cutting blades 133 and 134, the thread T can be cut by the cutting blades 133 and 134.

The thread cutting lever 131 is regulated in its pivotal movement by the guide slot 137 provided in the engagement plate 19 (FIG. 16) and the abutment pin 136. When the top end of the abutment pin 136 makes contact with the top end of the guide slot 137, the thread cutting lever 131 is in its lower limit position (FIG. 16). When the bottom end of the abutment pin 136 makes contact with the bottom end of the guide slot 137, the thread cutting lever 131 is in its upper limit position (FIG. 21).

The operation of the thread cutting mechanism 130 will be described with reference to FIGS. 16 to 22. The thread cutting lever 131 is urged toward the lower limit position by the tensile coil spring 141 and the cutting blades 133 and 134 are kept open. As shown in FIG. 16, when the sewing cartridge 5 is attached to the oscillating arm 40, the sewing cartridge 5 is pivoted clockwise with the engaging pin 42 engaged with the engagement recess 86*a*. When the engaging pin 42 is engaged with the engagement recess 86*a*, the sewing cartridge 5 is attached to the oscillating arm 40.

As shown in FIGS. 16 and 17, in order to surely cut the thread T by the cutting blades 133 and 134 for replacement of the sewing cartridge 5, the thread T is required to be disposed between the opened cutting blades 133 and 134 when the oscillating arm 40 is lifted to the upper limit position (in a state where the hollow needle 81 is far away from the work cloth 70 in the embroidery frame 4). The thread T is moved to the position by the control of the movement of the embroidery frame 4 by a controller, not shown (thread cutting preparation processing). The thread T extends between the sewing cartridge 5 and a last stitch position on the work cloth 70. By the thread cutting preparation processing, the embroidery frame 4 is moved backward, so that the last stitch position is situated behind the hollow needle 81. By doing so, as shown in FIG. 17, the thread T extends between the bottom of the hollow needle 81 and the last stitch point on the work cloth 70 straightly on the skew and the thread T is tautly disposed between the opened cutting blades 133 and 134. As the sewing cartridge 5 is pulled upward to remove from the oscillating arm 40, the thread T is brought closer to the cutting blades 133 and 134. Thus, the thread T can be surely cut by the cutting blades 133 and 134.

Figure 20:
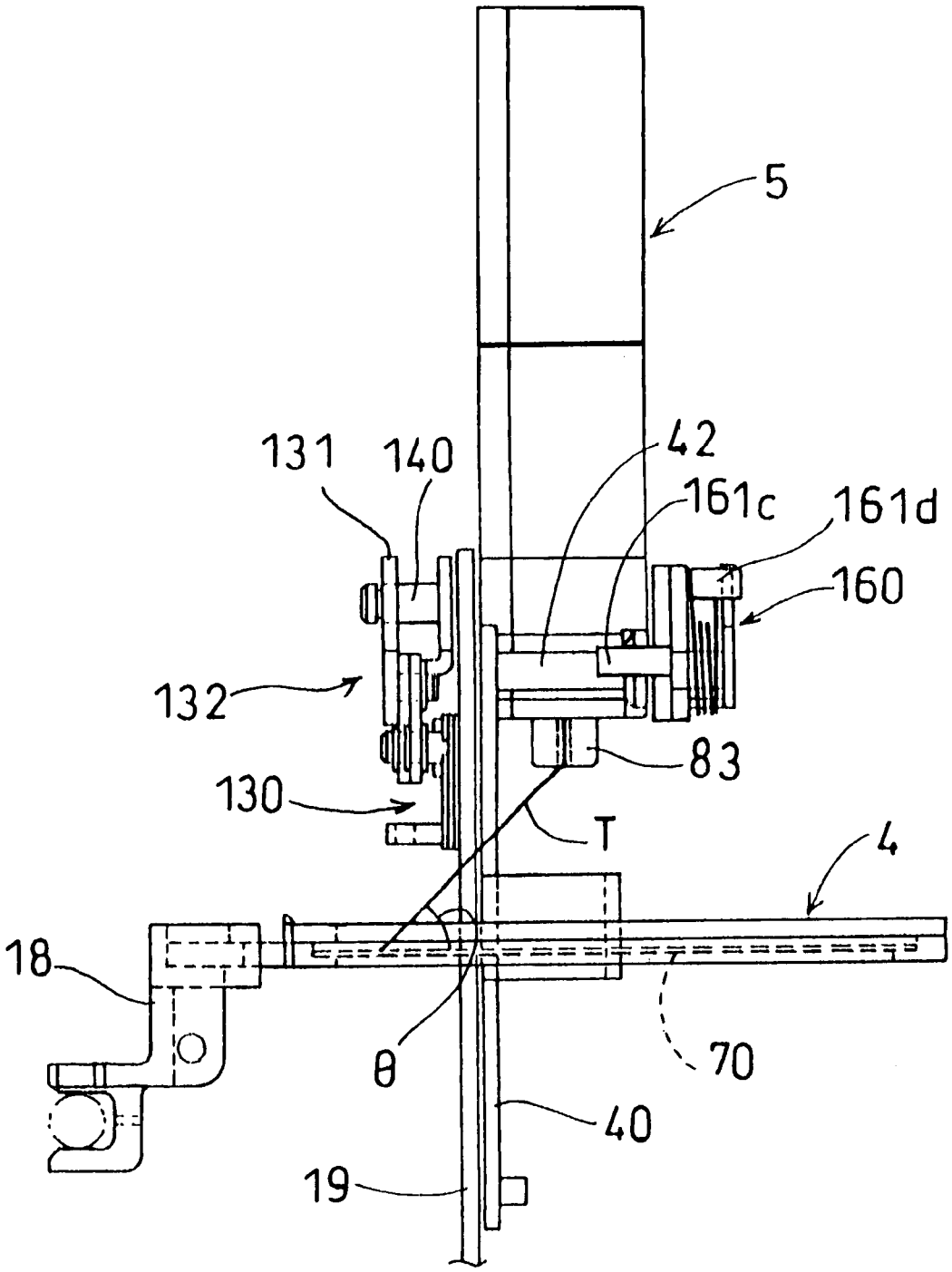
FIG. 20 is a left side view of essential parts of the sewing cartridge of FIG. 19.

When the sewing cartridge 5 is detached from the oscillating arm 40, as shown in FIG. 19, the operating member 44*b* is pressed downward so that the engaging member 44*a* is disengaged from the engagement groove 86*b*, and the sewing cartridge 5 is rotated about the engaging pin 42 (FIG. 17) counterclockwise by the cartridge setting member 160 so as to be in a position where the sewing cartridge 5 can be detached. When the sewing cartridge 5 is pivoted counterclockwise, the needle cover 83 protruding from the bottom of the sewing cartridge 5 is pivoted in a direction to be away from the engaging pin 42 (FIG. 17). Thus, as shown in FIG. 20, an angle θ between the thread T drawn from the bottom of the hollow needle 81 to the work cloth 70 and the surface of the work cloth 70 becomes greater than that shown in FIG. 17.

When the operating member 44*b* is further pressed downward (FIG. 21), the free end side of the thread cutting lever 131 greatly ascends, and a space between the links 143 and 144 in the link mechanism 132 becomes narrow. When the links 145 and 146 are closed via the links 143 and 144, they can sandwich the thread T at a position upwardly away from the work cloth 70. Thus, when the cutting blades 133 and 134 are closed, the thread T can be cut without damage to the work cloth 70.

Thus, when the operating member 44*b* provided on the sewing apparatus body 2 is pressed downward, the sewing cartridge 5 can be detached from the sewing apparatus body 2. In addition, when the operating member 44*b* is further pressed downward, the thread cutting mechanism 130 is actuated to perform cutting of the thread T.

When the operating member 44*b* is completely pressed downward, the sewing cartridge 5 is positioned in a posture where the sewing cartridge 5 is detachable, and the thread cutting mechanism 130 is actuated before the sewing cartridge 5 is completely detached. Thus, there is no need to separately provide an operating member to actuate the thread cutting mechanism 130. Accordingly, the number of operating processes can be decreased.

Thus, the sewing cartridge 5 can be prevented from being detached from the sewing apparatus body 2 without cutting the thread T, and the thread T can be prevented from being cut by mistake, although the sewing cartridge 5 is not expected to be detached from the sewing apparatus body 2 (or to be changed to the other). That is, cutting of the thread T, which is required for detaching (changing) the sewing cartridge 5 from the sewing apparatus body 2, can be reliably and simply performed, and the replacement of the spool (thread color change) can be further simply performed.

In the oscillating arm 40, where the cartridge setting member 160 is used, the sewing cartridge 5 is first held with a posture different from that where the sewing cartridge 5 is attached to the sewing apparatus body 2, and then the engaging pin 42 is engaged in the engagement recess 86*a*. As such, the sewing cartridge 5 can be pivotally supported at the sewing apparatus body 2. Then, the sewing cartridge 5 is pivoted about the engaging pin 42 to be switched to the sewing feasible position. When the engaging member 44*a* is engaged in the engagement groove 86*b*, the sewing cartridge 5 can be regulated for its pivotal movement in the sewing feasible position. That is, the sewing cartridge 5 can be attached to the sewing apparatus body 2 simply and reliably in consideration of the structures of the sewing cartridge 5 and the sewing apparatus body 2. Further, with this structure, it is easy to find whether the sewing cartridge 5 is attached correctly.

When the operating member 44*b* is rotated in the predetermined direction (the cassette detaching direction) to remove the sewing cartridge 5 from the sewing apparatus body 2, the engaging member 44*a* is disengaged from the engagement groove 86*b* of the sewing cartridge 5. At the same time, the sewing cartridge 5 rotates about the engaging pin 42 to an inclined posture by the cartridge setting member 160. Accordingly, the user can easily understand that the sewing cartridge 5 is now detachable from the sewing apparatus body 2.

With the use of the cartridge setting member 160, the sewing cartridge 5 takes the inclined posture by rotating about the engaging pin 42. Therefore, the needle cover 83 protruding from the undersurface of the sewing cartridge 5 in the inclined posture is positioned at a level higher than when the sewing cartridge 5 is attached to the oscillating arm 40 positioned in its upper limit position. The thread T extending from the sewing cartridge 5 is connected with a last stitch position. At the thread cutting processing, the embroidery frame 4 is moved backward so that the last stitch position is located behind that of the hollow needle 81, as shown in FIG. 17. Then, as the operating member 44 is pressed to detach the sewing cartridge 5, as shown in FIG. 20, an angle θ between the thread T drawn from the bottom of the hollow needle 81 to the work cloth 70 and the surface of the work cloth 70 becomes greater than that shown in FIG. 17. Thus, the thread T can be lifted between the opened cutting blades 133 and 134 in accordance with the lift of the sewing cartridge 5, and the thread cutting operation can be surely performed. As described above, according to the embodiment of the invention, the thread T can be surely cut by the thread cutting mechanism 130 even if the thread T is loosened or tightened.

In one embodiment, the engaging member 44*a* swings, back and forth, along an arc. However, an engaging member may be straightly moved back and forth, or may be moved in only one direction in a fixed circulation. Further, an engaging member may deform, in response to the operation of the operating member 44*b*, to serve the same function as the engaging member 44. The engaging member and operating member can be integrally formed.

The thread cutting mechanism 130 of the embodiment of the invention can be applied to a sewing machine, that performs sewing and/or embroidering, using both upper and lower threads, by moving a sewing needle up and down, without the sewing cartridge 5. In this case, the oscillating arm 40 for supporting and moving up and down the sewing cartridge 5 is not required.

Figure 36:
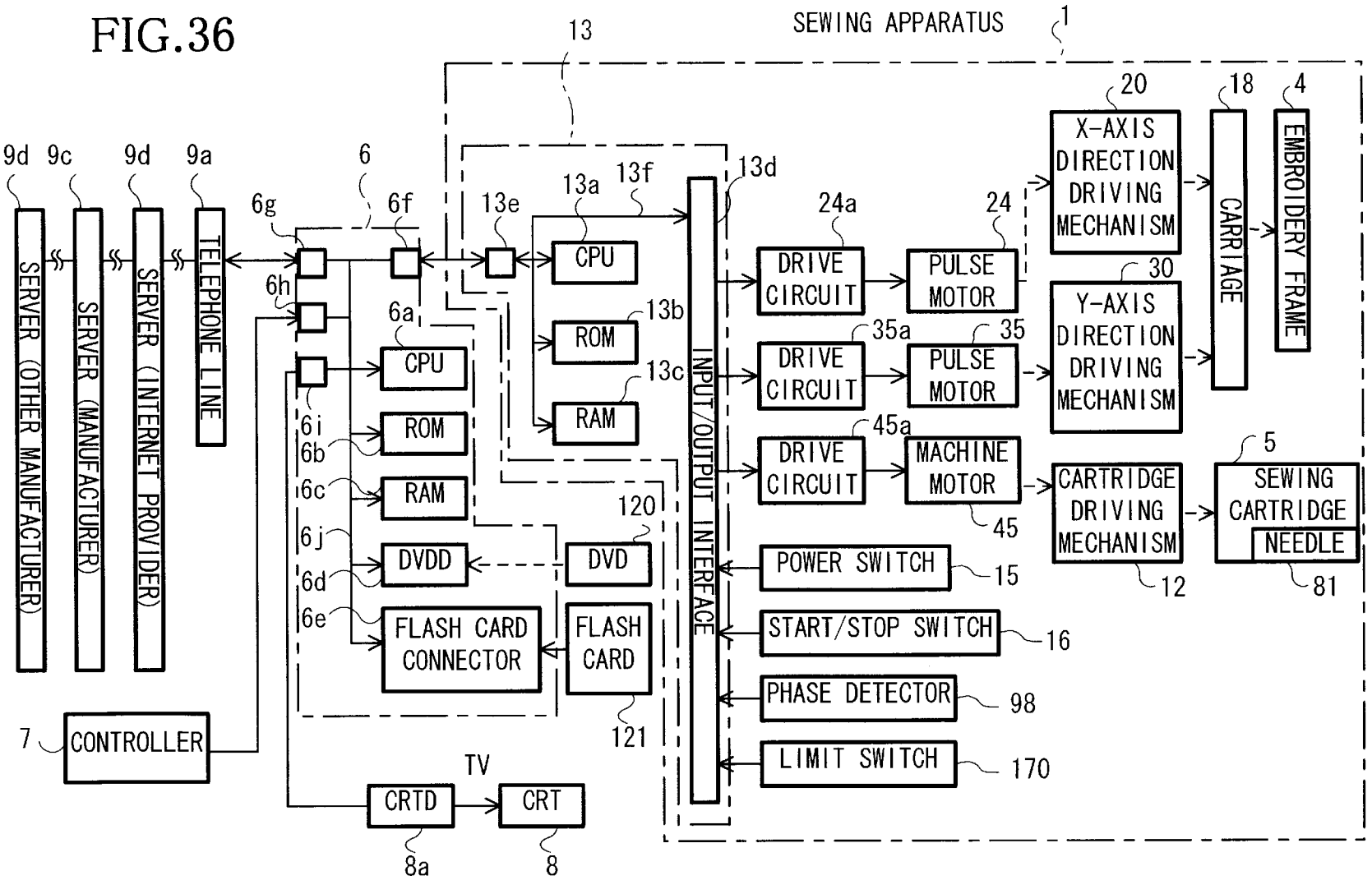
FIG. 36 is a block diagram showing a control system of the sewing apparatus and a game machine.

A control system will be described with reference to FIG. 36. The operational controller 13 of the sewing apparatus 1 has a computer including a CPU 13*a*, a ROM 13*b*, and a RAM 13*c*, an input/output interface 13*d*, and an input/output terminal 13*e*. The CPU 13*a*, the ROM 13*b*, the RAM 13*c*, the input/output interface 13*d*, and the input/output terminal 13*e* are connected to each other via a bus 13*f*. The input/output interface 13*d* is connected with a drive circuit 24*a* for the pulse motor 24 of the X-axis direction driving mechanism 20, a drive circuit 35*a* for the pulse motor 35 of the Y-axis direction driving mechanism 30, a drive circuit 45*a* for the machine motor 45 of the cartridge driving mechanism 12, the power switch 15, the start/stop switch 16, a phase detector 98, and a limit switch 170.

The phase detector 98 includes a plurality of photo interrupters and encoder disks which are fixedly attached to the pivot shaft integrally rotating with the large-diameter gear 54 that correspond to the photo interrupters. The phase detector 98 detects a rotational phase of the pivot shaft, so that an upper limit position, a lower limit position, and an unthreading position of the oscillating arm 40 can be detected.

As shown in FIGS. 16, 18, 19 and 21, the limit switch 170 detects the presence or absence of the sewing cartridge 5 in the sewing apparatus 1 and determines whether the sewing cartridge 5 is attached in a predetermined posture. The limit switch 170 of one embodiment detects whether the sewing cartridge 5 is attached in the sewing feasible position (posture) with respect to the oscillating arm 40, by detecting a vertical position (posture) of the operating member 44*b*.

Figure 18:
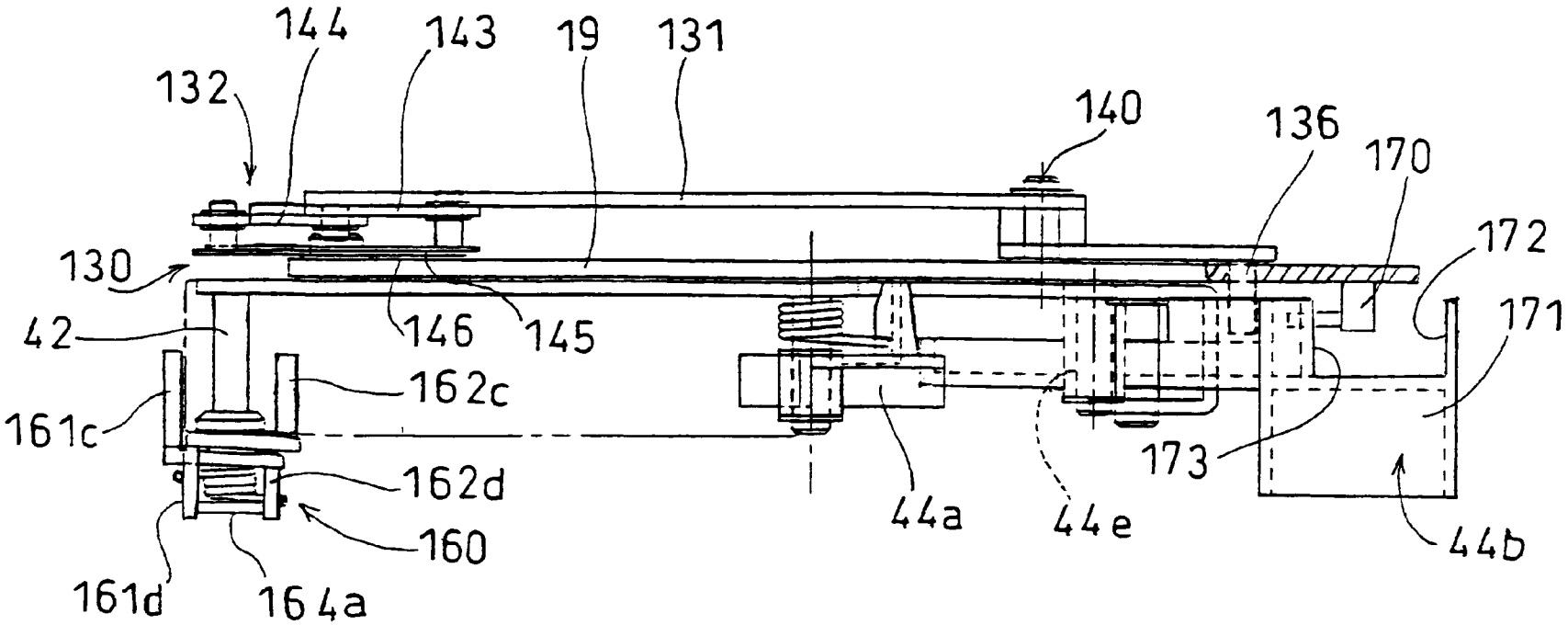
FIG. 18 is a plan view of the oscillating arm and the cartridge setting mechanism when the sewing cartridge is not attached to the oscillating arm.

More specifically, as shown in FIGS. 16 and 18, the operating member 44*b* has a push-piece 171 where the user presses. The push-piece 171 is partially cut away to form a cutaway portion 172 therein. The limit switch 170 is fixed to the front of the engagement plate 19 at a position where the limit switch 170 can pass through the cutaway portion 172 of the push-piece 171. A contact portion 173 (which is concave when viewed from the front) is integrally formed to the lower surface of the push-piece 171.

Figure 40:
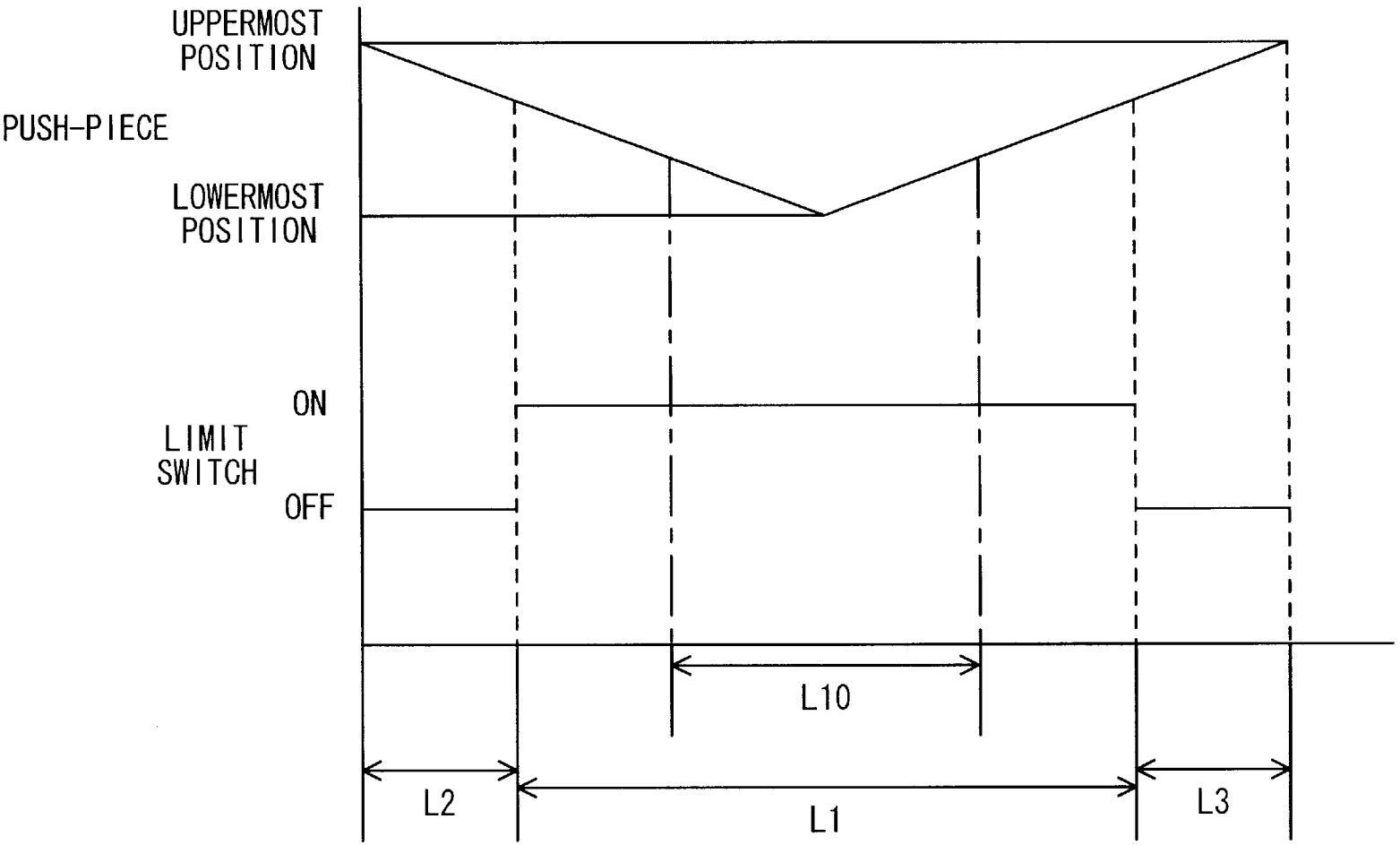
FIG. 40 is a time chart showing a relationship between movement of an operating member and ON/OFF of a limit switch.

As shown in FIG. 40, a range of an ascent/descent zone of the push-piece 173 of the operating member 44*b* is divided into three zones, from an uppermost position to a lowermost position, namely, a descent/ascent zone L1, a descent start zone L2, and an ascent end zone L3. The descent/ascent zone L1 includes the lowermost position. When the limit switch 170 is in this zone, a switch portion of the limit switch 170 is pressed by the contact portion 173 and is turned on, so that ON signals are continuously outputted. The descent start zone L2 and the ascent end zone L3 both include the uppermost position. In these zones, the limit switch 170 is off, so that the signals are not outputted. For example, as shown in FIG. 16, in a state where the user does not touch the push-piece 171, the limit switch 170 is off so that the signals are not outputted. As shown in FIG. 19 and described above, when the user presses the push-piece 171 of the operating member 44*b* downward to a certain point in order to place the sewing cartridge 5 in a detachable position, the limit switch 170 is turned on, so that the ON signals are outputted. As shown in FIG. 21, when the user further presses the push-piece 171 of the operating member 170 downward to the lowermost position in order to cut the thread T using the thread cutting mechanism 130, the limit switch 170 in the ON state is maintained, so that the ON signals are continuously outputted. Then, as the user releases the push-piece 171, the push-piece 171 automatically returns to its uppermost position by an urging force from a spring and the output of the ON signals are stopped on the way back to returning to the uppermost position. The control of the signals will be described later.

The game machine 6 has a computer including a CPU 6*a*, a ROM 6*b* and a RAM 6*c*, a DVD drive (DVDD) 6*d* capable of reading and-writing a DVD 120, a flash card connector 6*e*, input/output terminals 6*f*, 6*g*, an input terminal 6*h*, and an output terminal 6*i*, which are connected to each other via bus 6*j*. The input/output terminal 6*f* is connected to the input/output terminal 13*e* of the sewing apparatus 1. The controller 7 is connected to the input terminal 6*h*. The output terminal 6*i* is connected with a drive circuit (CRTD) 8*a* for the display (CRT) 8. The drive circuit 8*a* and display 8 could also be an LCD drive and display. The input/output terminal 6g can be connected with a telephone line 9*a*.

The DVD 120, as an external storage medium, stores various sewing data and programs so that the sewing data and the programs are readable by the computer. The DVD 120 can be attached to, or detached from the DVD drive 6*d*. When a DVD 120 storing game software for a video game is installed in the DVD drive 6*d*, a game screen is displayed on the display 8 according to the game software and a user can enjoy playing the game using the controller 7. Further, by connecting the input/output terminal 9*g* to the telephone line 9*a*, the sewing apparatus 1 can capture various data regarding sewing via the telephone line 9*a*, through a server 9*b* of an Internet provider, from a server 9*c* of a manufacturer of data and programs or a server 9*d* of another manufacturer. That is, various data regarding sewing provided from the manufacturers can be captured via the Internet 406.

In the sewing apparatus 1, an embroidery pattern can be formed on the work cloth 70 by controlling the embroidery frame driving mechanism 11 (the X-axis direction driving mechanism 20 and the Y-axis direction driving mechanism 30) and the cartridge driving mechanism 12 by the operational controller 13 based on the sewing data. A control program for sewing is stored in the ROM 13*b*. In one embodiment, various characters (e.g., persons, animals, and robots) to be displayed on the display 8 by the game software can be selected and edited using the game machine 6. Pattern data for sewing a selected/edited character can be created in the game machine 6 and can be supplied to the sewing apparatus 1.

Figure 37:
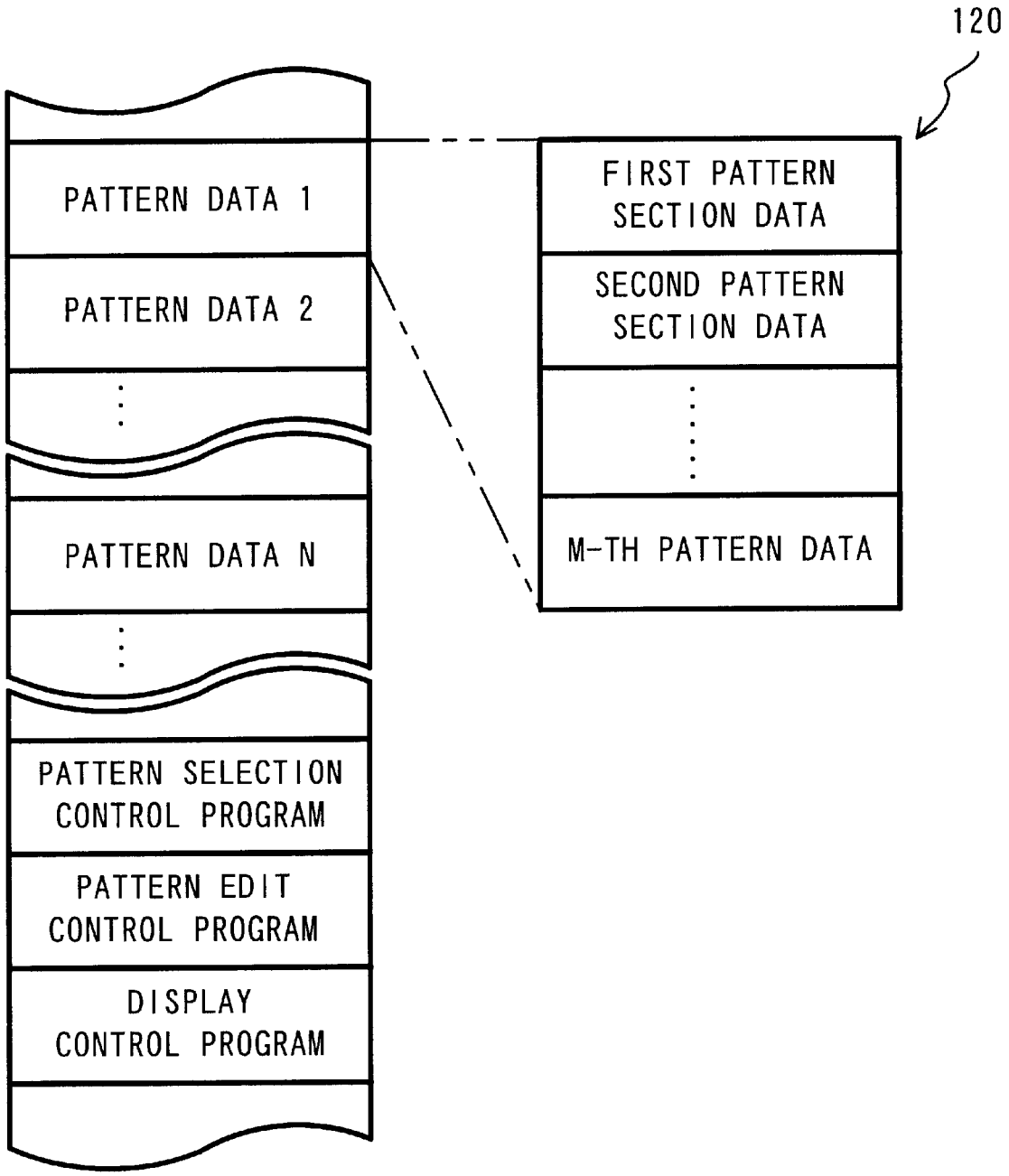
FIG. 37 is a diagram showing the data storage of a DVD.

Therefore, the DVD 120 for selecting/editing sewing data is provided for the game machine 6. That is, as shown in FIG. 37, the DVD 120 stores various kinds of embroidery patterns selected from game software as described above, pattern data of various kinds for prestored embroidery patterns, a pattern selection control program for selecting a desired embroidery pattern from the various kinds of embroidery patterns, a pattern edit control program for editing (e.g., enlargement, reduction, unification, and reversal) a selected embroidery pattern, and a display control program for displaying an embroidery pattern on the display 8 for selecting and setting. A flash card 121, connectable to the flash card connector 6*e*, can store pattern data of a selected/edited embroidery pattern.

The DVD 120 also stores a pattern data creation control program for creating pattern data by selecting/editing a character of game software based on data of the game software. When pattern data is created using the pattern data creation control program, first, the control program is downloaded into the RAM 6*c*, and then various kinds of characters are displayed by running the game software DVD. A character to be sewn is selected/edited, and pattern data for the character to be sewn is created. The created pattern data is stored in the DVD 120.

Next, a series of operations of the sewing apparatus 1 described above will be described with reference to the flowcharts of FIGS. 38 and 39. As shown in FIG. 1, it is assumed that the sewing apparatus 1 is connected with the game machine 6 via a connecting cable and the DVD 120 storing data of FIG. 37 is installed in the DVD drive 6*d* of the game machine 6. The game machine 6 is connected to the display 8 via the connecting cable.

First, an embroidery pattern is selected/edited using the controller 7 of the game machine 6 while observing a screen on the display 8. The embroidery pattern can be selected/edited without turning the power of the sewing apparatus 1 on.

Figure 38:
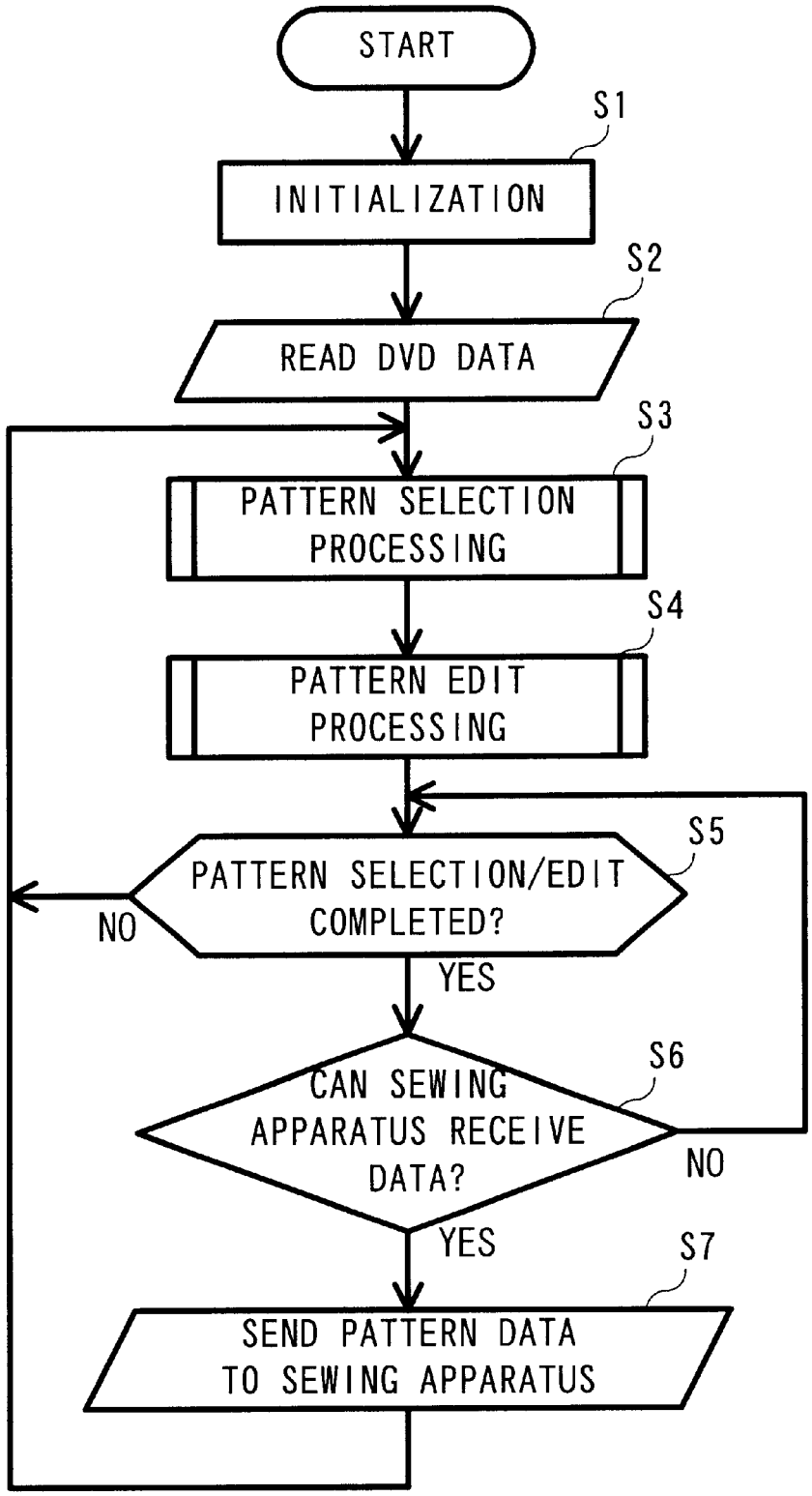
FIG. 38 is a control flowchart to be executed in the game machine.

As shown in FIG. 38, in a controller of the game machine 6, control is started when the power of the game machine 6 is turned on. After initialization (S1) (S stands for a step), data in the DVD 120 (such as the pattern selection control program, the pattern edit control program, and the display control program) are read (S2). Then, in pattern selection processing (S3), a desired embroidery pattern can be selected from various kinds of embroidery patterns stored in the DVD 120. In pattern edit processing (S4), a selected embroidery pattern can be edited (e.g., enlargement, reduction, unification, and reversal).

Selection/edit of the embroidery data is completed by operating a predetermined button of the controller 7 (S5;Yes). Then, when the sewing apparatus 1 can accept data (S6;Yes), the pattern data of the selected/edited embroidery pattern is sent to the sewing apparatus 1 (S7). After that, flow is returned to S3. When the sewing apparatus 1 cannot receive data, such that the power of the sewing apparatus 1 is not turned on (S6;No), flow returns to S5.

Figure 39:
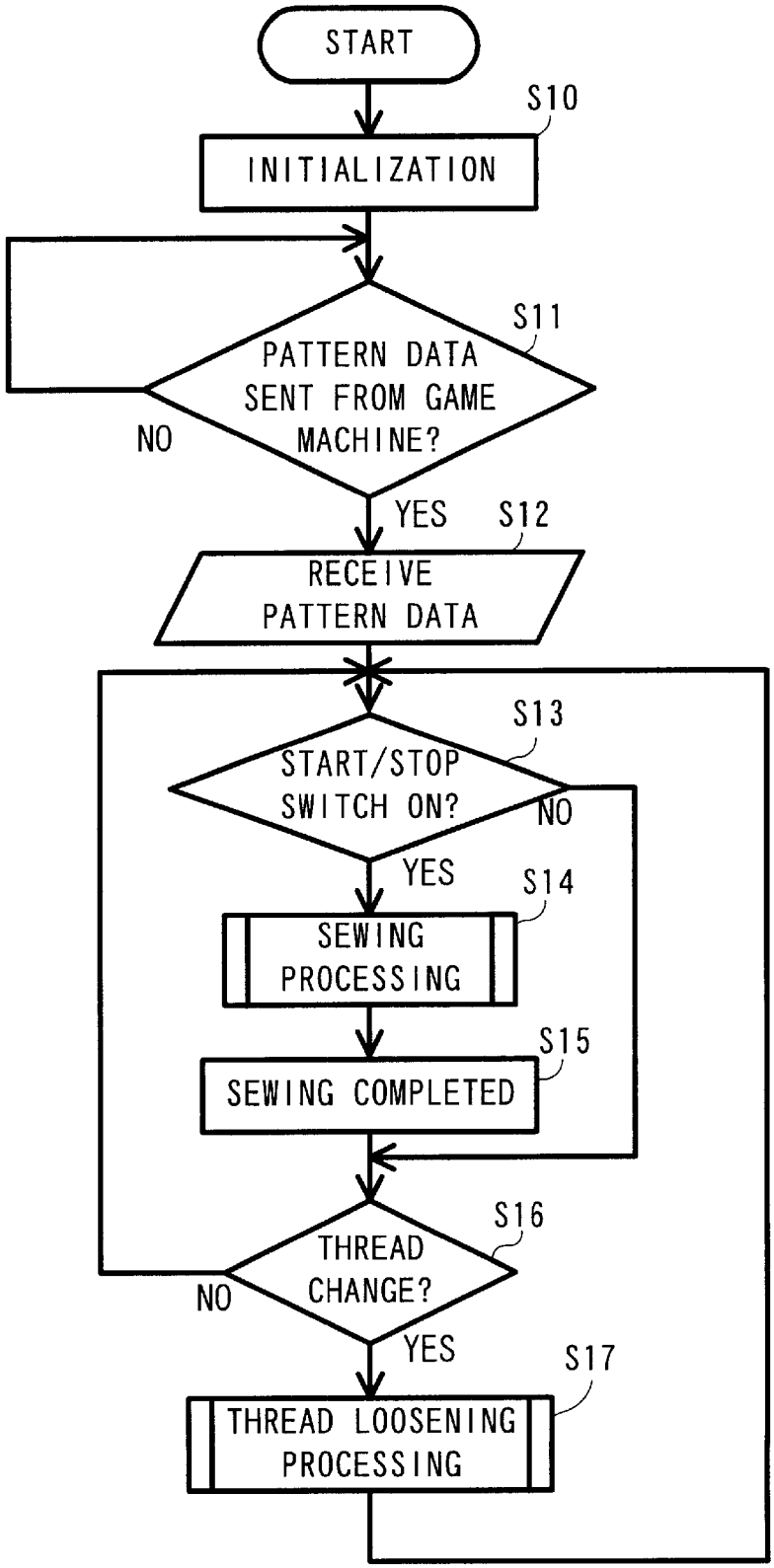
FIG. 39 is a control flowchart to be executed in the sewing apparatus.

As shown in FIG. 39, in the operational controller 13 of the sewing apparatus 1, control is started when the power switch 15 is turned on. After initialization (S10), the sewing apparatus 1 can receive data. When the selected/edited pattern data is sent from the game machine 6 (S11;Yes), the sewing apparatus 1 receives the pattern data (S12). Next, when the start/stop switch 16 is turned on (S13;Yes), sewing processing is performed based on the received pattern data (S14).

Preparation required prior to starting the sewing operation will now be described. In a state where the safety cover 3 of the sewing apparatus 1 is in the storage position shown in FIG. 2, the embroidery frame 4 having the work cloth 70 is inserted into the inside of the safety cover 3 from the embroidery frame insertion slot 3*f* while the embroidery frame 4 is guided by the guide member 69 of the safety cover 3. The installation portion 4*a* of the embroidery frame 4 is engaged with the engagement portion 18*a* of the carriage 18. As described above, the carriage 18 in which the embroidery frame 4 can be securely attached is positioned substantially under the oscillating arm 40. At initialization (S10), the carriage 18 is moved to this position and placed on standby. The safety cover 3 is in the storage position and the embroidery frame 4 slightly protrudes from the safety cover 3.

After the embroidery frame 4 is attached to the carriage 18, the guide member 69 is grasped and the safety cover 3 is slid forward so as to be placed in the sewing position. In this state, the cartridge insertion slot 68 is formed by the safety cover 3 and the casing 10. The sewing cartridge 5, accommodating a thread of a desired color, is inserted into the inside of the safety cover 3 from the cartridge insertion slot 68 and is attached to the oscillating arm 40. After this preparation is completed, the sewing process can be performed.

When the safety cover 3 is in a position other than the sewing position, the start/stop switch 16 cannot be operated because the start/stop switch 16 is covered with the safety cover 3. When the safety cover 3 is switched to the sewing position, the start/stop switch 16 is opposed to the switch operating hole 3*e*, so that the start/stop switch 16 can be operated. When the start/stop switch 16 is turned on (S13;Yes), the sewing processing (S14) is performed.

As shown in FIG. 37, pattern data of each embroidery pattern stored in the DVD 120 includes pattern section data of several pattern sections. The sewing cartridge is changed for every pattern section to change a thread color. That is, as shown in FIG. 39, when the start/stop switch 16 is turned on (S13;Yes), the sewing processing (S14) is performed. Based on the pattern data of one pattern section, the embroidery frame driving mechanism 11 and the cartridge driving mechanism 12 are controlled and the pattern section is sewn on the work cloth 70.

When one pattern section is formed, the sewing operation of the pattern section is finished (S15). When a pattern section to be sewn next has a different color, the sewing cartridge 5 is changed to another sewing cartridge 5 that has a thread having a color for a pattern section to be sewn. In this case, for example, when a thread change is commanded by operating a predetermined button of the controller 7 (S16;Yes) before the sewing cartridge 5 presently attached to the sewing apparatus body 2 is detached therefrom, thread loosening processing (S17) is performed in order to cut the thread and change the sewing cartridge 5.

In the thread cutting preparation processing of S17, the thread T extending between the pattern (work cloth 70) and the sewing cartridge 5 is placed between the cutting blades 133 and 134 of the thread cutting mechanism 130. Specifically, the embroidery frame driving mechanism 11 is controlled by the controller 13 (the CPU 13*a*) so that the embroidery frame 4 is placed at the farthest position within the embroidery frame moving area 38 and the thread T extends in the front to rear direction. The thread T is stretched to the extent that the thread T does not come off or out from the work cloth 70. It is essential only that the thread T be placed between the opened cutting blades 133 and 134.

Figure 41:
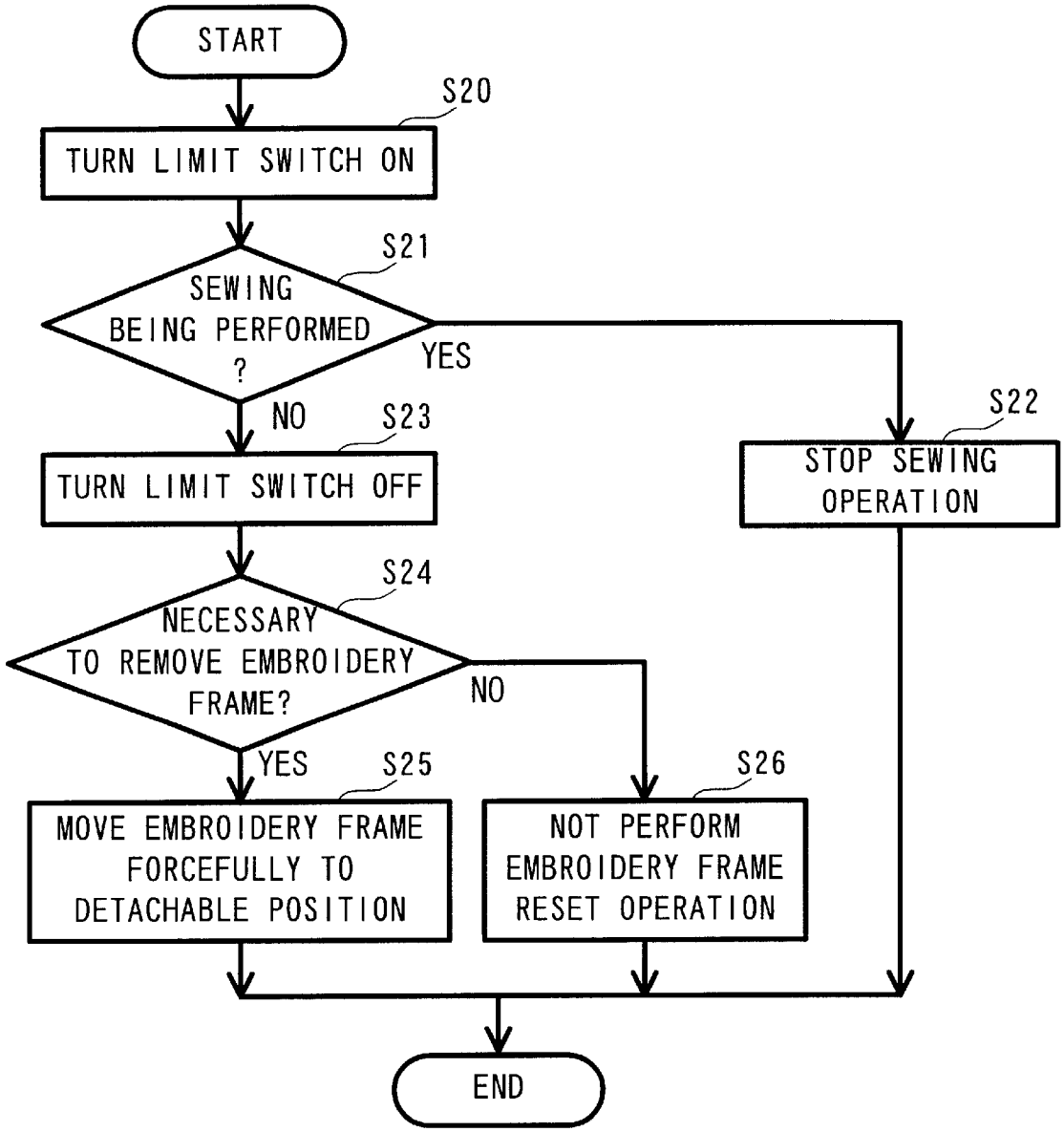
FIG. 41 is a subroutine control flowchart of detachment of the embroidery frame.

Then, as described above, when the push-piece 171 of the operating member 44*b* is pressed downward, the limit switch 170 is turned on and ON signals are outputted at the time the push-piece 171 enters the zone L1 from the zone L2 (S20 of a subroutine flowchart in FIG. 41). After that, the controller 13 (CPU 13*a*) determines whether the sewing operation is being performed (S21). The CPU 13*a* determines that the sewing operation being performed when the selected predetermined pattern section data has yet to be used.

When the CPU 13*a* determines that the sewing operation is being performed (S21;Yes), the CPU 13*a* immediately stops the sewing operation (S22), because the sewing cartridge 5 is placed in the detachable position by the rotation of the operating member 44*b* though the sewing operation is being performed. This case happens if the user presses the push-piece 77 by accident. The sewing cartridge 5 undesirably comes to be in the detachable position. By performing this processing, sewing failure, such that the hollow needle 81 penetrates the work cloth 70 from a slanting direction, and damages to parts, such as the sewing cartridge 5, can be more surely prevented.

In a case where the CPU 13*a* determines that the sewing operation is not being performed (S21;No), when the limit switch 170 is turned off, that is, after the thread cutting operation is completed (S23), the CPU 13*a* determines whether thread change is required, that is, the embroidery frame 4 needs to be detached (S24).

When the CPU 13*a* determines that the embroidery frame 4 needs to be detached (S24;Yes), the CPU 13*a* drives the pulse motor 35 to move the embroidery frame 4 in the Y direction in order to forcefully return the embroidery frame 4 to the frame detachable position (where the front end of the embroidery frame 4 protrudes from the embroidery frame insertion slot 3f) provided forward of the sewing apparatus 1. By doing so, the embroidery frame 4 holding the work cloth 70 on which the embroidery operation is completed, can be easily detached and pulled out from the embroidery frame insertion slot 3*f*.

When the embroidery frame 4 does not need to be detached (S24;No), because, for example, another embroidery pattern is to be formed in another position of the work cloth 70, the CPU 13*a* does not perform a reset operation to move the embroidery frame 4 to the frame detachable position (S26). In this case, the embroidery frame 4 is placed in a predetermined sewing start position.

When it is not necessary to change the sewing cartridge 5 (S24;No), the thread loosening processing at S17 does not need to be performed. That is, when the thread change is not commanded (S16;No), flow returns to S13. Accordingly, the start/stop switch 16 is turned on (S13;Yes) while the sewing operation is stopped (S15) and the sewing operation (S14) is started again. Thus, the next pattern section is formed.

As described above, according to the sewing apparatus 1, a desired embroidery pattern can be selected/edited from various kinds of embroidery patterns using the game machine 6. A selected/edited embroidery pattern can be sewn on a work cloth 70 attached to the embroidery frame 4. Further, a colorful embroidery pattern can be sewn using threads having different colors in several pattern sections forming the embroidery pattern. The work cloth 70 on which the embroidery pattern is sewn is removed from the embroidery frame 4 and is adhered with the double-sided adhesive tape 77. Thus, a patterned cloth 78 is obtained and can be attached to various items as an emblem.

The sewing apparatus 1 is convenient to carry and store because it is compact and lightweight. The embroidery frame 4 and the sewing cartridge 5 can be easily attached to and detached from the sewing apparatus 1. In the sewing apparatus 1 the safety cover 3 can be easily switched in its position between the storage position and the sewing position to attach/detach the embroidery frame 4 and the sewing cartridge 5 thereto/therefrom. The thread T extending between the hollow needle 81 and the work cloth 70 can be easily cut. Accordingly, the sewing apparatus 1 can be easily handled and operated.

In the aforementioned embodiment, a desired embroidery pattern is selected from various kinds of embroidery patterns stored in the DVD 120 and pattern data of the desired embroidery pattern is sent to the sewing apparatus 1 using the game machine 6. However, image data of a character in game software may be provided to the sewing apparatus 1 using the game machine 6 and pattern data may be created in the sewing apparatus 1 based on the image data.

The range of the zone that the limit switch 170 outputs the ON signal can be adjusted by changing the shape of the contact portion 173 and/or the position of the limit switch 170. For example, the range of the zone can be narrowed like a zone L10 indicated with a dot-and-dashed line as shown in FIG. 40. If it is designed that the limit switch 170 is turned on when the push-piece 171 is placed in a position extremely far from the uppermost position, the limit switch 170 is not turned on even if the user slightly presses the push-piece 171 by accident. Thus, the above-described control (S20 through S26) is not performed, so that the sewing failure and damages to parts can be prevented.

Although drawings are omitted, a sensor that detects the operation of the operating member 44*b* and the detachment of the sewing cartridge 5 from the sewing apparatus body 2, and an actuator, such as an electric motor, which actuates the thread cutting mechanism 130 may be provided. With this structure, the actuator is actuated according to a detection signal provided by the sensor to actuate the thread cutting mechanism 130.

In one embodiment, the limit switch 170 is turned on and off according to whether the contact portion 173 of the push-piece 171 comes into contact with and comes off the limit switch 170, thereby detecting the presence or absence of the sewing cartridge 5 and the mounting posture of the sewing cartridge 5. However, the limit switch 170 may be disposed near the mounting position of the sewing cartridge 5 so as to be turned on and off by the sewing cartridge 5 in accordance with the attachment and detachment of the sewing cartridge 5. Further, the sewing cartridge 5 may be attached to and detached from the sewing apparatus body using an electric actuator, such as a motor and a solenoid. In this case, the limit switch can be turned on and off by an operating member of the electric actuator or a member to be moved by the electric actuator, instead of the contact portion 173, in order to detect the presence or absence of the sewing cartridge 5 and the mounting posture of the sewing cartridge 5. In another embodiment, a control start signal can be regarded as the switching of the state of the limit switch 170 from off to on, in order to detect the presence or absence of the sewing cartridge 5 and the mounting posture of the sewing cartridge 5.

It is essential only that the control programs shown in FIGS. 39 and 41 be computer-readably stored in at least one of the DVD 120, the ROM 6*b* in the game machine 6, a hard disk on the server, and the ROM 13*b* in the sewing apparatus body 2. It is unnecessary to fixedly store the control programs. The control programs such as the pattern data may be sent to the sewing apparatus body 2 or the game machine 6 via the Internet.

According to a sewing apparatus of one embodiment of the invention, the sewing apparatus includes a sewing apparatus body, an oscillating arm that is oscillatably attached to the sewing apparatus body, an engaging member that engages the sewing cartridge so that the sewing cartridge can be attached and detached and an operating member that is disposed in the sewing apparatus body and is operated so as to move the engaging member in a disengagement direction from the sewing cartridge. In the sewing apparatus, the detecting device detects an operated position of the operating member, and the sewing control device controls the sewing operation so as to stop the sewing operation when it is determined that the detection signal from the detecting device indicates a disengagement position of the sewing cartridge during the sewing operation.

With this structure, even if the sewing cartridge is disengaged so as to be in the detachable position due to accidental operation of the operating member by the user, the detecting device can detect such a situation and automatically stop the sewing operation. Thus, the sewing apparatus does not perform undesired operation. Consequently, damage to the sewing apparatus and sewing cartridge can be more surely prevented.

According to another embodiment of the invention, the sewing apparatus further includes a thread cutting member that is disposed near the sewing cartridge, and an actuating member that rotates the thread cutting device in a thread cutting direction in conjunction with the operation of the operating member in the direction of disengaging the sewing cartridge. In the sewing apparatus, the sewing control device controls the holding frame to move to the detachable position when directing the detachment of the sewing cartridge.

With this structure, when the detachment or replacement of the sewing cartridge or holding frame is instructed, the actuator is rotated in the thread cutting direction in conjunction with the operation of the operating member in the direction of disengaging the sewing cartridge. Therefore, the thread extending between the sewing cartridge and the holding frame is automatically cut. The change of the posture of the sewing cartridge and the thread cutting operation can be achieved with single operation, so that operability can be improved. Further, the replacement or detachment of the sewing cartridge and the holding frame can be speedily and smoothly performed.

According to the sewing apparatus of the embodiment of the invention, the sewing apparatus further includes a sewing apparatus body, an oscillating arm that is oscillatably attached to the sewing apparatus body, a thread cutting member that disposed near the sewing cartridge, a movable engagement portion that is supported by the oscillating arm and pivotably supports the sewing cartridge, and a movable engaging member that supports the sewing cartridge so that the sewing cartridge can be attached and detached. In the sewing apparatus, the engaging member is operated in a disengagement direction of the sewing cartridge and an actuating lever that actuates the thread cutting device in conjunction with the operation of the operating member in the direction of disengaging the sewing cartridge. With this structure, the posture of the sewing cartridge can be changed to a posture where the sewing cartridge can be detached on the oscillating arm. The disengagement of the engaging member from the sewing cartridge and the thread cutting operation can be implemented at the same time by the operation of the operating member. The holding frame is moved to the detachable position after the engaging member is disengaged from the sewing cartridge and the thread cutting operation is completed. As a result, the holding frame can be extremely smoothly detached or replaced.

According to another embodiment of the invention, a computer-readable storage medium for a sewing apparatus that comprises a sewing cartridge, including at least one of a sewing needle moving up and down and a spool, a frame moving member that moves a holding frame to which a workpiece is attached, a detecting device that performs at least one of detection of the presence or absence of the sewing cartridge and detection of a mounting posture of the sewing cartridge, and a control device that controls the frame moving member for moving the holding frame, and sews a workpiece. The storage medium includes a computer program for moving the holding frame to a detachable position by driving the frame moving member by the control device in accordance with a detection signal from the detecting device.

Accordingly, with the use of the storage medium of this invention, the presence or absence of the sewing cartridge in the sewing apparatus and the posture of the sewing cartridge can be detected. As a result of the detection, if the condition of the sewing apparatus is inappropriate for the sewing operation, the holding frame is controlled so as not to be moved to the detachable position. By doing so, the holding frame is not moved due to the accidental operation by the user. Thus, damage to the sewing apparatus and parts of the sewing cartridge can be prevented.

When the sewing cartridge is in the posture where the sewing operation can be stopped, the holding frame is controlled to be moved to the detachable position. With this control, the replacement or detachment of the holding frame can be easily performed.

In the aforementioned embodiment, sewing data is supplied from the DVD 120, which is an external storage medium, via the home video game machine 6. However, sewing data may be supplied from other types of external storage mediums such as an optical recording medium (e.g., a CDROM, a CD-R), a magnetic recording medium (e.g. a floppy disk), and a semiconductor recording medium (e.g. a flash memory).

In the aforementioned embodiment, it is assumed that sewing data is stored in an external storage medium in advance. However, sewing data may be created by calculation of a CPU in the sewing apparatus body 2 or the game machine 6. For example, color image data of a game is divided by color and areas are specified by color. Then, the color-specific areas are specified as color-specific sewing areas. After that, sewing data for filling an area with Tatami stitches is created by color. Sewing data for stitching pattern sections so that boundary areas of the pattern sections overlap each other is created. Sewing data for stitching with Satin stitches as an outline of an embroidery pattern is created. A video capture function (a print screen function in a personal computer) can be used to capture image data as described above. A sequence of sewing of areas is determined based on size of areas and the lightness of the colors. However, an outline is preferably sewn last.

A data supply device connected to the sewing apparatus body 2 of the sewing apparatus 1 is not restricted to the home video game machine 6, but may be embroidery machines, computer sewing machines, radio-cassette players, satellite receiving tuners, karaoke terminals (including on-line and non on-line karaoke systems), facsimiles, cellar phones, televisions, videocassette recorders, music CD players, 8-millimeter video cameras, digital cameras, or computers, if the apparatus has a function of handling data. Data communications with the sewing apparatus body 2 may be implemented via a cable 401. However, wireless data communication (including infrared rays) may be implemented.

For example, when a satellite receiving tuner is used, main audio information may be used in a commercial and the satellite receiving tuner receives data and programs for the sewing apparatus body 2 through sub-audio information, which is not used for audio of the commercial while the commercial of the sewing apparatus 1, or other products are being run. Sewing may be performed by which data and programs received by the satellite receiving tuner are processed and the sewing apparatus body 2 is controlled. Data may be supplied to the sewing apparatus body 2 via other equipment, such as the home video game machine 6.

When the sub-audio information is used, advertising effectiveness may be ensured by which it is structured that the data and programs received by the satellite receiving tuner can be used only when the data is played back at a normal playback speed, in which the recorded commercial is watched, in a case where image data is recorded using a videocassette recorder. When a sewing machine is used as a data supply device, sewing can be performed using patterns installed in the sewing machine or patterns supplied from an external storage medium to be attached to the sewing machine. Sewing data is edited using a display and operating members provided on the sewing machine.

In the aforementioned embodiment, the sewing apparatus body 2 of the sewing apparatus 1 is directly connected with the data supply device via the connecting cable. The sewing apparatus body 2 may be connected with the data supply device via a converter 400 so as to be connected with other equipment described above. The converter 400 may be dedicated to various equipment described above, or may have several types of connecting portions. If such a converter 400 is used, there is a possibility that a general-purpose cable for connection can be used. The sewing apparatus body 2 may be connected with one or more data supply devices, such as a second game machine 402, a third game machine 403, a data supply device 404 other than the game machine, and a sewing machine 405, at the same time. The converter 400 may contribute to only data transmission, or may be provided with a CPU so that data can be edited or converted in the converter 400.

In the aforementioned embodiment, because a patterned cloth, such as an emblem, is adhered to clothes using a double-sided adhesive tape, the patterned cloth can be easily attached to and detached from the clothes. Instead of the double-sided adhesive tape, hook-and-loop fasteners may be used. In a case where an emblem is attached to clothes via a double-sided adhesive tape or hook-and-loop fasteners, the emblem can be easily removed from the clothes when the clothes are washed.

Although the invention has been described in detail with reference to specific embodiments thereof, it would be apparent to those skilled in the art that various changes and modifications may be made therein without departing from the spirit or scope of the invention.

What is claimed is:

1. A sewing apparatus comprising:

a needle that moves up and down;

a sewing cartridge designed to be able to accommodate a spool therein;

a holding frame to which a workpiece is attached;

a frame moving member that moves the holding frame;

a sewing operation member that performs a sewing operation on the workpiece while moving the holding frame in orthogonal directions;

a detecting device that performs at least one of detection of the presence or absence of the sewing cartridge and detection of a mounting posture of the sewing cartridge; and a sewing control device that moves the holding frame to a detachable position by moving the frame moving member in accordance with a detection signal from the detecting device.

2. The sewing apparatus according to claim 1, further comprising:

a sewing apparatus body;

an oscillating arm that is oscillatably attached to the sewing apparatus body;

an engaging member that engages the sewing cartridge so that the sewing cartridge can be attached and detached; and an operating member that is disposed in the sewing apparatus body and is operated so as to move the engaging member in a disengagement direction from the sewing cartridge, wherein the detecting device detects an operated position of the operating member, and the sewing control device controls the sewing operation so as to stop the sewing operation when it is determined that the detection signal from the detecting device indicates a disengagement position of the sewing cartridge during the sewing operation.

3. The sewing apparatus according to claim 2, further comprising:

a thread cutting member that is disposed near the sewing cartridge; and an actuating member that rotates the thread cutting device in a thread cutting direction in conjunction with operation of the operating member in the disengagement direction to detach the sewing cartridge, wherein the sewing control device controls the holding frame to move to the detachable position when directing the detachment of the sewing cartridge.

4. The sewing cartridge according to claim 1, further comprising:

a sewing apparatus body;

an oscillating arm that is oscillatably attached to the sewing apparatus body;

a thread cutting member that is disposed near the sewing cartridge;

a movable engagement portion that is supported by the oscillating arm and pivotably supports the sewing cartridge; and a movable engaging member that supports the sewing cartridge so that the sewing cartridge can be attached and detached;

wherein the engaging member is operated in a disengagement direction of the sewing cartridge and an actuating lever that actuates the thread cutting device in conjunction with the operation of the operating member in the disengagement direction to disengage the sewing cartridge.

5. A computer-readable storage medium for a sewing apparatus, said sewing apparatus comprising:

a sewing cartridge, including at least one of a sewing needle moving up and down and a spool, a frame moving member that moves a holding frame to which a workpiece is attached, a detecting device that performs at least one of detection of the presence or absence of the sewing cartridge and detection of a mounting posture of the sewing cartridge, and a control device that controls the frame moving member for moving the holding frame, and performs sewing operation on the workpiece, wherein the computer readable storage medium comprises:

a computer program for instructing the control device to move the holding frame to a detachable position by driving the frame moving member in accordance with a detection signal from the detecting device.

6. The computer readable storage medium according to claim 5, wherein said computer readable storage medium is a DVD.

7. The computer readable storage medium according to claim 6, further comprising:

a pattern selection control program that is stored in said DVD.

8. The computer readable storage medium according to claim 6, further comprising:

a pattern edit control program that is stored in said DVD.

9. The computer readable storage medium according to claim 6, further comprising:

a display control program that is stored in said DVD.

10. The computer readable storage medium according to claim 6, wherein the control device further comprises at least one of a CPU, a ROM and a RAM.

11. The computer readable storage medium according to claim 6, wherein the control device further comprises at least one of an input/output interface and an input/output terminal.

12. The computer readable storage medium according to claim 11, wherein the input/output interface is connected with a drive circuit for a pulse motor.

13. The computer readable storage medium according to claim 11, wherein the input/output interface is connected to an input/output terminal via a bus.

14. A method of operating a sewing apparatus having a needle that moves up and down, a sewing cartridge, a holding frame to which a workpiece is attached, a frame moving member, a sewing operation member that sews on a workpiece and a detecting device, comprising the steps of:

detecting at least one of the presence, absence or mounting posture of the sewing cartridge; and moving the holding frame to a detachable position by moving the frame moving member in accordance with a detection signal from the detecting device.

15. The method of claim 14, further comprising the steps of:

providing an operating member disposed in a sewing apparatus body;

operating the operating member to move an engaging member in a disengagement direction cartridge to disengage the sewing cartridge;

detecting the position of the operator member; and stopping a sewing operation when the detecting device indicates disengagement of the sewing cartridge.

16. The method of claim 15, further comprising the steps of:

disposing a thread cutting member near the sewing cartridge; and rotating the thread cutting device in a thread cutting direction in conjunction with operation of the operating member in the disengagement direction.

* * * * *